US010557219B1

(12) United States Patent
Su et al.

(10) Patent No.: US 10,557,219 B1
(45) Date of Patent: Feb. 11, 2020

(54) METHODS AND COMPOSITIONS FOR COOLING YARNS AND FABRICS COMPRISING A CELLULOSIC FIBER, AND ARTICLES COMPRISING SAME

(71) Applicant: BRRR! INC., Atlanta, GA (US)

(72) Inventors: Hung-Yuan Su, Taoyuan (TW); Ying-Pin Wei, HsinChu County (TW)

(73) Assignee: BRRR! Inc., Atlanta, GA (US)

( * ) Notice: Subject to any disclaimer, the term of this patent is extended or adjusted under 35 U.S.C. 154(b) by 0 days.

(21) Appl. No.: 16/263,614

(22) Filed: Jan. 31, 2019

Related U.S. Application Data

(60) Provisional application No. 62/785,771, filed on Dec. 28, 2018.

(51) Int. Cl.

| | |
|---|---|
| ***D03D 15/00*** | (2006.01) |
| ***D02G 3/38*** | (2006.01) |
| ***D02G 3/36*** | (2006.01) |
| ***D02G 3/02*** | (2006.01) |
| ***D03D 15/08*** | (2006.01) |
| *D03D 25/00* | (2006.01) |

(52) U.S. Cl.
CPC ..... *D02G 3/38* (2013.01); *D02G 3/02* (2013.01); *D02G 3/36* (2013.01); *D03D 15/08* (2013.01); *D03D 15/0027* (2013.01); *D10B 2201/24* (2013.01); *D10B 2331/02* (2013.01); *D10B 2331/04* (2013.01); *D10B 2501/00* (2013.01)

(58) Field of Classification Search
CPC .... D03D 15/08; D03D 15/0027; D03D 15/12; D03D 13/008; D03D 13/004; D03D 15/00; D01F 8/14; D01F 8/12; D01F 8/06; D01F 1/10; D01F 8/04; Y10T 428/2929; Y10T 428/2913; Y10T 428/2924; Y10T 442/3073; Y10T 428/2936; Y10T 442/3081; Y10T 442/3179; Y10T 428/249921; Y10T 442/3154; Y10T 428/2481; Y10T 428/2915; D04H 1/541
See application file for complete search history.

(56) References Cited

U.S. PATENT DOCUMENTS 2,855,758 A * 10/1958 Johnson ..... A41D 13/0053 62/4
3,093,160 A * 6/1963 Boggs ..... F16L 9/16 138/140
4,343,334 A * 8/1982 Schulze ..... D02G 3/36 139/420 R (Continued)

FOREIGN PATENT DOCUMENTS

WO 2012062480 5/2012

*Primary Examiner* — Robert H Muromoto, Jr.
(74) *Attorney, Agent, or Firm* — Thomas|Horstemeyer, LLP

(57) ABSTRACT

Composite fibers having a structure comprising a core component and sheath component, wherein each of the core component and the sheath component independently include a polymer and a disclosed cooling composition. In various further aspects, this application pertains to single-covered yarn including a core yarn comprising a disclosed composite fiber including a core component and a sheath component, and a first fiber including a cellulosic fiber, such that the first fiber is wrapped or surrounds the core fiber. In still further aspects, this application pertains to a woven or knit fabric including a disclosed single-covered yarn.

20 Claims, 13 Drawing Sheets

(56) References Cited

U.S. PATENT DOCUMENTS 4,896,406 A * 1/1990 Weingarten ..... D02G 3/367 28/166
4,958,485 A * 9/1990 Montgomery ..... D02G 3/367 428/377
5,509,430 A * 4/1996 Berger ..... A24D 3/065 131/341
6,240,716 B1 * 6/2001 Yanagawase ..... D02G 3/328 428/370
6,531,219 B1 * 3/2003 Fare' ..... D01F 8/06 428/370
6,606,846 B2 * 8/2003 Land ..... D02G 3/182 57/210
8,093,160 B2 * 1/2012 Tharpe, Jr. ..... D01H 1/00 442/191
10,260,175 B2 * 4/2019 Agzikara ..... D02G 3/324
10,337,128 B2 * 7/2019 Su ..... D03D 15/12
2005/0020172 A1 * 1/2005 Bansal ..... D01F 8/06 442/381
2008/0045105 A1 * 2/2008 Hara ..... D01F 1/103 442/200
2008/0268734 A1 * 10/2008 Tharpe ..... D01H 1/00 442/184
2008/0299855 A1 * 12/2008 Morihashi ..... D02G 3/36 442/181
2009/0068463 A1 * 3/2009 Mochizuki ..... D01F 8/12 428/370
2009/0191777 A1 * 7/2009 Liao ..... D03D 13/004 442/184
2013/0133353 A1 * 5/2013 Araujo ..... F25D 31/00 62/331
2013/0260129 A1 * 10/2013 Agzikara ..... D02G 3/324 428/221
2014/0101825 A1 * 4/2014 Vedula ..... D01F 6/70 2/243.1
2015/0240389 A1 * 8/2015 Chen ..... D01F 8/12 428/373
2015/0252500 A1 * 9/2015 Labsch ..... D02G 3/443 442/311
2016/0024699 A1 * 1/2016 Aldridge ..... G01V 3/38 442/337
2016/0160406 A1 * 6/2016 Agarwal ..... D03D 15/08 139/421
2016/0194791 A1 * 7/2016 Agarwal ..... D03D 15/08 139/421
2017/0275788 A1 * 9/2017 Agarwal ..... D03D 15/08
2018/0057972 A1 * 3/2018 Morrell ..... D02G 3/04
2019/0203385 A1 * 7/2019 Agzikara ..... D01H 5/70

* cited by examiner

METHODS AND COMPOSITIONS FOR COOLING YARNS AND FABRICS COMPRISING A CELLULOSIC FIBER, AND ARTICLES COMPRISING SAME

CROSS-REFERENCE TO RELATED APPLICATIONS

This Application claims the benefit of U.S. Provisional Application No. 62/785,771, filed on Dec. 28, 2018, which is incorporated herein by reference in its entirety.

BACKGROUND

Fabrics comprising cellulosic fibers are desirable by consumers for a variety of reasons. However, although fabrics comprising such fibers have a number of desirable characteristics, they also have shortcomings that are well known in the industry. For example, fabrics comprising cellulosic fibers, particularly regenerated cellulosic fibers, can be associated with poor dimensional stability (including a propensity to stretch), easily wrinkled, poor wicking, long drying times, and poor thermal conductivity, which can result in the fabric not feeling thermally cool under normal use. Although, cellulosic fibers are frequently blended with other natural and/or synthetic fibers to provide blended yarns designed to address some of the foregoing shortcomings, it has been found that the currently available blends of cellulosic fibers with other natural and/or synthetic fibers do not adequately address the range of deficiencies associated with cellulosic fibers.

Thus, despite advances in textile research, there remains an important need fabrics comprising cellulosic fibers that can address the know shortcomings of fabrics comprising such fibers such as poor wicking, drying time, dimensional stability, cooling properties, and thermal conductiveness, while maintaining the hand feel and function desired by consumers. These needs and other needs are satisfied by the present disclosure.

SUMMARY

In accordance with the purpose(s) of the disclosure, as embodied and broadly described herein, the disclosure, in one aspect, relates to composite fibers having a core component and a sheath component, wherein each of the core component and the sheath component independently comprise a polymer and a disclosed cooling composition.

Disclosed are cooling compositions comprising aluminum, calcium, copper, iron, magnesium, potassium, silicon, silver, sodium, titanium, zirconium, and combinations thereof.

Also disclosed are cooling polymer compositions comprising a polymer and a cooling composition comprising aluminum, calcium, copper, iron, magnesium, potassium, silicon, silver, sodium, titanium, zirconium, and combinations thereof.

Also disclosed are composite fibers comprising a core component and a sheath component, where: (a) the core component comprises a polyester polymer and a first cooling composition; and (b) the sheath component comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

Also disclosed are composite fibers comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 1 wt % to about 20 wt % based on the total weight of the polyester polymer and the first cooling composition; and wherein the second cooling composition is present in an amount from about 1 wt % to about 20 wt % based on the total weight of the polyamide polymer and the second cooling composition.

Also disclosed are composite fibers comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 0.1 wt % to about 25 wt % based on the total weight of the polyester polymer and the first cooling composition; wherein the first cooling composition comprises aluminum, calcium, copper, iron, magnesium, potassium, silicon, silver, sodium, titanium, zirconium, and combinations thereof; wherein the second cooling composition is present in an amount from about 0.1 wt % to about 35 wt % based on the total weight of the polyamide polymer and the second cooling composition; and wherein the second cooling composition comprises aluminum, calcium, copper, iron, magnesium, potassium, silicon, silver, sodium, titanium, zirconium, and combinations thereof.

Also disclosed are single-covered yarns comprising: (a) a core fiber comprising a disclosed composite fiber; and (b) a first fiber comprising a cellulosic fiber; wherein the first yarn is wound around the core yarn to form a single covered yarn.

Also disclosed are woven fabrics comprising: a weft yarn comprising a disclosed single-covered yarn; and a warp yarn.

Also disclosed are knit fabrics comprising a yarn comprising a disclosed single-covered yarn.

Also disclosed are articles comprising a yarn comprising a core component and a sheath component, where: (a) the core component comprises a polyester polymer and a first cooling composition; and (b) the sheath component comprises a polyamide polymer and a second cooling composition.

Also disclosed are articles comprising a disclosed single-covered yarn

Also disclosed are articles comprising a disclosed fabric.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE FIGURES

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A shows a side on cross-sectional view of a portion of a disclosed composite fiber with a cross-sectional view of an end thereof. An enlarged view of the cross-sectional end view is highlighted. A key is shown beneath the views indicating the gray-scale colors associated with a sheath component, a core component, and distribution of one or more cooling compositions in each of the sheath component and core component. FIG. 1B shows a cross-sectional view of a disclosed composite fiber, 100, with aspects specified as follows: a polyester core, 110; a first cooling composition, 112; a polyamide sheath, 115; and a second cooling composition, 117. FIG. 1C shows a cross-sectional view of a disclosed composite fiber, 120, with aspects specified as follows: a polyester core, 110; a polyamide sheath, 115; and a second cooling composition, 117. FIG. 1D shows a cross-sectional view of a disclosed composite fiber, 130, with aspects specified as follows: a polyester core, 110; a first cooling composition, 112; and a polyamide sheath, 115.

FIG. 2A shows the disclosed composite fiber at one magnification, with a 50 μm scalar bar shown in the lower right of the image. FIG. 2B shows the disclosed composite fiber at one magnification, with a 40 μm scalar bar shown in the lower right of the image. FIG. 2C shows the disclosed composite fiber at one magnification, with a 30 μm scalar bar shown in the lower right of the image.

FIG. 3A shows a disclosed fabric at one magnification, with a 500 μm scalar bar shown in the lower right of the image. FIG. 3B shows the disclosed warp yarn at a higher magnification compared to FIG. 3A, with a 1 mm scalar bar shown in the lower left of the image.

FIG. 4A shows the disclosed fabric at one magnification, with a 2 mm scalar bar shown in the lower right of the image. FIG. 4B shows the disclosed fabric at a higher magnification compared to FIG. 4A, with a 1 mm scalar bar shown in the lower right of the image. FIG. 4C shows the disclosed fabric at a higher magnification compared to FIG. 4A, with a 500 μm scalar bar shown in the lower right of the image.

FIG. 6A shows a schematic cross-sectional view of a disclosed single-covered yarn comprising a cellulosic fiber (e.g., a viscose rayon) wrapped around one or more composite fibers. FIG. 6B shows a cross-sectional view of a disclosed single-covered yarn, 1000, with aspects specified as follows: (a) a plurality of core fibers, 100*a*-100*d*, each comprising a disclosed composite fiber, such as that shown in FIG. 1B, comprising a core component comprising a polyester polymer and a first cooling composition, and a sheath component comprising a polyamide polymer and a second cooling composition; and (b) a plurality of first fibers, 200*a*-200*n*, comprising a cellulosic fiber; such that the plurality of first fibers are wound around the plurality of core fibers to form a single-covered yarn.

Figure 1A:
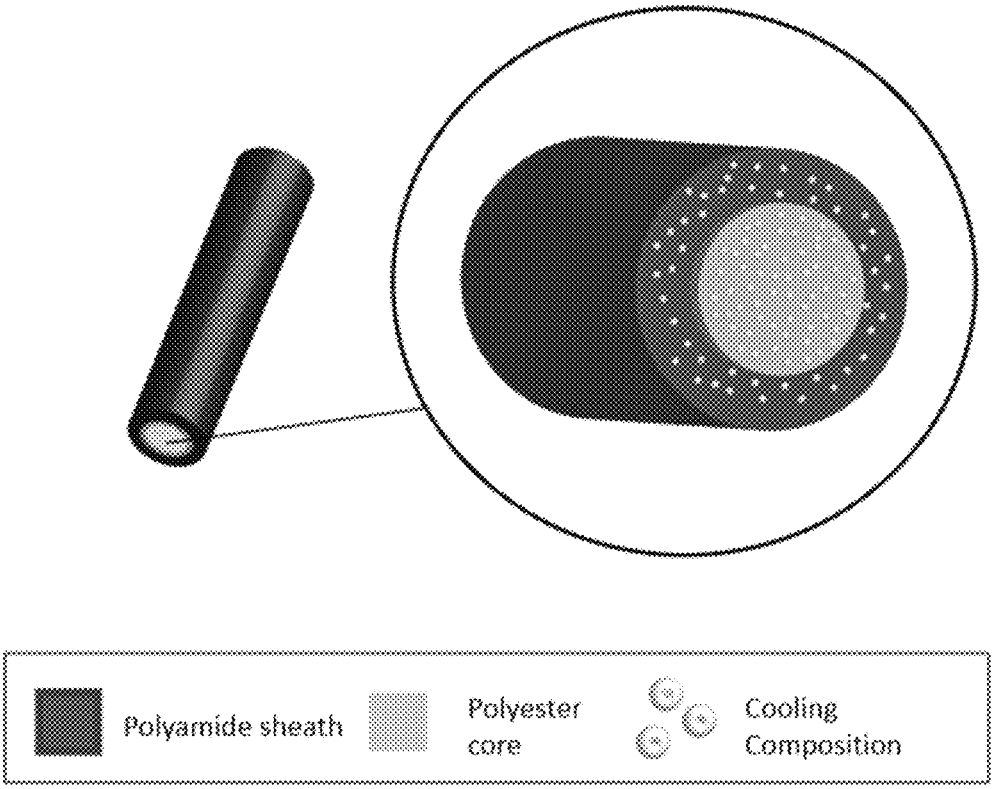
FIGS. 1A-1D show representative schematic views of a disclosed composite fiber.

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Prior to describing the various aspects of the present disclosure, the following definitions are provided and should be used unless otherwise indicated. Additional terms may be defined elsewhere in the present disclosure.

A. Definitions

As used herein, "comprising" is to be interpreted as specifying the presence of the stated features, integers, steps, or components as referred to, but does not preclude the presence or addition of one or more features, integers, steps, or components, or groups thereof. Additionally, the term "comprising" is intended to include examples and aspects encompassed by the terms "consisting essentially of" and "consisting of." Similarly, the term "consisting essentially of" is intended to include examples encompassed by the term "consisting of."

As used herein, the term "produced from" is synonymous to "comprising". As used herein, the terms "comprises," "comprising," "includes," "including," "has," "having," "contains" or "containing," or any other variation thereof, are intended to cover a non-exclusive inclusion. For example, a composition, process, method article, or apparatus that comprises a list of elements is not necessarily limited to only those elements but may include other elements not expressly listed or inherent to such composition, process, method, article, or apparatus.

The transitional phrase "consisting of" excludes any element, step, or ingredient not specified. If in the claim, such a phrase would close the claim to the inclusion of materials other than those recited except for impurities ordinarily associated therewith. When the phrase "consisting of" appears in a clause of the body of a claim, rather than immediately following the preamble, it limits only the element set forth in that clause; other elements are not excluded from the claim as a whole.

The transitional phrase "consisting essentially of" is used to define a composition, method or apparatus that includes materials, steps, features, components, or elements, in addition to those literally discussed, provided that the additional materials, steps features, components, or elements do not materially affect the basic and novel characteristic(s) of the claimed invention. The term "consisting essentially of" occupies a middle ground between "comprising" and "consisting of".

Further, unless expressly stated to the contrary, "or" refers to an inclusive "or" and not to an exclusive "or". For example, a condition A "or" B is satisfied by any one of the following: A is true (or present) and B is false (or not present), A is false (or not present) and B is true (or present), and both A and B are true (or present).

As used in the specification and the appended claims, the singular forms "a," "an" and "the" include plural referents unless the context clearly dictates otherwise. Thus, for example, reference to "a polymer," "a yarn," or "a fabric," including, but not limited to, two or more such polymers, yarns, or fabrics, and the like. Therefore "a" or "an" should be read to include one or at least one, and the singular word form of the element or component also includes the plural unless the number is obviously meant to be singular.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range. To further illustrate, when a range of "1 to 5" is recited, the recited range should be construed as including ranges "1 to 4", "1 to 3", "1-2", "1-2 & 4-5", "1-3 & 5", and the like.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The terms "decrease", "reduced", "reduction" "decrease" or "inhibit" are all used herein generally to mean a decrease by a statistically significant amount. However, for avoidance of doubt, "reduced", "reduction" or "decrease" or "inhibit" means a decrease by at least 10% as compared to a reference level, for example a decrease by at least about 20%, or at least about 30%, or at least about 40%, or at least about 50%, or at least about 60%, or at least about 70%, or at least about 80%, or at least about 90% or up to and including a 100% decrease (e.g. absent level as compared to a reference sample), or any decrease between 10-100% as compared to a reference level.

The terms "increased", "increase" or "enhance" or "activate" are all used herein to generally mean an increase by a statically significant amount; for the avoidance of any doubt, the terms "increased", "increase" or "enhance" or "activate" means an increase of at least 10% as compared to a reference level, for example an increase of at least about 20%, or at least about 30%, or at least about 40%, or at least about 50%, or at least about 60%, or at least about 70%, or at least about 80%, or at least about 90% or up to and including a 100% increase or any increase between 10-100% as compared to a reference level, or at least about a 2-fold, or at least about a 3-fold, or at least about a 4-fold, or at least about a 5-fold or at least about a 10-fold increase, or any increase between 2-fold and 10-fold or greater as compared to a reference level.

The term "statistically significant" or "significantly" refers to statistical significance and generally means at least two standard deviation (2SD) away from a reference level. The term refers to statistical evidence that there is a difference. It is defined as the probability of making a decision to reject the null hypothesis when the null hypothesis is actually true.

As used herein the terms "weight percent," "wt %," and "wt. %," which can be used interchangeably, indicate the percent by weight of a given component based on the total weight of a composition of which it is a component, unless otherwise specified. That is, unless otherwise specified, all wt % values are based on the total weight of the composition. It should be understood that the sum of wt % values for all components in a disclosed composition or formulation are equal to 100. Alternatively, if the wt % value is based on the total weight of a subset of components in a composition, it should be understood that the sum of wt % values the specified components in the disclosed composition or formulation are equal to 100.

As used herein, the term "effective amount" refers to an amount that is sufficient to achieve the desired modification of a physical property of the composition or material. For example, an "effective amount" of a cooling composition refers to an amount that is sufficient to achieve the desired improvement in the property modulated by the cooling composition, e.g. achieving the desired enhancement in Qmax compared to a yarn or fabric without the effective amount. The specific level in terms of wt % in a composition required as an effective amount will depend upon a variety of factors including the amount and type of polymer and yarn, fabric use, and the like.

As used herein, the terms "optional" or "optionally" means that the subsequently described event or circumstance can or cannot occur, and that the description includes instances where said event or circumstance occurs and instances where it does not.

The term "microscale" as used herein comprises a surface having a measurable feature in the range of from about 1 to about 1000 μm.

The term "nanoscale" as used herein comprises a surface having a measurable feature in the range of from about 1 to about 1000 nm.

The term "nanoparticle" as used herein comprises a nanoscale deposit of a homogenous or heterogeneous material. Nanoparticles may be regular or irregular in shape and may be formed from a plurality of co-deposited particles that form a composite nanoscale particle. Nanoparticles may be generally spherical in shape or have a composite shape formed from a plurality of co-deposited generally spherical particles. Exemplary shapes for the nanoparticles include, but are not limited to, spherical, rod, elliptical, cylindrical, disc, and the like. In some embodiments, the nanoparticles have a substantially spherical shape.

As used herein, reference to an element, e.g., a core component comprises Al, Ca, Cu, Fe . . . Zr" or "a core component comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum.

As used herein, the term "transition metal" means an element whose atom has a partially filled d sub-shell, or which can give rise to cations with an incomplete d sub-shell, typically found in Groups 3-12 of the periodic table in Periods 4-7. Exemplary, but non-limiting, transition metals include titanium, vanadium, chromium, manganese, iron, cobalt, nickel, copper, zinc, yttrium, zirconium, silver, tungsten, platinum, and gold.

As used herein, "nanosilver" and "nanosilver oxide," can be used interchangeably, and refer to silver oxide (i.e., silver (I) oxide, silver (II) oxide, or combinations thereof) in which the silver oxide is in a form comprising substantially a particulates, a powder, or combinations thereof, in which the particles and/or powder are nano-sized. That is the particles or powder, as appropriate, generally have a size of about 1 nm to about 1000 nm.

The term "denier" or abbreviated as "d" as used herein will be understood to be a relative measure of a fineness (or linear density) of a fiber or yarn. Denier is equivalent numerically to the weight in grams per 9,000 meters length of the material. The term "decitex" is another measure of a fineness of a fiber, which is equivalent to the weight in grams of a 10,000 meter length of the material.

As used herein, "multicomponent" refers to a fiber composed of more than one polymer.

As used herein, the term "fiber" refers to refers to any slender, elongated structure that can be carded, combed, or otherwise formed into a thread or filament. A fiber can comprise a natural material (e.g., cotton, linen or wool) or an artificial material (e.g., nylon, polyester). A fiber is a material in which the length to diameter ratio is greater than about 10. Fiber is typically classified according to its fineness. Fiber is generally defined as having a fiber fineness greater than about 15 denier, usually greater than about 30 denier. Fine denier fiber generally refers to a fiber having a fineness less than about 15 denier. Examples of fibers include "staple fibers", a term that is well-known in the textile art. A reference to "fiber" of "fibers" may mean or include individual fibers or a plurality or bulk of fibers as the situation requires. A plurality of fibers may comprise fibers of different compositions or may be substantially uniform in composition. Thus, by way of illustration, a reference to "natural fiber" or "synthetic fiber" may mean and may include a single fiber of such type, or may mean any quantity or plurality of such fibers and they may be comprised in threads, felts, yarns, fabrics materials etc., all as will be apparent from the context.

The fiber can be a synthetic fiber or a natural or organic fiber. As one of skill in the art is well aware, smoothness of the outer surfaces is significantly varied between different fibers. Accordingly, the outer surface of the fiber can be smooth or rough. By way of example only, manmade fibers, such as polyester fibers, usually have a smooth outer surface. In contrast, natural fibers, such as cotton, usually have a rough outer surface. One consequence of the roughness of the outer surface is that rough surfaces take more fluid to completely cover the surface per unit diameter.

As used herein, "fiber" refers to any one of the various types of matter that form the basic elements of a textile and that is characterized by a flexible, macroscopically homogeneous body having a high ratio of length to width and being small in cross section, and may include one or more fibrous materials (e.g., fibers or filaments). It is understood that "fiber" includes "filaments."

As used herein, "filament" refers generally to a continuous fiber of extremely long length, whereas a "staple fiber" means a fiber of finite length. A staple fiber can be a natural fiber or a fiber cut from, for example, a filament.

As used herein, "natural fibers" refer to fibers which are obtained from natural sources, such as cellulosic fibers and protein fibers, or which are formed by the regeneration of or processing of natural occurring fibers and/or products. Natural fibers are not intended to include fibers formed from petroleum products. Natural fibers include fibers formed from cellulose, such as cotton fiber and regenerated cellulose fiber, commonly referred to as rayon, or acetate fiber derived by reacting cellulose with acetic acid and acetic anhydride in the presence of sulfuric acid. As used herein, "natural fibers", are intended to include natural fibers in any form, including individual filaments, and fibers present in yarns, fabrics and other textiles, while "individual natural fibers" is intended to refer to individual natural filaments.

As used herein, the term "cellulosic fiber" is intended to refer to a fiber comprising cellulose, and include, but are not limited to, cotton, linen, flax, rayon, cellulose acetate, cellulose triacetate, hemp and ramie fibers.

As used herein, the term "non-cotton cellulosic" fiber, yarn, or fabric means fibers, yarns, or fabrics which are comprised primarily of a cellulose based composition other than cotton. Examples of such compositions include linen, ramie, jute, flax, rayon, lyocell, cellulose acetate, bamboo and other similar compositions which are derived from non-cotton cellulosics.

As used herein, the term "rayon fiber" is intended to include, but is not limited to, a fiber comprising viscose rayon, high wet modulus rayon, cuprammonium rayon, saponified rayon, modal rayon and lyocell rayon.

"Protein fibers", are intended to refer to fibers comprising proteins, and include, but are not limited to, wools, such as sheep wool, alpaca, vicuna, mohair, cashmere, guanaco, camel and llama, and silks.

As used herein, the term "synthetic fiber" refers to a fiber that is not prepared from naturally occurring filaments and include, but are not limited to, fibers made from components by polymerization, polycondensation or polyaddition. Materials for forming the synthetic fibers include, but are limited to, polyesters, polyamides such as nylons, polyacrylics, polyurethanes such as spandex, elastanes, elastodienes, fluoro fibers, acrylics, modacrylics, aramids, polyvinyl chlorides, polyvinylidene chloride, polyethylenes, polypropylenes and vinylals. Synthetic fibers include fibers formed from petroleum products. Synthetic-fiber containing materials are those that contain both the purely synthetic fiber and also natural materials.

"Polymers" are understood to include, but are not limited to, homopolymers, copolymers, such as for example, block, graft, random and alternating copolymers, terpolymers, etc. and blends and modifications thereof.

The term "polyamide" as used herein means the well-known fiber-forming substance that is a long-chain synthetic polyamide. The term particularly relates to poly (ε-caprolactam; "nylon 6") and poly (hexamethylene adipamide; "nylon 6,6") as well as their copolymers.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) which is a condensation product of ethylene glycol and terephthalic acid.

As used herein, the term "polyurethane-polyurea copolymer" refers to synthetic polymers sold as "spandex" or "elastane" under the brand names of LYCRA (Invista), ELASPAN (Invista), ACEPORA (Taekwang), CREORA (Hyosung), INVIYA (Indorama Corporation), ROICA and DORLASTAN (Asahi Kasei), LINEL (Fillattice), and ESPA (Toyobo).

The term "filament fiber" including "monofilament fiber" and "multifilament fiber" means a fiber comprising one or more continuous strands of natural or synthetic material of indefinite (i.e., not predetermined) length, as opposed to a "staple fiber" which is a discontinuous strand of fiber of definite length (i.e., a strand which has been cut or otherwise divided into segments of a predetermined length).

Filaments are generally formed by the melting of polymer pellets or another source of polymer which is then forced through an extrusion die to produce a continuous fiber. A filament can be a single continuous extrusion, or may be a chopped apart extrusion such as to form a staple. This fiber can then be texturized directly (which is uncommon), or can be combined with other filaments to form a filament bundle with the resultant filament bundle can then be texturized.

As used herein, "composite fiber" refers to a continuous fiber in which two distinct polymers are intimately adhered to each other along the length of the fiber. In some instances, a composite filament is a filament or fiber that is composed of at least two distinct polymers which have been spun together to form a single filament or fiber. By the term "distinct polymers" it is meant that each of the at least two polymeric components are arranged in distinct substantially constantly positioned zones across the cross-section of the composite fiber and extend substantially continuously along the length of the fiber. Composite fibers are distinguished from fibers that are extruded from a homogeneous melt blend of polymeric materials in which zones of distinct polymers are not formed. The at least two distinct polymeric components useable herein can be chemically different or they can be chemically the same polymer, but have different physical characteristics, such as tacticity, intrinsic viscosity, melt viscosity, die swell, density, crystallinity, and melting point or softening point. One or more of the polymeric components in the composite fiber can be a blend of different polymers. A composite fiber can have a fiber cross-section that is, for example, a side-by-side, eccentric sheath-core, concentratic sheath-core, or other suitable cross-section.

As understood herein, "filaments", which will be considered single strand synthetic fiber or polymer extrusions, and "yarns" or "filament bundles" are structures comprising a number of filaments combined together. For example, filaments are spun or otherwise interconnected, entangled, or arranged together form a filament bundle or yarn.

The term "yarn" refers a structure comprising a plurality of fibers that have been twisted, spun or otherwise joined together to form the yarn and may include spun yarns, continuous filament yarns, and yarns of core spun construction. The strands that that have been twisted, spun or otherwise joined together can be of natural or synthetic material, such as wool, nylon, or polyester, in a form suitable for sewing, knitting, weaving, or otherwise intertwining to form a textile fabric. In general, "yarn" refers to a product obtained when fibers are aligned. Yarns are products of substantial length and relatively small cross-section. Yarns may be single ply yarns, that is, having one yarn strand, or multiple ply yarns, such as 2-ply yarn that comprises two single yarns twisted together or 3-ply yarn that comprises three yarn strands twisted together. In various aspects, the disclosed composite fibers are used to prepare disclosed yarns. The disclosed yarns can be formed using staple fibers, using continuous fibers, or combinations thereof.

As used herein, "multifilament" means a yarn consisting of many continuous filaments or strands, as opposed to monofilament which is one strand. Most textile filament yarns are multifilament.

As used herein, "CSY" and "core spun yarn" can be used interchangeably to refer to a yarn made by twisting fibers around one or more core fibers or filaments, thus concealing the core fibers or filaments.

As used herein, "FDY" and "fully drawn yarn" can be used interchangeably to refer to filament yarns in which the draw ratio is normal so that full longitudinal orientation of polymer molecules.

As used herein, "POY" and "partially oriented yarn" can be used interchangeably to refer to filament yarns in which the draw ratio is less than normal so that only partial longitudinal orientation of the polymer molecules.

As used herein, the term "filament yarn" refers to a yarn that is composed of more than one fiber filaments that run the whole length of the yarn. Filament yarns can also be referred to as multi-filament yarns. The structure of a filament yarn is influenced by the amount of twist, and in some cases the fiber texturing. The properties of the filament yarn can be influenced by the structure of the yarn, fiber to fiber friction of the constituent fibers, and the properties of the constituent fibers. In some embodiments, the yarn structure and the recombinant protein fiber properties are chosen to impart various characteristics to the resulting yarns. The properties of the yarn can also be influenced by the number of fibers (i.e., filaments) in the yarn. The filament yarns disclosed herein can be multifilament yarns. Throughout this disclosure "filament yarns" can refer to flat filament yarns, textured filament yarns, drawn filament yarns, undrawn filament yarns, or filament yarns of any structure.

As used herein, the term "spun yarn" refers to a yarn that is made by twisting staple fibers together to make a cohesive yarn (or thread, or "single"). The structure of a spun yarn is influenced by the spinning methods parameters. The properties of the spun yarn are influenced by the structure of the yarn, as well as the constituent fibers.

As used herein, the term "blended yarn" refer to a type of yarn comprising various fibers being blended together.

As used herein, the term "warp direction" refers to the length direction or the machine direction of the fabric, and the term "weft direction" refers to the width direction or the cross machine direction of the fabric.

As used herein, the term "textile" shall mean a fiber, filament, yarn, fabric, or any article comprising fabrics and/or yarns, such as garments, articles of clothing, home goods, including, but not limited to, bed and table linens, linens, draperies and curtains, and upholsteries, and the like.

The term "articles of clothing" include any article of clothing including, for example, underwear, t-shirts, shirts, pants, socks, hats, diapers, and jackets.

As used herein, the term "garment" refers to wearable articles comprising fabrics or cloth to any item that is covers or protects some region of the user's body from weather or other factors in the environment outside the body. Exemplary garments, include, but are not limited to, coats, jackets, pants, hats, gloves, shoes, socks, shirts, blouses, dresses, coats, and the like. It is noted that the term "garment" is intended to cover clothing for human or animal use.

The term "linen" as used herein, refers to any article routinely washed in a residential or commercial washing machine besides articles of clothing, including, for example, sheets, blankets, towels, drapery, wash cloths, napkins, table cloths, and pillow cases.

As used herein, the term "fabric" is to be understood in its widest meaning. The term "fabric" may be used for all structures composed of fibers which have been manufactured according to a surface-forming method. Fabrics include materials where one or more different types of yarns, threads, filaments, or fibers that have been woven, knitted, felted, wrapped, spun, co-mingled, coated, coextruded, braided, entangled, applied or otherwise assembled into a desired material. Generally, the fabric has a structure which comprises a series of meshes or openings and filament bundles which define the mesh boundaries, such as woven, knitted, knotted, interwoven or tufted structures. Without limitations, the term "fabric" is intended to include woven fabrics, yarn sheets, knitted fabrics and non-woven fabrics. Further, the fabrics may be constructed from a combination of fibers, threads or yarns. Fabrics comprising different fibers, threads or yarns are also referred to as fabric blends herein. A knitted fabric may be flat knit, circular knit, warp knit, narrow elastic, and lace. A woven fabric may be of any construction, for example sateen, twill, plain weave, oxford weave, basket weave, and narrow elastic and the like.

As used herein, the term "cloth" refers to any textile fabric woven, nonwoven, felted, knitted or otherwise formed from any filament or fiber or plurality of filaments or fibers, including but not limited to thread yarn, monofilaments, and ribbons. Further, the term cloth is intended to include within its scope not only woven, knitted, non-woven, and felted materials, but also sheet materials.

As used herein, the term "strand" is being used as a term generic to both "fiber" and filament". In this regard, "filaments" are referring to continuous strands of material while "fibers" mean cut or discontinuous strands having a definite length. Thus, while the following discussion may use "strand" or "fiber" or "filament", the discussion can be equally applied to all three terms.

As used herein, the term "wicking" refers to the passage of liquids along or through a textile material or a textile element of a coated fabric, or along interstices formed by a textile element and a coating polymer of a coated fabric. Wicking involves a spontaneous transport of a liquid driven into a porous system by capillary forces.

Unless otherwise specified, temperatures referred to herein are based on atmospheric pressure (i.e. one atmosphere).

B. Cooling Compositions

In one aspect, the disclosure relates to cooling compositions that can be used in manufacture of a yarn. More specifically, in one aspect, the present disclosure relates to a cooling polymer composition comprising a polymer and a cooling composition comprising a cooling material, a cooling compound, a cooling salt, or combinations thereof. Disclosed cooling polymer compositions can be fabricated in chips or pellets for use in a yarn or filament spinning apparatus or machine.

In various aspects, the polymer in a disclosed cooling polymer composition can comprise a polyester polymer, such as a polyethylene terephthalate, a polytrimethylene terephthalate, or combinations thereof. In some aspects, the polyester can comprise a polyethylene terephthalate. In further aspects, the polyester can comprise a polytrimethylene terephthalate. In still further aspects, the polyester is a polyeseter co-polymer comprising a polyethylene terephthalate, a polytrimethylene terephthalate, or combinations thereof. In a yet further aspect, the polyester can comprise a co-polymer comprising polyethylene terephthalate. In a further aspect, the polyester can comprise a co-polymer comprising polytrimethylene terephthalate.

In various aspects, the polymer in a disclosed cooling polymer composition can comprise a polyamide polymer, such as a nylon 6, nylon 4/6, nylon 6/6, nylon 6/10, nylon 6/12, nylon 11, nylon 12, or combinations thereof. In a further aspect, the polyamide can comprise a nylon 6/6. In a still further aspect, the polyamide is a polyamide co-polymer comprising nylon 6, nylon 4/6, nylon 6/6, nylon 6/10, nylon 6/12, nylon 11, nylon 12, or combinations thereof. In a yet further aspect, the polyamide is a polyamide co-polymer comprising nylon 6/6.

In an aspect, the cooling composition can be present in the cooling polymer composition present in an amount of about 0.001 wt % to about 5 wt % based on the total weight of the polymer and the cooling composition. In a further aspect, the cooling composition can be present in an amount, based on the total weight of the polymer and the cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the cooling composition can be present in an amount of about 5.0 wt % to about 25 wt % based on the total weight of the polymer and the cooling composition. In a further aspect, the cooling composition can be present in an amount, based on the total weight of the polymer and the cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the cooling material can be present in the cooling composition in an amount of about 0.2 wt % to about 2 wt % of the cooling material; about 0.02 wt % to about 0.07 wt % of the cooling compound; about 0.001 wt % to about 0.02 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 0.5 wt % to about 1 wt % of the cooling material; about 0.03 wt % to about 0.05 wt % of the cooling compound; about 0.001 wt % to about 0.01 wt % of the cooling salt; or combinations thereof; and wherein the wt % is based on the total weight of the polymer and the cooling composition. In a yet further aspect, the cooling material can be present in the cooling composition in an amount of about 0.2 wt % to about 2 wt % of the cooling material; about 0.02 wt % to about 0.07 wt % of the cooling compound; and about 0.001 wt % to about 0.02 wt % of the cooling salt; and wherein the wt % is based on the total weight of the polymer and the cooling composition. In an even further aspect, the cooling material can be present in the cooling composition in an amount of about 0.5 wt % to about 1 wt % of the cooling material; about 0.03 wt % to about 0.05 wt % of the cooling compound; and about 0.001 wt % to about 0.01 wt % of the cooling salt; and wherein the wt % is based on the total weight of the polymer and the cooling composition.

In a further aspect, the cooling material can be present in the cooling composition in an amount of about 3.0 wt % to about 10.0 wt % of the cooling material; about 5.0 wt % to about 12.0 wt % of the cooling compound; about 0.3 wt % to about 4.0 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 4.0 wt % to about 8.0 wt % of the cooling material; about 5.5 wt % to about 11.0 wt % of the cooling compound; about 0.4 wt % to about 3.0 wt % of the cooling salt; or combinations thereof; and wherein the wt % is based on the total weight of the polymer and the cooling composition. In a yet further aspect, the cooling material can be present in the cooling composition in an amount of about 4.5 wt % to about 7.7 wt % of the cooling material; about 5.9 wt % to about 11.0 wt % of the cooling compound; and about 0.4 wt % to about 2.5 wt % of the cooling salt; and wherein the wt % is based on the total weight of the polymer and the cooling composition. In an even further aspect, the cooling material can be present in the cooling composition in an amount of about 5.0 wt % to about 7.2 wt % of the cooling material; about 6.4 wt % to about 10.5 wt % of the cooling compound; and about 0.5 wt % to about 2.1 wt % of the cooling salt; and wherein the wt % is based on the total weight of the polymer and the cooling composition. In a still further aspect, the cooling material can be present in the cooling composition in an amount of about 5.0 wt % to about 7.0 wt % of the cooling material; about 6.7 wt % to about 10.0 wt % of the cooling compound; and about 0.59 wt % to about 2.0 wt % of the cooling salt; and wherein the wt % is based on the total weight of the polymer and the cooling composition.

In a further aspect, the cooling material can be present in the cooling composition in an amount of about 0.2 wt % to about 2 wt %; and wherein the wt % is based on the total weight of the polymer and the cooling composition. In a still further aspect, the cooling material can be present in an amount of about 0.4 wt % to about 1 wt %; and wherein the wt % is based on the total weight of the polymer and the cooling composition. In a yet further aspect, the cooling material can be present in an amount of about 0.5 wt % to about 0.9 wt %; and wherein the wt % is based on the total weight of the polymer and the cooling composition.

In a further aspect, the cooling material can be present in the cooling composition in an amount of about 3.0 wt % to about 10.0 wt %; and wherein the wt % is based on the total weight of the polymer and the cooling composition. In a still further aspect, the cooling material can be present in an amount of about 4.0 wt % to about 8.0 wt %; and wherein the wt % is based on the total weight of the polymer and the cooling composition. In a yet further aspect, the cooling material can be present in an amount of about 4.5 wt % to about 7.7 wt %; and wherein the wt % is based on the total weight of the polymer and the cooling composition. In a still further aspect, the cooling material can be present in an amount of about 5.0 wt % to about 7.2 wt %; and wherein the wt % is based on the total weight of the polymer and the cooling composition. In an even further aspect, the cooling material can be present in an amount of about 5.0 wt % to about 7.0 wt %; and wherein the wt % is based on the total weight of the polymer and the cooling composition.

In a further aspect, the cooling material can be present in the cooling composition, based on the total weight of the polymer and the cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the cooling material can be present in the cooling composition, based on the total weight of the polymer and the cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the cooling material comprises a metal, a metal alloy, a metal oxide, a carbon material, a ceramic material, a mineral, or combinations thereof.

In a further aspect, the cooling material comprises a metal oxide. Exemplary, but non-limiting, metal oxides useful for preparation of the cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the cooling material comprises a ceramic comprising aluminum oxide, aluminum titanate, zirconium oxide, aluminum nitride, silicon carbide, silicon nitride, silicon alumina nitride, or combinations thereof.

In a further aspect, the cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the cooling material, comprising a metal, a metal alloy, a metal oxide, a carbon material, a ceramic material, a mineral, or combinations thereof, can be in a form that is convenient for incorporation into the cooling polymer composition, such as a powder, a wire, a filament, a sheet, a particle, or combinations thereof. In other instances, the cooling material, comprising a metal, a metal alloy, a metal oxide, a carbon material, a ceramic material, a mineral, or combinations thereof, can be in the form of a particle, a powder, or combinations thereof. In some instances, the cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the cooling material is a metal, a metal alloy, a metal oxide, a carbon material, a ceramic material, a mineral, or combinations thereof, comprising microparticles. The microparticles in the cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the cooling compound can be present in the cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polymer and the cooling composition; and wherein the wt % is based on the total weight of the polymer and the cooling composition.

In a further aspect, the cooling compound can be present in the cooling polymer composition, based on the total weight of the polymer and the cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the cooling compound can be present in the cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polymer and the cooling composition.

In a further aspect, the cooling compound can be present in the cooling polymer composition, based on the total weight of the polymer and the cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The cooling compound can comprise a transition metal oxide, a Group 13 oxide, a Group 14 oxide, a Group 13 carbide, Group 14 carbide, or mixtures thereof. In some instances, the cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the cooling compound can comprise aluminum oxide, silicon dioxide, titanium dioxide, or combinations thereof. In a still further aspect, the cooling compound can comprise titanium dioxide. The cooling compound can be in the form of a powder, a particle, or combinations thereof. In a further aspect, the cooling compound can be in the form of a particle, such as a nanoparticle, a microparticle, or combinations thereof.

In various aspects, the cooling compound can be in a form that is convenient for incorporation into the cooling polymer composition, such as a powder, a wire, a filament, a sheet, a particle, or combinations thereof. In other instances, the cooling compound can be in the form of a particle, a powder, or combinations thereof. In some instances, the cooling compound is in the form of a particle, including forms such as a nanoparticle, a microparticle, or combinations thereof.

In various aspects, the cooling compound comprises a particle form of the cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the cooling compound comprises a particle form of the cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the cooling compound can comprise nanoparticles having a size of about 10 nm to about 100 nm. In a still further aspect, the cooling compound can comprise nanoparticles having a size of about 15 nm to about 50 nm. In a yet further aspect, the cooling compound can comprise nanoparticles having a size of about 20 nm to about 40 nm. In an even further aspect, the cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the cooling composition comprises a cooling salt present in an amount, based on the total weight of the polymer and the cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the cooling composition comprises a cooling salt present in an amount, based on the total weight of the polymer and the cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The cooling composition comprises a cooling salt comprising a transition metal salt, a Group I salt, a Group II salt, or combinations thereof. In some instances, the cooling salt is a Group I salt. In other instances, the cooling salt is a Group II salt. In further instances, the cooling salt is a transition metal salt. The cooling salt can comprise a Group I carbonate, a Group I halide, a Group I nitrate, or combinations thereof. Alternatively, the cooling salt can comprise a Group II carbonate, a Group II halide, a Group II nitrate, or combinations thereof. In further aspects, the cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the cooling salt can be in a form that is convenient for incorporation into the cooling polymer composition, such as a powder, a wire, a filament, a sheet, a particle, or combinations thereof. In other instances, the cooling salt can be in the form of a particle, a powder, or combinations thereof. In some instances, the cooling salt is in the form of a particle, including forms such as a nanoparticle, a microparticle, or combinations thereof.

The cooling salt in the cooling composition can be in the form of a powder, a particle, or combinations thereof. In some aspects, the cooling salt in the cooling composition comprises particles having a size of about 10 μm to about 1000 μm. In a further aspect, the salt in the cooling composition comprises particles having a size of about 30 μm to about 500 μm.

In various aspects, the cooling salt in the cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390

μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the cooling salt can comprise nanoparticles having a size of about 10 nm to about 100 nm. In a still further aspect, the cooling salt can comprise nanoparticles having a size of about 15 nm to about 50 nm. In a yet further aspect, the cooling salt can comprise nanoparticles having a size of about 20 nm to about 40 nm. In an even further aspect, the cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In one aspect, the disclosure relates to cooling compositions that can be used in manufacture of a yarn, e.g., a cooling polymer composition comprising a polymer and a cooling composition comprising a cooling material, a cooling compound, a cooling salt, or combinations thereof. Disclosed cooling polymer compositions can be fabricated in chips or pellets for use in a yarn or filament spinning apparatus or machine.

In various aspects, the polymer in a disclosed cooling polymer composition can comprise a polyester polymer, such as a polyethylene terephthalate, a polytrimethylene terephthalate, or combinations thereof. In some aspects, the polyester can comprise a polyethylene terephthalate. In further aspects, the polyester can comprise a polytrimethylene terephthalate. In still further aspects, the polyester is a polyeseter co-polymer comprising a polyethylene terephthalate, a polytrimethylene terephthalate, or combinations thereof. In a yet further aspect, the polyester can comprise a co-polymer comprising polyethylene terephthalate. In a further aspect, the polyester can comprise a co-polymer comprising polytrimethylene terephthalate.

In various aspects, the polymer in a disclosed cooling polymer composition can comprise a polyamide polymer, such as a nylon 6, nylon 4/6, nylon 6/6, nylon 6/10, nylon 6/12, nylon 11, nylon 12, or combinations thereof. In a further aspect, the polyamide can comprise a nylon 6/6. In a still further aspect, the polyamide is a polyamide co-polymer comprising nylon 6, nylon 4/6, nylon 6/6, nylon 6/10, nylon 6/12, nylon 11, nylon 12, or combinations thereof. In a yet further aspect, the polyamide is a polyamide co-polymer comprising nylon 6/6.

In an aspect, the cooling composition can be present in the cooling polymer composition present in an amount of about 0.001 wt % to about 5 wt % based on the total weight of the polymer and the cooling composition. In a further aspect, the cooling composition can be present in an amount, based on the total weight of the polymer and the cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the cooling composition can be present in an amount of about 5.0 wt % to about 25 wt % based on the total weight of the polymer and the cooling composition. In a further aspect, the cooling composition can be present in an amount, based on the total weight of the polymer and the cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the cooling material can be present in the cooling composition in an amount of about 0.2 wt % to about 2 wt % of the cooling material; about 0.02 wt % to about 0.07 wt % of the cooling compound; about 0.001 wt % to about 0.02 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 0.5 wt % to about 1 wt % of the cooling material; about 0.03 wt % to about 0.05 wt % of the cooling compound; about 0.001 wt % to about 0.01 wt % of the cooling salt; or combinations thereof; and wherein the wt % is based on the total weight of the polymer and the cooling composition. In a yet further aspect, the cooling material can be present in the cooling composition in an amount of about 0.2 wt % to about 2 wt % of the cooling material; about 0.02 wt % to about 0.07 wt % of the cooling compound; and about 0.001 wt % to about 0.02 wt % of the cooling salt; and wherein the wt % is based on the total weight of the polymer and the cooling composition. In an even further aspect, the cooling material can be present in the cooling composition in an amount of about 0.5 wt % to about 1 wt % of the cooling material; about 0.03 wt % to about 0.05 wt % of the cooling compound; and about 0.001 wt % to about 0.01 wt % of the cooling salt; and wherein the wt % is based on the total weight of the polymer and the cooling composition.

In a further aspect, the cooling material can be present in the cooling composition in an amount of about 3.0 wt % to about 10.0 wt % of the cooling material; about 5.0 wt % to about 12.0 wt % of the cooling compound; about 0.3 wt % to about 4.0 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 4.0 wt % to about 8.0 wt % of the cooling material; about 5.5 wt % to about 11.0 wt % of the cooling compound; about 0.4 wt % to about 3.0 wt % of the cooling salt; or combinations thereof; and wherein the wt % is based on the total weight of the polymer and the cooling composition. In a yet further aspect, the cooling material can be present in the cooling composition in an amount of about 4.5 wt % to about 7.7 wt % of the cooling material; about 5.9 wt % to about 11.0 wt % of the cooling compound; and about 0.4 wt % to about 2.5 wt % of the cooling salt; and wherein the wt % is based on the total weight of the polymer and the cooling composition. In an even further aspect, the cooling material can be present in the cooling composition in an amount of about 5.0 wt % to about 7.2 wt % of the cooling material; about 6.4 wt % to about 10.5 wt % of the cooling compound; and about 0.5 wt % to about 2.1 wt % of the cooling salt; and wherein the wt % is based on the total weight of the polymer and the cooling composition. In a still further aspect, the cooling material can be present in the cooling composition in an amount of about 5.0 wt % to about 7.0 wt % of the cooling material; about 6.7 wt % to about 10.0 wt % of the cooling compound; and about 0.59 wt % to about 2.0 wt % of the cooling salt; and wherein the wt % is based on the total weight of the polymer and the cooling composition.

In a further aspect, the cooling material can be present in the cooling composition in an amount of about 0.2 wt % to about 2 wt %; and wherein the wt % is based on the total weight of the polymer and the cooling composition. In a still further aspect, the cooling material can be present in an amount of about 0.4 wt % to about 1 wt %; and wherein the wt % is based on the total weight of the polymer and the cooling composition. In a yet further aspect, the cooling material can be present in an amount of about 0.5 wt % to about 0.9 wt %; and wherein the wt % is based on the total weight of the polymer and the cooling composition.

In a further aspect, the cooling material can be present in the cooling composition in an amount of about 3.0 wt % to about 10.0 wt %; and wherein the wt % is based on the total weight of the polymer and the cooling composition. In a still further aspect, the cooling material can be present in an amount of about 4.0 wt % to about 8.0 wt %; and wherein the wt % is based on the total weight of the polymer and the cooling composition. In a yet further aspect, the cooling material can be present in an amount of about 4.5 wt % to about 7.7 wt %; and wherein the wt % is based on the total weight of the polymer and the cooling composition. In a still further aspect, the cooling material can be present in an amount of about 5.0 wt % to about 7.2 wt %; and wherein the wt % is based on the total weight of the polymer and the cooling composition. In an even further aspect, the cooling material can be present in an amount of about 5.0 wt % to about 7.0 wt %; and wherein the wt % is based on the total weight of the polymer and the cooling composition.

In a further aspect, the cooling material can be present in the cooling composition, based on the total weight of the polymer and the cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the cooling material can be present in the cooling composition, based on the total weight of the polymer and the cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the cooling material comprises a metal, a metal alloy, a metal oxide, a carbon material, a ceramic material, a mineral, or combinations thereof.

In a further aspect, the cooling material comprises a metal oxide. Exemplary, but non-limiting, metal oxides useful for preparation of the cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the cooling material comprises a ceramic comprising aluminum oxide, aluminum titanate, zirconium oxide, aluminum nitride, silicon carbide, silicon nitride, silicon alumina nitride, or combinations thereof.

In a further aspect, the cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the cooling material, comprising a metal, a metal alloy, a metal oxide, a carbon material, a ceramic material, a mineral, or combinations thereof, can be in a form that is convenient for incorporation into the cooling polymer composition, such as a powder, a wire, a filament, a sheet, a particle, or combinations thereof. In other instances, the cooling material, comprising a metal, a metal alloy, a metal oxide, a carbon material, a ceramic material, a mineral, or combinations thereof, can be in the form of a particle, a powder, or combinations thereof. In some instances, the cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the cooling material is a metal, a metal alloy, a metal oxide, a carbon material, a ceramic material, a mineral, or combinations thereof, comprising microparticles. The microparticles in the cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the cooling compound can be present in the cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polymer and the cooling composition; and wherein the wt % is based on the total weight of the polymer and the cooling composition.

In a further aspect, the cooling compound can be present in the cooling polymer composition, based on the total weight of the polymer and the cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the cooling compound can be present in the cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polymer and the cooling composition.

In a further aspect, the cooling compound can be present in the cooling polymer composition, based on the total weight of the polymer and the cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The cooling compound can comprise a transition metal oxide, a Group 13 oxide, a Group 14 oxide, a Group 13 carbide, Group 14 carbide, or mixtures thereof. In some instances, the cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the cooling compound can comprise aluminum oxide, silicon dioxide, titanium dioxide, or combinations thereof. In a still further aspect, the cooling compound can comprise titanium dioxide. The cooling compound can be in the form of a powder, a particle, or combinations thereof. In a further aspect, the cooling compound can be in the form of a particle, such as a nanoparticle, a microparticle, or combinations thereof.

In various aspects, the cooling compound can be in a form that is convenient for incorporation into the cooling polymer composition, such as a powder, a wire, a filament, a sheet, a particle, or combinations thereof. In other instances, the cooling compound can be in the form of a particle, a powder, or combinations thereof. In some instances, the cooling compound is in the form of a particle, including forms such as a nanoparticle, a microparticle, or combinations thereof.

In various aspects, the cooling compound comprises a particle form of the cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the cooling compound comprises a particle form of the cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the cooling compound can comprise nanoparticles having a size of about 10 nm to about 100 nm. In a still further aspect, the cooling compound can comprise nanoparticles having a size of about 15 nm to about 50 nm. In a yet further aspect, the cooling compound can comprise nanoparticles having a size of about 20 nm to about 40 nm. In an even further aspect, the cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the cooling composition comprises a cooling salt present in an amount, based on the total weight of the polymer and the cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the cooling composition comprises a cooling salt present in an amount, based on the total weight of the polymer and the cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The cooling composition comprises a cooling salt comprising a transition metal salt, a Group I salt, a Group II salt, or combinations thereof. In some instances, the cooling salt is a Group I salt. In other instances, the cooling salt is a Group II salt. In further instances, the cooling salt is a transition metal salt. The cooling salt can comprise a Group I carbonate, a Group I halide, a Group I nitrate, or combinations thereof. Alternatively, the cooling salt can comprise a Group II carbonate, a Group II halide, a Group II nitrate, or combinations thereof. In further aspects, the cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the cooling salt can be in a form that is convenient for incorporation into the cooling polymer composition, such as a powder, a wire, a filament, a sheet, a particle, or combinations thereof. In other instances, the cooling salt can be in the form of a particle, a powder, or combinations thereof. In some instances, the cooling salt is in the form of a particle, including forms such as a nanoparticle, a microparticle, or combinations thereof.

The cooling salt in the cooling composition can be in the form of a powder, a particle, or combinations thereof. In some aspects, the cooling salt in the cooling composition comprises particles having a size of about 10 μm to about 1000 μm. In a further aspect, the salt in the cooling composition comprises particles having a size of about 30 μm to about 500 μm.

In various aspects, the cooling salt in the cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390 μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the cooling salt can comprise nanoparticles having a size of about 10 nm to about 100 nm. In a still further aspect, the cooling salt can comprise nanoparticles having a size of about 15 nm to about 50 nm. In a yet further aspect, the cooling salt can comprise nanoparticles having a size of about 20 nm to about 40 nm. In an even further aspect, the cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

C. Composite Fibers

In one aspect, the disclosure relates to composite fibers, comprising a core component and a sheath component that can be used in manufacture of a single-covered yarn or a double-covered yarn, or utilized in a woven or knit fabric. More particularly, in some aspects, the present disclosure relates composite fibers comprising a core component and a sheath component, wherein: (a) the core component comprises a polyester polymer; and (b) the sheath component comprises a polyamide polymer; and such that each of the core component and the sheath component independently comprise a cooling composition.

In various aspects, a disclosed composite fiber comprises about 20 wt % to about 80 wt % of a polyester polymer and about 80 wt % to about 20 wt % of a polyamide polymer, based on the total weight of the composite fiber. In a further aspect, a disclosed composite fiber comprises about 50 wt % to about 70 wt % of a polyester polymer and about 50 wt % to about 30 wt % of a polyamide polymer, based on the total weight of the composite fiber. In a still further aspect, a disclosed composite fiber comprises about 55 wt % to about 65 wt % of a polyester polymer and about 45 wt % to about 35 wt % of a polyamide polymer, based on the total weight of the composite fiber. In a yet further aspect, a disclosed composite fiber comprises about 57 wt % to about 63 wt % of a polyester polymer and about 43 wt % to about 37 wt % of a polyamide polymer, based on the total weight of the composite fiber. A disclosed composite fiber comprises about 58 wt % to about 62 wt % of a polyester polymer and about 42 wt % to about 38 wt % of a polyamide polymer, based on the total weight of the composite fiber.

In a further aspect, a disclosed composite fiber comprises a polyester polymer in a weight percent amount based on the total weight of the composite fiber of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In a further aspect, a disclosed composite fiber comprises a polyamide polymer in a weight percent amount based on the total weight of the composite fiber of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In various aspects, the polyester polymer is a polyethylene terephthalate, a polytrimethylene terephthalate, or combinations thereof. In a further aspect, the polyester polymer is a polyethylene terephthalate. In a still further aspect, the polyester polymer is a polytrimethylene terephthalate.

In various aspects, the polyamide polymer can comprise a nylon 6, nylon 4/6, nylon 6/6, nylon 6/10, nylon 6/12, nylon 11, nylon 12, or combinations thereof. In a further aspect, the polyamide polymer can comprise a nylon 6, a nylon 6/6, a nylon 6/12, or combinations thereof. In a still further aspect, the polyamide polymer can comprise a nylon 6/6.

Figure 1B:
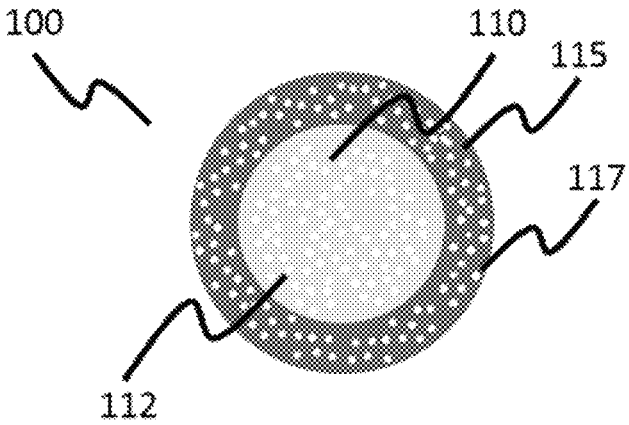
Figure 1C:
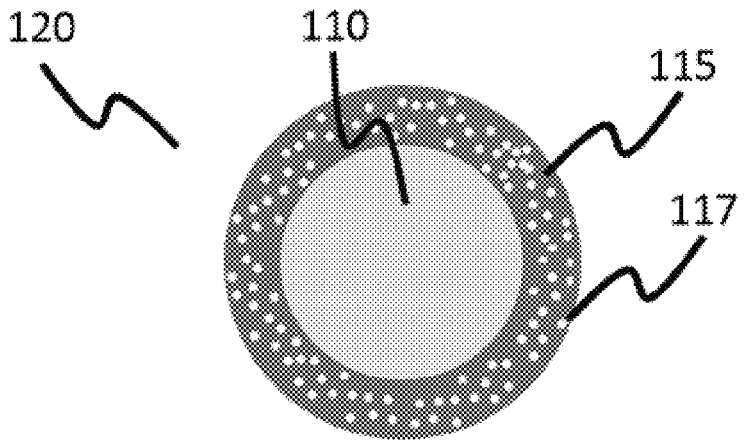
Figure 1D:
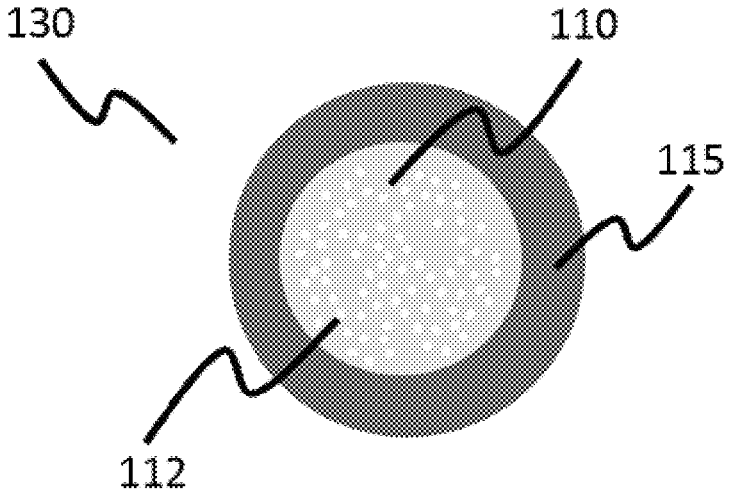

Referring now to FIGS. 1A-1D, which show representative schematic views of disclosed composite fibers. FIG. 1A shows a side on cross-sectional view of a portion of a disclosed composite fiber with a cross-sectional view of an end thereof. An enlarged view of the cross-sectional end view is highlighted. A key is shown beneath the views indicating the gray-scale colors associated with a sheath component, a core component, and distribution of one or more cooling compositions in each of the sheath component and core component. FIG. 1B shows a cross-sectional view of a disclosed composite fiber, 100, with aspects specified as follows: a polyester core, 110; a first cooling composition, 112; a polyamide sheath, 115; and a second cooling composition, 117. FIG. 1C shows a cross-sectional view of a disclosed composite fiber, 120, with aspects specified as follows: a polyester core, 110; a polyamide sheath, 115; and a second cooling composition, 117. FIG. 1D shows a cross-sectional view of a disclosed composite fiber, 130, with aspects specified as follows: a polyester core, 110; a first cooling composition, 112; and a polyamide sheath, 115.

In various aspects, the present disclosure relates composite fibers comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 0.1 wt % to about 25 wt % based on the total weight of the polyester polymer and the first cooling composition; wherein the first cooling composition comprises aluminum, calcium, copper, iron, magnesium, potassium, silicon, silver, sodium, titanium, zirconium, or combinations thereof; wherein the second cooling composition is present in an amount from about 0.1 wt % to about 35 wt % based on the total weight of the polyamide polymer and the second cooling composition; and wherein the second cooling composition comprises aluminum, calcium, copper, iron, magnesium, potassium, silicon, silver, sodium, titanium, zirconium, or combinations thereof.

In a further aspect, the disclosed composite fiber comprises a first cooling composition that can be present in an amount of about 0.1 wt % to about 20 wt % based on the total weight of the polyester polymer and the first cooling composition. In a still further aspect, the first cooling composition can be present in an amount, based on the total weight of the polyester polymer and the first cooling composition of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the disclosed composite fiber comprises a first ceramic material, a first cooling compound, a first metal, a first metal alloy, a first metal oxide, a first mineral, a first salt, or combinations thereof.

In a further aspect, the disclosed composite fiber comprises a first ceramic material comprising aluminum oxide, aluminum titanate, zirconium oxide, aluminum nitride, silicon carbide, silicon nitride, silicon alumina nitride, or combinations thereof.

In a further aspect, the disclosed composite fiber comprises a first cooling compound comprising a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof. For example, in a non-limiting aspect, the first cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof. In a still further non-limiting aspect, the first cooling compound comprises aluminum oxide, magnesium oxide, silicon dioxide, titanium dioxide, or combinations thereof. In a particular aspect, the first cooling compound comprises titanium dioxide.

In a further aspect, the disclosed composite fiber comprises a first metal comprising silver, aluminum, copper, or combinations thereof. For example, in a non-limiting aspect, the first metal can comprise silver. Alternatively, the first metal can comprise copper. In some aspects, the first metal can comprise a mixture of copper and silver.

In a further aspect, the disclosed composite fiber comprises a first metal alloy comprises silver, aluminum, copper, or combinations thereof. For example, in a non-limiting aspect, the first metal alloy can be a metal alloy comprising silver. Alternatively, the first metal alloy can be a metal alloy comprising copper. In a still further alternative aspect, the first metal alloy can be a metal alloy comprising copper and silver In a further aspect, the disclosed composite fiber comprises a first metal oxide comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. For example, in a non-limiting aspect, the first metal oxide can comprise silver (I) oxide, copper (I) oxide, copper (II) oxide, or combinations thereof. In a specific aspect, the first metal oxide can comprise silver (I) oxide.

In a further aspect, the disclosed composite fiber comprises a first mineral comprising dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof. For example, in a non-limiting aspect, in some instances the first mineral can comprise dolomite, tourmaline, zircon, magnesia, magnesite, calcite, periclase, limestone, aragonite, quartz, or combinations thereof. In a further non-limiting particular aspect, the first mineral can comprise calcium, magnesium, silicon, zirconium, titanium, or combinations thereof. In some instances, the first mineral can comprise calcium in the form of calcite, aragonite, dolomite, tourmaline, or combinations thereof. In other instances, the first mineral can comprise magnesium in the form of magnesia, periclase, magnesite, dolomite, tourmaline, or combinations thereof. In further instances, the first mineral can comprise silicon in the form of quartz, granite, chalcedony, chrysoprase, garnet, phenacite, olivine, mica, kaolinite, feldspar, zeolite, carnelian, agate, onyx, jasper, heliotrope, flint, or combinations thereof. In alternative instances, the first mineral can comprise titanium in the form of rutile, Imenite, titanite, anatase, brookite, or combinations thereof. The first mineral comprising zirconium can be in the form of zircon, allendeite, baddeleyite, eudialyte, loranskite, menezesite, or combinations thereof. In some instances, the first mineral can comprise both zirconium and titanium, for example, but not limited to, in the form of calzirtite, kobeite, lakargiite, lindsleyite, loveringite, mathiasite, tazheranite, zircon, zirconolite, zirkelite, or combinations thereof.

In a further aspect, the disclosed composite fiber can comprise a first cooling salt comprising a Group I salt, a Group II salt, a transition metal salt, or combinations thereof.

In a further aspect, the disclosed composite fiber can comprise a first cooling salt such as a Group I salt, for example, but not limited to, a Group I salt comprising a cation of sodium, potassium or combinations thereof. For example, the disclosed composite fiber can comprise a first cooling salt comprising a Group I salt, such as, but not limited to, a Group I carbonate, a Group I halide, a Group I nitrate, a Group I sulfate, or combinations thereof.

In a further aspect, the disclosed composite fiber can comprise a first cooling salt such as a Group II salt, for example, but not limited to, a Group II salt comprising a cation of calcium, magnesium or combinations thereof. For example, the disclosed composite fiber can comprise a first cooling salt comprising a Group II salt, such as, but not limited to a Group II carbonate, a Group II halide, a Group II nitrate, a Group II sulfate, or combinations thereof.

In a further aspect, the disclosed composite fiber can comprise a first cooling salt such as a transition metal salt, for example, but not limited to, a transition metal salt comprising a cation of silver, copper, titanium, iron, nickel, zinc, gold, or combinations thereof. For example, the disclosed composite fiber can comprise a first cooling salt comprising a transition metal salt, such as, but not limited to a transition metal carbonate, a transition metal halide, a transition metal nitrate, a transition metal sulfate, or combinations thereof.

In a further aspect, the disclosed composite fiber can comprise a first cooling salt such as a Group I sulfate, a Group II sulfate, transition metal sulfate, or combinations thereof. For example, the disclosed composite fiber can comprise a first cooling salt comprising sodium sulfate, potassium sulfate, calcium sulfate, magnesium sulfate, or combinations thereof. In a particular aspect, the first cooling salt can comprise sodium sulfate, postassium sulfate, magnesium sulfate, or combinations thereof.

In a further aspect, the disclosed composite fiber can comprise a first cooling salt such as a Group I halide, a Group II halide, transition metal halide, or combinations thereof. For example, the disclosed composite fiber can comprise a first cooling salt comprising iron (II) chloride, iron (III) chloride, sodium chloride, potassium chloride, calcium chloride, magnesium chloride, or combinations thereof. In a particular aspect, the first cooling salt can comprise potassium chloride.

In a further aspect, the disclosed composite fiber can comprise a first cooling salt such as a Group I carbonate, a Group II carbonate, transition metal carbonate, or combinations thereof. For example, the disclosed composite fiber can comprise a first cooling salt comprising calcium carbonate, magnesium carbonate, or combinations thereof.

In various aspects, the disclosed composite fiber can comprise a first cooling composition that is in the form of a powder, a wire, a filament, a sheet, a particle, or combinations thereof. In a particular aspect, the first cooling composition comprises a particle, a powder, or combinations thereof. In some instances, the first cooling composition comprises a particle, such as a nanoparticle, a microparticle, or combinations thereof. A first cooling composition comprising a nanoparticle can comprise a nanoparticle having a size of about 10 nm to about 100 nm; about 15 nm to about 50 nm; about 20 nm to about 40 nm; about 10 μm to about 200 μm; about 20 μm to about 100 μm; about 30 μm to about 90 μm; about 40 μm to about 80 μm; about 50 μm to about 70 μm; a sub-range within any of the foregoing ranges; or any set of values utilizing values within any of the foregoing ranges.

In a further aspect, the disclosed composite fiber can comprise a first cooling composition comprising aluminum. Aluminum can be present in a first cooling composition in an amount of about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed composite fiber can comprise a first cooling composition comprising calcium. Calcium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed composite fiber can comprise a first cooling composition comprising copper. Copper can be present in a first cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed composite fiber can comprise a first cooling composition comprising iron. Iron can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed composite fiber can comprise a first cooling composition comprising magnesium. Magnesium can be present in a first cooling composition in an amount of about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed composite fiber can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed composite fiber can comprise a first cooling composition comprising silver. Silver can be present in a first cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed composite fiber can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed composite fiber can comprise a first cooling composition comprising titanium. Titanium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed composite fiber can comprise a first cooling composition comprising zirconium.

Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed composite fiber comprises a second cooling composition that can be present in an amount of about 0.1 wt % to about 30 wt % based on the total weight of the polyamide polymer and the second cooling composition. In a still further aspect, the second cooling composition can be present in an amount, based on the total weight of the polyamide polymer and the second cooling composition of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; a range utilizing any of the foregoing values; a sub-range with a range utilizing any of the foregoing values; or any set of values utilizing the foregoing values.

In a further aspect, the disclosed composite fiber comprises a second ceramic material, a second cooling compound, a second metal, a second metal alloy, a second metal oxide, a second mineral, a second salt, or combinations thereof.

In a further aspect, the disclosed composite fiber comprises a second ceramic material comprising aluminum oxide, aluminum titanate, zirconium oxide, aluminum nitride, silicon carbide, silicon nitride, silicon alumina nitride, or combinations thereof.

In a further aspect, the disclosed composite fiber comprises a second cooling compound comprising a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof. For example, in a non-limiting aspect, the second cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof. In a still further non-limiting aspect, the second cooling compound comprises aluminum oxide, magnesium oxide, silicon dioxide, titanium dioxide, or combinations thereof. In a particular aspect, the second cooling compound comprises titanium dioxide.

In a further aspect, the disclosed composite fiber comprises a second metal comprising silver, aluminum, copper, or combinations thereof. For example, in a non-limiting aspect, the second metal can comprise silver. Alternatively, the second metal can comprise copper. In some aspects, the second metal can comprise a mixture of copper and silver.

In a further aspect, the disclosed composite fiber comprises a second metal alloy comprises silver, aluminum, copper, or combinations thereof. For example, in a non-limiting aspect, the second metal alloy can be a metal alloy comprising silver. Alternatively, the second metal alloy can be a metal alloy comprising copper. In a still further alternative aspect, the second metal alloy can be a metal alloy comprising copper and silver In a further aspect, the disclosed composite fiber comprises a second metal oxide comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. For example, in a non-limiting aspect, the second metal oxide can comprise silver (I) oxide, copper (I) oxide, copper (II) oxide, or combinations thereof. In a specific aspect, the second metal oxide can comprise silver (I) oxide.

In a further aspect, the disclosed composite fiber comprises a second mineral comprising dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof. For example, in a non-limiting aspect, in some instances the second mineral can comprise dolomite, tourmaline, zircon, magnesia, magnesite, calcite, periclase, limestone, aragonite, quartz, or combinations thereof. In a further non-limiting particular aspect, the second mineral can comprise calcium, magnesium, silicon, zirconium, titanium, or combinations thereof. In some instances, the second mineral can comprise calcium in the form of calcite, aragonite, dolomite, tourmaline, or combinations thereof. In other instances, the second mineral can comprise magnesium in the form of magnesia, periclase, magnesite, dolomite, tourmaline, or combinations thereof. In further instances, the second mineral can comprise silicon in the form of quartz, granite, chalcedony, chrysoprase, garnet, phenacite, olivine, mica, kaolinite, feldspar, zeolite, carnelian, agate, onyx, jasper, heliotrope, flint, or combinations thereof. In alternative instances, the second mineral can comprise titanium in the form of rutile, Imenite, titanite, anatase, brookite, or combinations thereof. The second mineral comprising zirconium can be in the form of zircon, allendeite, baddeleyite, eudialyte, loranskite, menezesite, or combinations thereof. In some instances, the second mineral can comprise both zirconium and titanium, for example, but not limited to, in the form of calzirtite, kobeite, lakargiite, lindsleyite, loveringite, mathiasite, tazheranite, zircon, zirconolite, zirkelite, or combinations thereof.

In a further aspect, the disclosed composite fiber can comprise a second cooling salt comprising a Group I salt, a Group II salt, a transition metal salt, or combinations thereof.

In a further aspect, the disclosed composite fiber can comprise a second cooling salt such as a Group I salt, for example, but not limited to, a Group I salt comprising a cation of sodium, potassium or combinations thereof. For example, the disclosed composite fiber can comprise a second cooling salt comprising a Group I salt, such as, but not limited to, a Group I carbonate, a Group I halide, a Group I nitrate, a Group I sulfate, or combinations thereof.

In a further aspect, the disclosed composite fiber can comprise a second cooling salt such as a Group II salt, for example, but not limited to, a Group II salt comprising a cation of calcium, magnesium or combinations thereof. For example, the disclosed composite fiber can comprise a second cooling salt comprising a Group II salt, such as, but not limited to a Group II carbonate, a Group II halide, a Group II nitrate, a Group II sulfate, or combinations thereof.

In a further aspect, the disclosed composite fiber can comprise a second cooling salt such as a transition metal salt, for example, but not limited to, a transition metal salt comprising a cation of silver, copper, titanium, iron, nickel, zinc, gold, or combinations thereof. For example, the disclosed composite fiber can comprise a second cooling salt comprising a transition metal salt, such as, but not limited to a transition metal carbonate, a transition metal halide, a transition metal nitrate, a transition metal sulfate, or combinations thereof.

In a further aspect, the disclosed composite fiber can comprise a second cooling salt such as a Group I sulfate, a Group II sulfate, transition metal sulfate, or combinations thereof. For example, the disclosed composite fiber can comprise a second cooling salt comprising sodium sulfate, potassium sulfate, calcium sulfate, magnesium sulfate, or combinations thereof. In a particular aspect, the second cooling salt can comprise sodium sulfate, potassium sulfate, magnesium sulfate, or combinations thereof.

In a further aspect, the disclosed composite fiber can comprise a second cooling salt such as a Group I halide, a Group II halide, transition metal halide, or combinations thereof. For example, the disclosed composite fiber can comprise a second cooling salt comprising iron (II) chloride, iron (III) chloride, sodium chloride, potassium chloride, calcium chloride, magnesium chloride, or combinations thereof. In a particular aspect, the second cooling salt can comprise potassium chloride.

In a further aspect, the disclosed composite fiber can comprise a second cooling salt such as a Group I carbonate, a Group II carbonate, transition metal carbonate, or combinations thereof. For example, the disclosed composite fiber can comprise a second cooling salt comprising calcium carbonate, magnesium carbonate, or combinations thereof.

In various aspects, the disclosed composite fiber can comprise a second cooling composition that is in the form of a powder, a wire, a filament, a sheet, a particle, or combinations thereof. In a particular aspect, the second cooling composition comprises a particle, a powder, or combinations thereof. In some instances, the second cooling composition comprises a particle, such as a nanoparticle, a microparticle, or combinations thereof. A second cooling composition comprising a nanoparticle can comprise a nanoparticle having a size of about 10 nm to about 100 nm; about 15 nm to about 50 nm; about 20 nm to about 40 nm; about 10 μm to about 200 μm; about 20 μm to about 100 μm; about 30 μm to about 90 μm; about 40 μm to about 80 μm; about 50 μm to about 70 μm; a sub-range within any of the foregoing ranges; or any set of values utilizing values within any of the foregoing ranges.

In a further aspect, the disclosed composite fiber can comprise a second cooling composition comprising aluminum. Aluminum can be present in a second cooling composition in an amount of about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed composite fiber can comprise a second cooling composition comprising calcium. Calcium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed composite fiber can comprise a second cooling composition comprising copper. Copper can be present in a second cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed composite fiber can comprise a second cooling composition comprising iron. Iron can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed composite fiber can comprise a second cooling composition comprising magnesium. Magnesium can be present in a second cooling composition in an amount of about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed composite fiber can comprise a second cooling composition comprising potassium. Potassium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed composite fiber can comprise a second cooling composition comprising silver. Silver can be present in a second cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed composite fiber can comprise a second cooling composition comprising sodium. Sodium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed composite fiber can comprise a second cooling composition comprising titanium. Titanium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed composite fiber can comprise a second cooling composition comprising zirconium. Zirconium can be present in a second cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

It is to be understood, that in reference that a wt % amount of aluminum, calcium, copper, iron, magnesium, potassium, silicon, silver, sodium, titanium, zirconium, or combinations thereof is the wt % amount of the element as determined by elemental analysis of the polyester polymer and the first cooling composition.

The weight percent for a given element in a disclosed composite fiber, e.g., aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

In various aspects, a disclosed composite fiber can have a cross-sectional profile of various geometries or shapes. For example, the disclosed composite fiber can have, but is not limited to a cross sectional profile such as a side-by-side cross-section; an eccentric sheath-core cross-section; an islands-in-the-sea cross-section; a segmented pie cross-section; or a concentric cross-section.

In some aspects, the disclosed composite fiber can have a suitable fiber weight, e.g., a fiber weight of about 100 d/60f to about 200 d/75f.

D. Single-Covered Yarns

In one aspect, the disclosure relates to single-covered yarns that can be utilized in a woven or knit fabric. In various aspects, a disclosed single-covered yarn comprises a core fiber comprising a disclosed composite fiber; and a first fiber comprising a cellulosic fiber. More specifically, in one aspect, the present disclosure relates to single-covered yarn comprising: (a) a core fiber comprising a disclosed composite fiber; and (b) a first fiber comprising a cellulosic fiber; wherein the first yarn is wound around the core yarn to form a single-covered yarn. In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 20 wt % to about 50 wt %; wherein the first fiber is present in an amount of from about 40 wt % to about 80 wt %; wherein the weight percent is based upon the total weight of the single-covered yarn, and provided that the total weight percent of the elastic yarn, the first fiber, and the second yarn is from about 90 wt % to about 100 wt %. In some aspects, each of the core fiber and the first fiber can independently comprise a plurality of core fibers and first fibers, respectively.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 25 wt % to about 45 wt %; wherein the first fiber is present in an amount of from about 55 wt % to about 80 wt %; wherein the weight percent is based upon the total weight of the single-covered yarn, and provided that the total weight percent of the elastic yarn, the first fiber, and the second yarn is from about 90 wt % to about 100 wt %.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 27 wt % to about 42 wt %; wherein the first fiber is present in an amount of from about 88 wt % to about 73 wt %; wherein the weight percent is based upon the total weight of the single-covered yarn, and provided that the total weight percent of the elastic yarn, the first fiber, and the second yarn is from about 90 wt % to about 100 wt %.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 30 wt % to about 40 wt %; wherein the first fiber is present in an amount of from about 60 wt % to about 70 wt %; wherein the weight percent is based upon the total weight of the single-covered yarn, and provided that the total weight percent of the elastic yarn, the first fiber, and the second yarn is from about 90 wt % to about 100 wt %.

In a further aspect, a single-covered yarn comprises a core fiber in a weight percent amount based on the total weight of the single-covered yarn of about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; about 30.1 wt %; about 30.2 wt %; about 30.3 wt %; about 30.4 wt %; about 30.5 wt %; about 30.6 wt %; about 30.7 wt %; about 30.8 wt %; about 30.9 wt %; about 31.0 wt %; about 31.1 wt %; about 31.2 wt %; about 31.3 wt %; about 31.4 wt %; about 31.5 wt %; about 31.6 wt %; about 31.7 wt %; about 31.8 wt %; about 31.9 wt %; about 32.0 wt %; about 32.1 wt %; about 32.2 wt %; about 32.3 wt %; about 32.4 wt %; about 32.5 wt %; about 32.6 wt %; about 32.7 wt %; about 32.8 wt %; about 32.9 wt %; about 33.0 wt %; about 33.1 wt %; about 33.2 wt %; about 33.3 wt %; about 33.4 wt %; about 33.5 wt %; about 33.6 wt %; about 33.7 wt %; about 33.8 wt %; about 33.9 wt %; about 34.0 wt %; about 34.1 wt %; about 34.2 wt %; about 34.3 wt %; about 34.4 wt %; about 34.5 wt %; about 34.6 wt %; about 34.7 wt %; about 34.8 wt %; about 34.9 wt %; about 35.0 wt %; about 35.1 wt %; about 35.2 wt %; about 35.3 wt %; about 35.4 wt %; about 35.5 wt %; about 35.6 wt %; about 35.7 wt %; about 35.8 wt %; about 35.9 wt %; about 36.0 wt %; about 36.1 wt %; about 36.2 wt %; about 36.3 wt %; about 36.4 wt %; about 36.5 wt %; about 36.6 wt %; about 36.7 wt %; about 36.8 wt %; about 36.9 wt %; about 37.0 wt %; about 37.1 wt %; about 37.2 wt %; about 37.3 wt %; about 37.4 wt %; about 37.5 wt %; about 37.6 wt %; about 37.7 wt %; about 37.8 wt %; about 37.9 wt %; about 38.0 wt %; about 38.1 wt %; about 38.2 wt %; about 38.3 wt %; about 38.4 wt %; about 38.5 wt %; about 38.6 wt %; about 38.7 wt %; about 38.8 wt %; about 38.9 wt %; about 39.0 wt %; about 39.1 wt %; about 39.2 wt %; about 39.3 wt %; about 39.4 wt %; about 39.5 wt %; about 39.6 wt %; about 39.7 wt %; about 39.8 wt %; about 39.9 wt %; about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; a range utilizing any of the foregoing values; a sub-range with a range utilizing any of the foregoing values; or any set of values utilizing the foregoing values, and provided that the total weight percent of the elastic yarn, the first fiber, and the second yarn is from about 90 wt % to about 100 wt %.

In a further aspect, a single-covered yarn comprises a first fiber in a weight percent amount based on the total weight of the single-covered yarn of about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; about 50.1 wt %; about 50.2 wt %; about 50.3 wt %; about 50.4 wt %; about 50.5 wt %; about 50.6 wt %; about 50.7 wt %; about 50.8 wt %; about 50.9 wt %; about 51.0 wt %; about 51.1 wt %; about 51.2 wt %; about 51.3 wt %; about 51.4 wt %; about 51.5 wt %; about 51.6 wt %; about 51.7 wt %; about 51.8 wt %; about 51.9 wt %; about 52.0 wt %; about 52.1 wt %; about 52.2 wt %; about 52.3 wt %; about 52.4 wt %; about 52.5 wt %; about 52.6 wt %; about 52.7 wt %; about 52.8 wt %; about 52.9 wt %; about 53.0 wt %; about 53.1 wt %; about 53.2 wt %; about 53.3 wt %; about 53.4 wt %; about 53.5 wt %; about 53.6 wt %; about 53.7 wt %; about 53.8 wt %; about 53.9 wt %; about 54.0 wt %; about 54.1 wt %; about 54.2 wt %; about 54.3 wt %; about 54.4 wt %; about 54.5 wt %; about 54.6 wt %; about 54.7 wt %; about 54.8 wt %; about 54.9 wt %; about 55.0 wt %; about 55.1 wt %; about 55.2 wt %; about 55.3 wt %; about 55.4 wt %; about 55.5 wt %; about 55.6 wt %; about 55.7 wt %; about 55.8 wt %; about 55.9 wt %; about 56.0 wt %; about 56.1 wt %; about 56.2 wt %; about 56.3 wt %; about 56.4 wt %; about 56.5 wt %; about 56.6 wt %; about 56.7 wt %; about 56.8 wt %; about 56.9 wt %; about 57.0 wt %; about 57.1 wt %; about 57.2 wt %; about 57.3 wt %; about 57.4 wt %; about 57.5 wt %; about 57.6 wt %; about 57.7 wt %; about 57.8 wt %; about 57.9 wt %; about 58.0 wt %; about 58.1 wt %; about 58.2 wt %; about 58.3 wt %; about 58.4 wt %; about 58.5 wt %; about 58.6 wt %; about 58.7 wt %; about 58.8 wt %; about 58.9 wt %; about 59.0 wt %; about 59.1 wt %; about 59.2 wt %; about 59.3 wt %; about 59.4 wt %; about 59.5 wt %; about 59.6 wt %; about 59.7 wt %; about 59.8 wt %; about 59.9 wt %; about 60.0 wt %; about 60.1 wt %; about 60.2 wt %; about 60.3 wt %; about 60.4 wt %; about 60.5 wt %; about 60.6 wt %; about 60.7 wt %; about 60.8 wt %; about 60.9 wt %; about 61.0 wt %; about 61.1 wt %; about 61.2 wt %; about 61.3 wt %; about 61.4 wt %; about 61.5 wt %; about 61.6 wt %; about 61.7 wt %; about 61.8 wt %; about 61.9 wt %; about 62.0 wt %; about 62.1 wt %; about 62.2 wt %; about 62.3 wt %; about 62.4 wt %; about 62.5 wt %; about 62.6 wt %; about 62.7 wt %; about 62.8 wt %; about 62.9 wt %; about 63.0 wt %; about 63.1 wt %; about 63.2 wt %; about 63.3 wt %; about 63.4 wt %; about 63.5 wt %; about 63.6 wt %; about 63.7 wt %; about 63.8 wt %; about 63.9 wt %; about 64.0 wt %; about 64.1 wt %; about 64.2 wt %; about 64.3 wt %; about 64.4 wt %; about 64.5 wt %; about 64.6 wt %; about 64.7 wt %; about 64.8 wt %; about 64.9 wt %; about 65.0 wt %; about 65.1 wt %; about 65.2 wt %; about 65.3 wt %; about 65.4 wt %; about 65.5 wt %; about 65.6 wt %; about 65.7 wt %; about 65.8 wt %; about 65.9 wt %; about 66.0 wt %; about 66.1 wt %; about 66.2 wt %; about 66.3 wt %; about 66.4 wt %; about 66.5 wt %; about 66.6 wt %; about 66.7 wt %; about 66.8 wt %; about 66.9 wt %; about 67.0 wt %; about 67.1 wt %; about 67.2 wt %; about 67.3 wt %; about 67.4 wt %; about 67.5 wt %; about 67.6 wt %; about 67.7 wt %; about 67.8 wt %; about 67.9 wt %; about 68.0 wt %; about 68.1 wt %; about 68.2 wt %; about 68.3 wt %; about 68.4 wt %; about 68.5 wt %; about 68.6 wt %; about 68.7 wt %; about 68.8 wt %; about 68.9 wt %; about 69.0 wt %; about 69.1 wt %; about 69.2 wt %; about 69.3 wt %; about 69.4 wt %; about 69.5 wt %; about 69.6 wt %; about 69.7 wt %; about 69.8 wt %; about 69.9 wt %; about 70.0 wt %; about 70.1 wt %; about 70.2 wt %; about 70.3 wt %; about 70.4 wt %; about 70.5 wt %; about 70.6 wt %; about 70.7 wt %; about 70.8 wt %; about 70.9 wt %; about 71.0 wt %; about 71.1 wt %; about 71.2 wt %; about 71.3 wt %; about 71.4 wt %; about 71.5 wt %; about 71.6 wt %; about 71.7 wt %; about 71.8 wt %; about 71.9 wt %; about 72.0 wt %; about 72.1 wt %; about 72.2 wt %; about 72.3 wt %; about 72.4 wt %; about 72.5 wt %; about 72.6 wt %; about 72.7 wt %; about 72.8 wt %; about 72.9 wt %; about 73.0 wt %; about 73.1 wt %; about 73.2 wt %; about 73.3 wt %; about 73.4 wt %; about 73.5 wt %; about 73.6 wt %; about 73.7 wt %; about 73.8 wt %; about 73.9 wt %; about 74.0 wt %; about 74.1 wt %; about 74.2 wt %; about 74.3 wt %; about 74.4 wt %; about 74.5 wt %; about 74.6 wt %; about 74.7 wt %; about 74.8 wt %; about 74.9 wt %; about 75.0 wt %; about 75.1 wt %; about 75.2 wt %; about 75.3 wt %; about 75.4 wt %; about 75.5 wt %; about 75.6 wt %; about 75.7 wt %; about 75.8 wt %; about 75.9 wt %; about 76.0 wt %; about 76.1 wt %; about 76.2 wt %; about 76.3 wt %; about 76.4 wt %; about 76.5 wt %; about 76.6 wt %; about 76.7 wt %; about 76.8 wt %; about 76.9 wt %; about 77.0 wt %; about 77.1 wt %; about 77.2 wt %; about 77.3 wt %; about 77.4 wt %; about 77.5 wt %; about 77.6 wt %; about 77.7 wt %; about 77.8 wt %; about 77.9 wt %; about 78.0 wt %; about 78.1 wt %; about 78.2 wt %; about 78.3 wt %; about 78.4 wt %; about 78.5 wt %; about 78.6 wt %; about 78.7 wt %; about 78.8 wt %; about 78.9 wt %; about 79.0 wt %; about 79.1 wt %; about 79.2 wt %; about 79.3 wt %; about 79.4 wt %; about 79.5 wt %; about 79.6 wt %; about 79.7 wt %; about 79.8 wt %; about 79.9 wt %; about 80.0 wt %; a range utilizing any of the foregoing values; a sub-range with a range utilizing any of the foregoing values; or any set of values utilizing the foregoing values, and provided that the total weight percent of the elastic yarn, the first fiber, and the second yarn is from about 90 wt % to about 100 wt %.

Figure 6A:
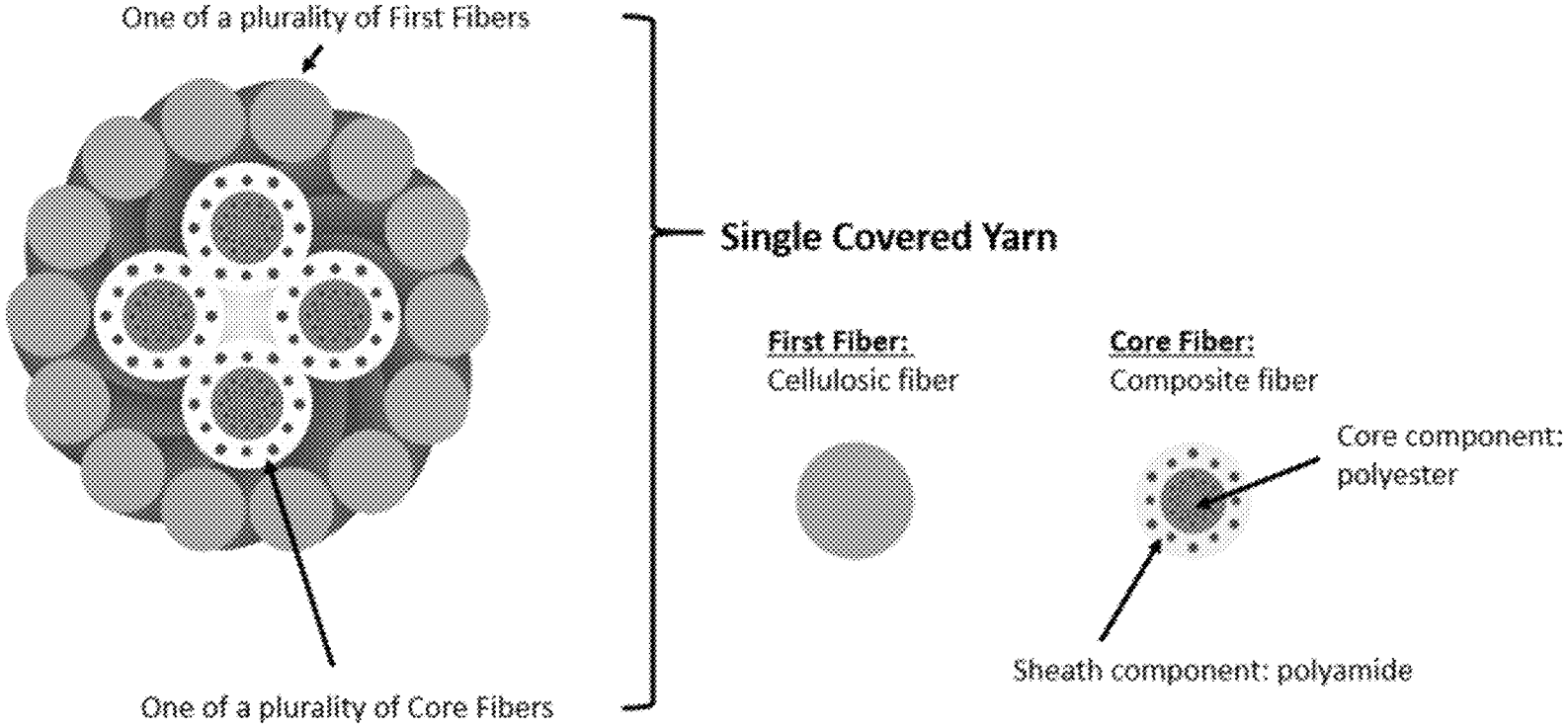
FIGS. 6A-6B show a representative cross-sectional views of disclosed single-covered yarns.
Figure 6B:
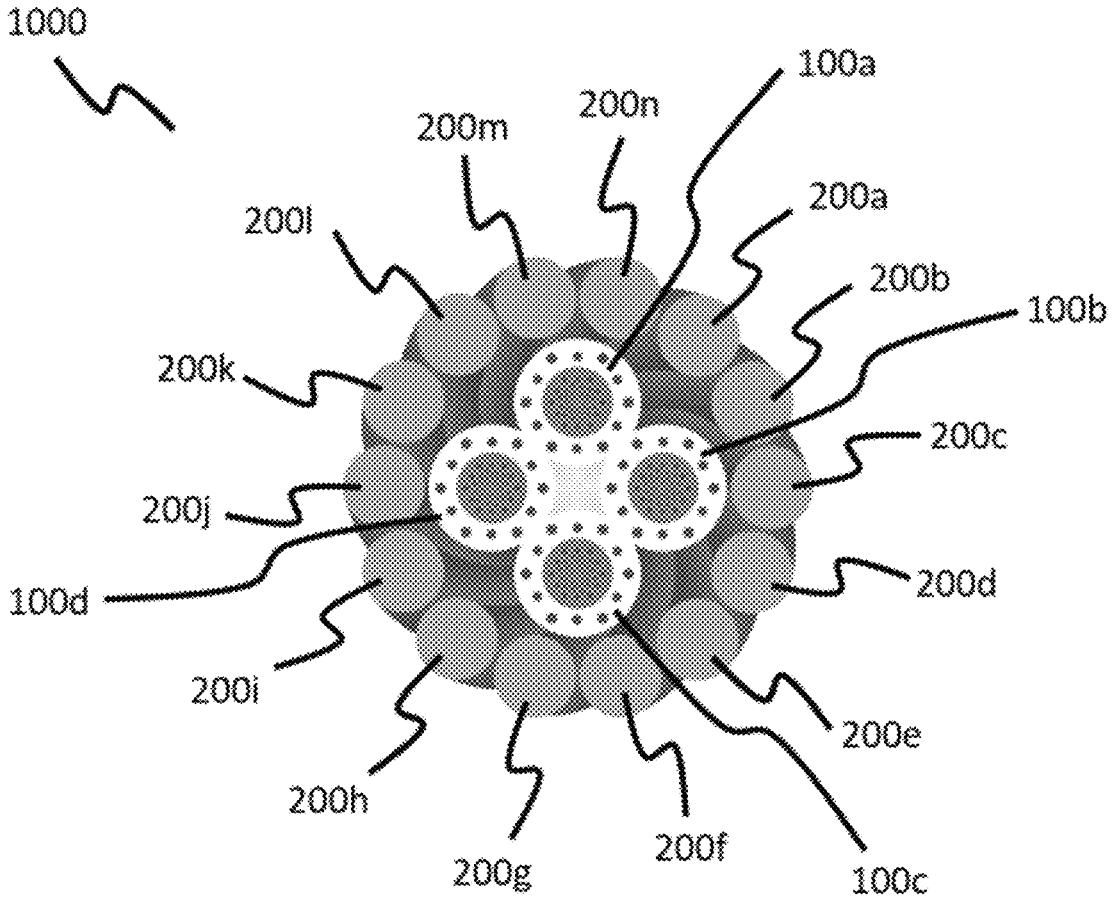

Referring now to FIGS. 6A-6B, which show representative cross-sectional views of disclosed single-covered yarns. FIG. 6A shows a schematic cross-sectional view of a disclosed single-covered yarn comprising a cellulosic fiber (e.g., a viscose rayon) wrapped around one or more composite fibers. FIG. 6B shows a cross-sectional view of a disclosed single-covered yarn, 1000, with aspects specified as follows: (a) a plurality of core fibers, 100*a*-100*d*, each comprising a disclosed composite fiber, such as that shown in FIG. 1B, comprising a core component comprising a polyester polymer and a first cooling composition, and a sheath component comprising a polyamide polymer and a second cooling composition; and (b) a plurality of first fibers, 200*a*-200*n*, comprising a cellulosic fiber; such that the plurality of first fibers are wound around the plurality of core fibers to form a single-covered yarn.

In various aspects, the single-covered yarn can utilize a core fiber, comprising a disclosed composite fiber, having a weight of about 120 denier to about 600 denier; about 130 denier to about 500 denier; about 140 denier to about 400 denier; a sub-range within the foregoing ranges; or a set of values within any of the foregoing ranges. In a further aspect, the single-covered yarn can utilize a core fiber, comprising a disclosed composite fiber, having a weight of about 120 denier; about 130 denier; about 140 denier; about 150 denier; about 160 denier; about 170 denier; about 180 denier; about 190 denier; about 200 denier; about 210 denier; about 220 denier; about 230 denier; about 240 denier; about 250 denier; about 260 denier; about 270 denier; about 280 denier; about 290 denier; about 300 denier; about 310 denier; about 320 denier; about 330 denier; about 340 denier; about 350 denier; about 360 denier; about 370 denier; about 380 denier; about 390 denier; about 400 denier; about 410 denier; about 420 denier; about 430 denier; about 440 denier; about 450 denier; about 460 denier; about 470 denier; about 480 denier; about 490 denier; about 500 denier; about 510 denier; about 520 denier; about 530 denier; about 540 denier; about 550 denier; about 560 denier; about 570 denier; about 580 denier; about 590 denier; about 600 denier; a range encompassed by any of the foregoing values; or any set of the foregoing values.

In various aspects, the first fiber used in a disclosed single-covered yarn can be a suitable cellulosic fiber. In some instances, the cellulosic fiber of the f fiber is a regenerated cellulosic fiber, such as, but not limited to, a viscose rayon, a high wet modulus rayon, a cuprammonium rayon, a saponified rayon, a modal rayon, a lyocell rayon, or combinations thereof. In a particular instance, the regenerated cellulosic fiber can be a viscose rayon.

In various aspects, the first fiber of the single-covered yarn has a weight of about 105 d/20f to about 130 d/40f; about 110 d/20f to about 130 d/40f; about 115 d/20f to about 130 d/40f; about 105 d/20f to about 130 d/35f; about 110 d/35f to about 130 d/35f; about 115 d/20f to about 130 d/35f; about 105 d/20f to about 130 d/30f; about 110 d/20f to about 130 d/30f; about 115 d/20f to about 130 d/30f; about 105 d/20f to about 130 d/40f; about 115 d/25f to about 135 d/35f; a sub-range within any of the foregoing ranges; or any set of values utilizing values within any of the foregoing ranges.

In a further aspect, the first fiber of the single-covered yarn has a weight of about 120 d/20f±10%; about 120 d/20f±5%; about 120 d/20f±3%; 121 d/20f±10%; about 121 d/20f±5%; about 121 d/20f±3%; 122 d/20f±10%; about 122 d/20f±5%; about 122 d/20f±3%; 123 d/20f±10%; about 123 d/20f±5%; about 123 d/20f±3%; 124 d/20f±10%; about 124 d/20f±5%; about 124 d/20f±3%; 125 d/20f±10%; about 125 d/20f±5%; about 125 d/20f±3%; 126 d/20f±10%; about 126 d/20f±5%; about 126 d/20f±3%; 127 d/20f±10%; about 127 d/20f±5%; about 127 d/20f±3%; 128 d/20f±10%; about 128 d/20f±5%; about 128 d/20f±3%; 129 d/20f±10%; about 129 d/20f±5%; about 129 d/20f±3%; 130 d/20f±10%; about 130 d/20f±5%; about 130 d/20f±3%; about 120 d/25f±10%; about 120 d/25f±5%; about 120 d/25f±3%; 121 d/25f±10%; about 121 d/25f±5%; about 121 d/25f±3%; 122 d/25f±10%; about 122 d/25f±5%; about 122 d/25f±3%; 123 d/25f±10%; about 123 d/25f±5%; about 123 d/25f±3%; 124 d/25f±10%; about 124 d/25f±5%; about 124 d/25f±3%; 125 d/25f±10%;

about 125 d/25f±5%; about 125 d/25f±3%; 126 d/25f±10%; about 126 d/25f±5%; about 126 d/25f±3%; 127 d/25f±10%; about 127 d/25f±5%; about 127 d/25f±3%; 128 d/25f±10%; about 128 d/25f±5%; about 128 d/25f±3%; 129 d/25f±10%; about 129 d/25f±5%; about 129 d/25f±3%; 130 d/25f±10%; about 130 d/25f±5%; about 130 d/25f±3%; about 120 d/30f±10%; about 120 d/30f±5%; about 120 d/30f±3%; 121 d/30f±10%; about 121 d/30f±5%; about 121 d/30f±3%; 122 d/30f±10%; about 122 d/30f±5%; about 122 d/30f±3%; 123 d/30f±10%; about 123 d/30f±5%; about 123 d/30f±3%; 124 d/30f±10%; about 124 d/30f±5%; about 124 d/30f±3%; 125 d/30f±10%; about 125 d/30f±5%; about 125 d/30f±3%; 126 d/30f±10%; about 126 d/30f±5%; about 126 d/30f±3%; 127 d/30f±10%; about 127 d/30f±5%; about 127 d/30f±3%; 128 d/30f±10%; about 128 d/30f±5%; about 128 d/30f±3%; 129 d/30f±10%; about 129 d/30f±5%; about 129 d/30f±3%; 130 d/30f±10%; about 130 d/30f±5%; about 130 d/30f±3%; about 120 d/35f±10%; about 120 d/35f±5%; about 120 d/35f±3%; 121 d/35f±10%; about 121 d/35f±5%; about 121 d/35f±3%; 122 d/35f±10%; about 122 d/35f±5%; about 122 d/35f±3%; 123 d/35f±10%; about 123 d/35f±5%; about 123 d/35f±3%; 124 d/35f±10%; about 124 d/35f±5%; about 124 d/35f±3%; 125 d/35f±10%; about 125 d/35f±5%; about 125 d/35f±3%; 126 d/35f±10%; about 126 d/35f±5%; about 126 d/35f±3%; 127 d/35f±10%; about 127 d/35f±5%; about 127 d/35f±3%; 128 d/35f±10%; about 128 d/35f±5%; about 128 d/35f±3%; 129 d/35f±10%; about 129 d/35f±5%; about 129 d/35f±3%; 130 d/35f±10%; about 130 d/35f±5%; about 130 d/35f±3%; about 120 d/40f±10%; about 120 d/40f±5%; about 120 d/40f±3%; 121 d/40f±10%; about 121 d/40f±5%; about 121 d/40f±3%; 122 d/40f±10%; about 122 d/40f±5%; about 122 d/40f±3%; 123 d/40f±10%; about 123 d/40f±5%; about 123 d/40f±3%; 124 d/40f±10%; about 124 d/40f±5%; about 124 d/40f±3%; 125 d/40f±10%; about 125 d/40f±5%; about 125 d/40f±3%; 126 d/40f±10%; about 126 d/40f±5%; about 126 d/40f±3%; 127 d/40f±10%; about 127 d/40f±5%; about 127 d/40f±3%; 128 d/40f±10%; about 128 d/40f±5%; about 128 d/40f±3%; 129 d/40f±10%; about 129 d/40f±5%; about 129 d/40f±3%; 130 d/40f±10%; about 130 d/40f±5%; about 130 d/40f±3%; a range encompassing any of the foregoing value; or any combination of the foregoing values.

In various aspects, the single-covered yarn has a weight of about 250 denier to about 370 denier; about 260 denier to about 370 denier; about 270 denier to about 370 denier; about 280 denier to about 370 denier; about 290 denier to about 370 denier; about 300 denier to about 370 denier; about 310 denier to about 370 denier; about 320 denier to about 370 denier; about 330 denier to about 370 denier; about 340 denier to about 370 denier; about 350 denier to about 370 denier; about 355 denier to about 370 denier; about 360 denier to about 370 denier; about 250 denier to about 360 denier; about 260 denier to about 360 denier; about 270 denier to about 360 denier; about 280 denier to about 360 denier; about 290 denier to about 360 denier; about 300 denier to about 360 denier; about 310 denier to about 360 denier; about 320 denier to about 360 denier; about 330 denier to about 360 denier; about 340 denier to about 360 denier; about 350 denier to about 360 denier; about 250 denier to about 350 denier; about 260 denier to about 350 denier; about 270 denier to about 350 denier; about 280 denier to about 350 denier; about 290 denier to about 350 denier; about 300 denier to about 350 denier; about 310 denier to about 350 denier; about 320 denier to about 350 denier; about 330 denier to about 350 denier; about 340 denier to about 350 denier; about 250 denier to about 340 denier; about 260 denier to about 340 denier; about 270 denier to about 340 denier; about 280 denier to about 340 denier; about 290 denier to about 340 denier; about 300 denier to about 340 denier; about 310 denier to about 340 denier; about 320 denier to about 340 denier; about 330 denier to about 340 denier; about 250 denier to about 330 denier; about 260 denier to about 330 denier; about 270 denier to about 330 denier; about 280 denier to about 330 denier; about 285 denier to about 330 denier; about 290 denier to about 330 denier; about 300 denier to about 330 denier; about 310 denier to about 330 denier; about 320 denier to about 330 denier; about 250 denier to about 320 denier; about 260 denier to about 320 denier; about 270 denier to about 320 denier; about 280 denier to about 320 denier; about 290 denier to about 320 denier; about 300 denier to about 320 denier; about 310 denier to about 320 denier; about 250 denier to about 310 denier; about 260 denier to about 310 denier; about 270 denier to about 310 denier; about 280 denier to about 310 denier; about 290 denier to about 310 denier; about 300 denier to about 310 denier; about 250 denier to about 300 denier; about 260 denier to about 300 denier; about 270 denier to about 300 denier; about 280 denier to about 300 denier; about 290 denier to about 300 denier; about 250 denier to about 350 denier; about 270 denier to about 330 denier; about 280 denier to about 320 denier; about 285 denier to about 310 denier; about 250 denier to about 360 denier; about 270 denier to about 360 denier; about 280 denier to about 360 denier; about 285 denier to about 360 denier; a sub-range within any of the foregoing ranges; or any set of values utilizing values within any of the foregoing ranges.

In a further aspect, the single-covered yarn has a weight of about 270 denier±10%; 270 denier±5%; about 270 denier±3%; about 271 denier±10%; 271 denier±5%; about 271 denier±3%; about 272 denier±10%; 272 denier±5%; about 272 denier±3%; about 273 denier±10%; 273 denier±5%; about 273 denier±3%; about 274 denier±10%; 274 denier±5%; about 274 denier±3%; about 275 denier±10%; 275 denier±5%; about 275 denier±3%; about 276 denier±10%; 276 denier±5%; about 276 denier±3%; about 277 denier±10%; 277 denier±5%; about 277 denier±3%; about 278 denier±10%; 278 denier ±5%; about 278 denier±3%; about 279 denier±10%; 279 denier±5%; about 279 denier±3%; about 280 denier±10%; 280 denier±5%; about 280 denier±3%; about 281 denier±10%; 281 denier±5%; about 281 denier±3%; about 282 denier±10%; 282 denier±5%; about 282 denier±3%; about 283 denier±10%; 283 denier±5%; about 283 denier±3%; about 284 denier±10%; 284 denier±5%; about 284 denier±3%; about 285 denier±10%; 285 denier±5%; about 285 denier±3%; about 286 denier±10%; 286 denier±5%; about 286 denier±3%; about 287 denier±10%; 287 denier±5%; about 287 denier±3%; about 288 denier±10%; 288 denier±5%; about 288 denier±3%; about 289 denier±10%; 289 denier±5%; about 289 denier±3%; about 290 denier±10%; 290 denier±5%; about 290 denier±3%; about 291 denier±10%; 291 denier±5%; about 291 denier±3%; about 292 denier±10%; 292 denier±5%; about 292 denier±3%; about 293 denier±10%; 293 denier ±5%; about 293 denier±3%; about 294 denier±10%; 294 denier±5%; about 294 denier±3%; about 295 denier±10%; 295 denier±5%; about 295 denier±3%; about 296 denier±10%; 296 denier±5%; about 296 denier±3%; about 297 denier±10%; 297 denier±5%; about 297 denier±3%; about 298 denier±10%; 298 denier±5%; about 298 denier±3%; about 299 denier±10%; 299 denier±5%; about 299 denier±3%; about 300 denier±10%; 300 denier±5%; about 300 denier±3%; about 301 denier±10%; 301 denier±5%; about 301 denier±3%; about 302 denier±10%;

302 denier±5%; about 302 denier±3%; about 303 denier±10%; 303 denier±5%; about 303 denier±3%; about 304 denier±10%; 304 denier±5%; about 304 denier±3%; about 305 denier±10%; 305 denier±5%; about 305 denier±3%; about 306 denier±10%; 306 denier±5%; about 306 denier±3%; about 307 denier±10%; 307 denier±5%; about 307 denier±3%; about 308 denier±10%; 308 denier ±5%; about 308 denier±3%; about 309 denier±10%; 309 denier±5%; about 309 denier±3%; about 310 denier±10%; 310 denier±5%; about 310 denier±3%; about 311 denier±10%; 311 denier±5%; about 311 denier±3%; about 312 denier±10%; 312 denier±5%; about 312 denier±3%; about 313 denier±10%; 313 denier±5%; about 313 denier±3%; about 314 denier±10%; 314 denier±5%; about 314 denier±3%; about 315 denier±10%; 315 denier±5%; about 315 denier±3%; about 316 denier±10%; 316 denier±5%; about 316 denier±3%; about 317 denier±10%; 317 denier±5%; about 317 denier±3%; about 318 denier±10%; 318 denier±5%; about 318 denier±3%; about 319 denier±10%; 319 denier±5%; about 319 denier±3%; about 320 denier±10%; 320 denier±5%; about 320 denier±3%; about 321 denier±10%; 321 denier±5%; about 321 denier±3%; about 322 denier±10%; 322 denier±5%; about 322 denier±3%; about 323 denier±10%; 323 denier ±5%; about 323 denier±3%; about 324 denier±10%; 324 denier±5%; about 324 denier±3%; about 325 denier±10%; 325 denier±5%; about 325 denier±3%; about 326 denier±10%; 326 denier±5%; about 326 denier±3%; about 327 denier±10%; 327 denier±5%; about 327 denier±3%; about 328 denier±10%; 328 denier±5%; about 328 denier±3%; about 329 denier±10%; 329 denier±5%; about 329 denier±3%; about 330 denier±10%; 330 denier±5%; about 330 denier±3%; about 331 denier±10%; 331 denier±5%; about 331 denier±3%; about 332 denier±10%; 332 denier±5%; about 332 denier±3%; about 333 denier±10%; 333 denier±5%; about 333 denier±3%; about 334 denier±10%; 334 denier±5%; about 334 denier±3%; about 335 denier±10%; 335 denier±5%; about 335 denier±3%; about 336 denier±10%; 336 denier±5%; about 336 denier±3%; about 337 denier±10%; 337 denier±5%; about 337 denier±3%; about 338 denier±10%; 338 denier ±5%; about 338 denier±3%; about 339 denier±10%; 339 denier±5%; about 339 denier±3%; about 340 denier±10%; 340 denier±5%; about 340 denier±3%; about 341 denier±10%; 341 denier±5%; about 341 denier±3%; about 342 denier±10%; 342 denier±5%; about 342 denier±3%; about 343 denier±10%; 343 denier±5%; about 343 denier±3%; about 344 denier±10%; 344 denier±5%; about 344 denier±3%; about 345 denier±10%; 345 denier±5%; about 345 denier±3%; about 346 denier±10%; 346 denier±5%; about 346 denier±3%; about 347 denier±10%; 347 denier±5%; about 347 denier±3%; about 348 denier±10%; 348 denier±5%; about 348 denier±3%; about 349 denier±10%; 349 denier±5%; about 349 denier±3%; about 350 denier±10%; 350 denier±5%; about 350 denier±3%; about 351 denier±10%; 351 denier±5%; about 351 denier±3%; about 352 denier±10%; 352 denier±5%; about 352 denier±3%; about 353 denier±10%; 353 denier ±5%; about 353 denier±3%; about 354 denier±10%; 354 denier±5%; about 354 denier±3%; about 355 denier±10%; 355 denier±5%; about 355 denier±3%; about 356 denier±10%; 356 denier±5%; about 356 denier±3%; about 357 denier±10%; 357 denier±5%; about 357 denier±3%; about 358 denier±10%; 358 denier±5%; about 358 denier±3%; about 359 denier±10%; 359 denier±5%; about 359 denier±3%; about 360 denier±10%; 360 denier±5%; about 360 denier±3%; about 361 denier±10%; 361 denier±5%; about 361 denier±3%; about 362 denier±10%; 362 denier±5%; about 362 denier±3%; about 363 denier±10%; 363 denier±5%; about 363 denier±3%; about 364 denier±10%; 364 denier±5%; about 364 denier±3%; about 365 denier±10%; 365 denier±5%; about 365 denier±3%; about 366 denier±10%; 366 denier±5%; about 366 denier±3%; about 367 denier±10%; 367 denier±5%; about 367 denier±3%; about 368 denier±10%; 368 denier ±5%; about 368 denier±3%; about 369 denier±10%; about 369 denier±5%; about 369 denier±3%; about 370 denier±10%; 370 denier±5%; about 370 denier±3%; about 371 denier±10%; 371 denier±5%; about 371 denier±3%; about 372 denier±10%; 372 denier ±5%; about 372 denier±3%; about 373 denier±10%; 373 denier±5%; about 373 denier±3%; about 374 denier±10%; 374 denier±5%; about 374 denier±3%; about 375 denier±10%; 375 denier±5%; about 375 denier±3%; about 376 denier±10%; 376 denier±5%; about 376 denier±3%; about 377 denier±10%; 377 denier±5%; about 377 denier±3%; about 378 denier±10%; 378 denier±5%; about 378 denier±3%; about 379 denier±10%; about 379 denier±5%; about 379 denier±3%; about 380 denier±10%; about 380 denier±5%; about 380 denier±3%; a range encompassing any of the foregoing values; or any combination of the foregoing values.

In an aspect, the first cooling composition can be present in an amount of about 0.01 wt % to about 20 wt % based on the total weight of the single-covered yarn. In a further aspect, the first cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

In an aspect, the second cooling composition can be present in an amount of about 0.01 wt % to about 20 wt % based on the total weight of the single-covered yarn. In a further aspect, the second cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

The weight percent for a cooling composition in a disclosed single-covered yarn, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

In one aspect, the disclosure relates to single-covered yarns that can be utilized in a woven or knit fabric. More specifically, in one aspect, the present disclosure relates to single-covered yarn comprising: (a) a core fiber comprising a disclosed composite fiber; and (b) a first fiber comprising a cellulosic fiber; wherein the first fiber is wound around the core fiber to form a single covered yarn.

In various aspects, a disclosed single-covered yarn comprises about 35 wt % to about 55 wt % of a core fiber comprising a disclosed composite fiber; and about 35 wt % to about 60 wt % of a first fiber comprising a cellulosic fiber; and wherein the weight percent is based upon the total weight of the single-covered yarn, and provided that the total weight percent of the core fiber and the first fiber is from about 90 wt % to about 100 wt %.

In a further aspect, a disclosed single-covered yarn comprises about 38 wt % to about 52 wt % of a core fiber comprising a disclosed composite fiber; and about 40 wt % to about 50 wt % of a first fiber comprising a cellulosic fiber; and wherein the weight percent is based upon the total weight of the single-covered yarn, and provided that the total weight percent of the core fiber and the first fiber is from about 90 wt % to about 100 wt %.

In a further aspect, a disclosed single-covered yarn comprises about 40 wt % to about 50 wt % of a core fiber comprising a disclosed composite fiber; and about 42 wt % to about 48 wt % of a first fiber comprising a cellulosic fiber; and wherein the weight percent is based upon the total weight of the single-covered yarn, and provided that the total weight percent of the core fiber and the first fiber is from about 90 wt % to about 100 wt %.

In a further aspect, a single-covered yarn comprises a core fiber in a weight percent amount based on the total weight of the single-covered yarn of about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; a range utilizing any of the foregoing values; a sub-range with a range utilizing any of the foregoing values; or any set of values utilizing the foregoing values, and provided that the total weight percent of the elastic yarn, the first yarn, and the first fiber is from about 90 wt % to about 100 wt %.

In a further aspect, a single-covered yarn comprises a first fiber in a weight percent amount based on the total weight of the single-covered yarn of about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; a range utilizing any of the foregoing values; a sub-range with a range utilizing any of the foregoing values; or any set of values utilizing the foregoing values, and provided that the total weight percent of the elastic yarn, the first yarn, and the first fiber is from about 90 wt % to about 100 wt %.

In various aspects, the first fiber used in a disclosed single-covered yarn can be a suitable cellulosic fiber. In some instances, the cellulosic fiber of the f fiber is a regenerated cellulosic fiber, such as, but not limited to, a viscose rayon, a high wet modulus rayon, a cuprammonium rayon, a saponified rayon, a modal rayon, a lyocell rayon, or combinations thereof. In a particular instance, the regenerated cellulosic fiber can be a viscose rayon.

In various aspects, the first fiber of the single-covered yarn has a weight of about 105 d/20f to about 130 d/40f; about 110 d/20f to about 130 d/40f; about 115 d/20f to about 130 d/40f; about 105 d/20f to about 130 d/35f; about 110 d/35f to about 130 d/35f; about 115 d/20f to about 130 d/35f; about 105 d/20f to about 130 d/30f; about 110 d/20f to about 130 d/30f; about 115 d/20f to about 130 d/30f; or a sub-range within the foregoing ranges.

In a further aspect, the first fiber of the single-covered yarn has a weight of about 120 d/20f±10%; about 120 d/20f±5%; about 120 d/20f±3%; 121 d/20f±10%; about 121 d/20f±5%; about 121 d/20f±3%; 122 d/20f±10%; about 122 d/20f±5%; about 122 d/20f±3%; 123 d/20f±10%; about 123 d/20f±5%; about 123 d/20f±3%; 124 d/20f±10%; about 124 d/20f±5%; about 124 d/20f±3%; 125 d/20f±10%; about 125 d/20f±5%; about 125 d/20f±3%; 126 d/20f±10%; about 126 d/20f±5%; about 126 d/20f±3%; 127 d/20f±10%; about 127 d/20f±5%; about 127 d/20f±3%; 128 d/20f±10%; about 128 d/20f±5%; about 128 d/20f±3%; 129 d/20f±10%; about 129 d/20f±5%; about 129 d/20f±3%; 130 d/20f±10%; about 130 d/20f±5%; about 130 d/20f±3%; about 120 d/25f±10%; about 120 d/25f±5%; about 120 d/25f±3%; 121 d/25f±10%; about 121 d/25f±5%; about 121 d/25f±3%; 122 d/25f±10%; about 122 d/25f±5%; about 122 d/25f±3%; 123 d/25f±10%; about 123 d/25f±5%; about 123 d/25f±3%; 124 d/25f±10%; about 124 d/25f±5%; about 124 d/25f±3%; 125 d/25f±10%; about 125 d/25f±5%; about 125 d/25f±3%; 126 d/25f±10%; about 126 d/25f±5%; about 126 d/25f±3%; 127 d/25f±10%; about 127 d/25f±5%; about 127 d/25f±3%; 128 d/25f±10%; about 128 d/25f±5%; about 128 d/25f±3%; 129 d/25f±10%; about 129 d/25f±5%; about 129 d/25f±3%; 130 d/25f±10%; about 130 d/25f±5%; about 130 d/25f±3%; about 120 d/30f±10%; about 120 d/30f±5%; about 120 d/30f±3%; 121 d/30f±10%; about 121 d/30f±5%; about 121 d/30f±3%; 122 d/30f±10%; about 122 d/30f±5%; about 122 d/30f±3%; 123 d/30f±10%; about 123 d/30f±5%; about 123 d/30f±3%; 124 d/30f±10%; about 124 d/30f±5%; about 124 d/30f±3%; 125 d/30f±10%; about 125 d/30f±5%; about 125 d/30f±3%; 126 d/30f±10%; about 126 d/30f±5%; about 126 d/30f±3%; 127 d/30f±10%; about 127 d/30f±5%; about 127 d/30f±3%; 128 d/30f±10%; about 128 d/30f±5%; about 128 d/30f±3%; 129 d/30f±10%; about 129 d/30f±5%; about 129 d/30f±3%; 130 d/30f±10%; about 130 d/30f±5%; about 130 d/30f±3%; about 120 d/35f±10%; about 120 d/35f±5%; about 120 d/35f±3%; 121 d/35f±10%; about 121 d/35f±5%; about 121 d/35f±3%; 122 d/35f±10%; about 122 d/35f±5%; about 122 d/35f±3%; 123 d/35f±10%; about 123 d/35f±5%; about 123 d/35f±3%; 124 d/35f±10%; about 124 d/35f±5%; about 124 d/35f±3%; 125 d/35f±10%; about 125 d/35f±5%; about 125 d/35f±3%; 126 d/35f±10%; about 126 d/35f±5%; about 126 d/35f±3%; 127 d/35f±10%; about 127 d/35f±5%; about 127 d/35f±3%; 128 d/35f±10%; about 128 d/35f±5%; about 128 d/35f±3%; 129 d/35f±10%; about 129 d/35f±5%; about 129 d/35f±3%; 130 d/35f±10%; about 130 d/35f±5%; about 130 d/35f±3%; about 120 d/40f±10%; about 120 d/40f±5%; about 120 d/40f±3%; 121 d/40f±10%; about 121 d/40f±5%; about 121 d/40f±3%; 122 d/40f±10%; about 122 d/40f±5%; about 122 d/40f±3%; 123 d/40f±10%; about 123 d/40f±5%; about 123 d/40f±3%; 124 d/40f±10%; about 124 d/40f±5%; about 124 d/40f±3%; 125 d/40f±10%; about 125 d/40f±5%; about 125 d/40f±3%; 126 d/40f±10%; about 126 d/40f±5%; about 126 d/40f±3%; 127 d/40f±10%; about 127 d/40f±5%; about 127 d/40f±3%; 128 d/40f±10%; about 128 d/40f±5%; about 128 d/40f±3%; 129 d/40f±10%; about 129 d/40f±5%; about 129 d/40f±3%; 130 d/40f±10%; about 130 d/40f±5%; about 130 d/40f±3%; a range encompassing any of the foregoing value; or any combination of the foregoing values.

In various aspects, the single-covered yarn has a weight of about 250 denier to about 370 denier; about 260 denier to about 370 denier; about 270 denier to about 370 denier; about 280 denier to about 370 denier; about 290 denier to about 370 denier; about 300 denier to about 370 denier; about 310 denier to about 370 denier; about 320 denier to about 370 denier; about 330 denier to about 370 denier; about 340 denier to about 370 denier; about 350 denier to about 370 denier; about 355 denier to about 370 denier; about 360 denier to about 370 denier; about 250 denier to about 360 denier; about 260 denier to about 360 denier; about 270 denier to about 360 denier; about 280 denier to about 360 denier; about 290 denier to about 360 denier; about 300 denier to about 360 denier; about 310 denier to about 360 denier; about 320 denier to about 360 denier; about 330 denier to about 360 denier; about 340 denier to about 360 denier; about 350 denier to about 360 denier; about 250 denier to about 350 denier; about 260 denier to about 350 denier; about 270 denier to about 350 denier; about 280 denier to about 350 denier; about 290 denier to about 350 denier; about 300 denier to about 350 denier; about 310 denier to about 350 denier; about 320 denier to about 350 denier; about 330 denier to about 350 denier; about 340 denier to about 350 denier; about 250 denier to about 340 denier; about 260 denier to about 340 denier; about 270 denier to about 340 denier; about 280 denier to about 340 denier; about 290 denier to about 340 denier; about 300 denier to about 340 denier; about 310 denier to about 340 denier; about 320 denier to about 340 denier; about 330 denier to about 340 denier; about 250 denier to about 330 denier; about 260 denier to about 330 denier; about 270 denier to about 330 denier; about 280 denier to about 330 denier; about 285 denier to about 330 denier; about 290 denier to about 330 denier; about 300 denier to about 330 denier; about 310 denier to about 330 denier; about 320 denier to about 330 denier; about 250 denier to about 320 denier; about 260 denier to about 320 denier; about 270 denier to about 320 denier; about 280 denier to about 320 denier; about 290 denier to about 320 denier; about 300 denier to about 320 denier; about 310 denier to about 320 denier; about 250 denier to about 310 denier; about 260 denier to about 310 denier; about 270 denier to about 310 denier; about 280 denier to about about 310 denier; about 290 denier to about 310 denier; about 300 denier to about 310 denier; about 250 denier to about 300 denier; about 260 denier to about 300 denier; about 270 denier to about 300 denier; about 280 denier to about 300 denier; about 290 denier to about 300 denier; or a value, set of values, or sub-range within any of the foregoing ranges.

In a further aspect, the single-covered yarn has a weight of about 270 denier±10%; 270 denier±5%; about 270 denier±3%; about 271 denier±10%; 271 denier±5%; about 271 denier±3%; about 272 denier±10%; 272 denier±5%; about 272 denier±3%; about 273 denier±10%; 273 denier±5%; about 273 denier±3%; about 274 denier±10%; 274 denier±5%; about 274 denier±3%; about 275 denier±10%; 275 denier±5%; about 275 denier±3%; about 276 denier±10%; 276 denier±5%; about 276 denier±3%; about 277 denier±10%; 277 denier±5%; about 277 denier±3%; about 278 denier±10%; 278 denier ±5%; about 278 denier±3%; about 279 denier±10%; 279 denier±5%; about 279 denier±3%; about 280 denier±10%; 280 denier±5%; about 280 denier±3%; about 281 denier±10%; 281 denier±5%; about 281 denier±3%; about 282 denier±10%; 282 denier±5%; about 282 denier±3%; about 283 denier±10%; 283 denier±5%; about 283 denier±3%; about 284 denier±10%; 284 denier±5%; about 284 denier±3%; about 285 denier±10%; 285 denier±5%; about 285 denier±3%; about 286 denier±10%; 286 denier±5%; about 286 denier±3%; about 287 denier±10%; 287 denier±5%; about 287 denier±3%; about 288 denier±10%; 288 denier±5%; about 288 denier±3%; about 289 denier±10%; 289 denier±5%; about 289 denier±3%; about 290 denier±10%; 290 denier±5%; about 290 denier±3%; about 291 denier±10%; 291 denier±5%; about 291 denier±3%; about 292 denier±10%; 292 denier±5%; about 292 denier±3%; about 293 denier±10%; 293 denier ±5%; about 293 denier±3%; about 294 denier±10%; 294 denier±5%; about 294 denier±3%; about 295 denier±10%; 295 denier±5%; about 295 denier±3%; about 296 denier±10%; 296 denier±5%; about 296 denier±3%; about 297 denier±10%; 297 denier±5%; about 297 denier±3%; about 298 denier±10%; 298 denier±5%; about 298 denier±3%; about 299 denier±10%; 299 denier±5%; about 299 denier±3%; about 300 denier±10%; 300 denier±5%; about 300 denier±3%; about 301 denier±10%; 301 denier±5%; about 301 denier±3%; about 302 denier±10%; 302 denier±5%; about 302 denier±3%; about 303 denier±10%; 303 denier±5%; about 303 denier±3%; about 304 denier±10%; 304 denier±5%; about 304 denier±3%; about 305 denier±10%; 305 denier±5%; about 305 denier±3%; about 306 denier±10%; 306 denier±5%; about 306 denier±3%; about 307 denier±10%; 307 denier±5%; about 307 denier±3%; about 308 denier±10%; 308 denier ±5%; about 308 denier±3%; about 309 denier±10%; 309 denier±5%; about 309 denier±3%; about 310 denier±10%; 310 denier±5%; about 310 denier±3%; about 311 denier±10%; 311 denier±5%; about 311 denier±3%; about 312 denier±10%; 312 denier±5%; about 312 denier±3%; about 313 denier±10%; 313 denier±5%; about 313 denier±3%; about 314 denier±10%; 314 denier±5%; about 314 denier±3%; about 315 denier±10%; 315 denier±5%; about 315 denier±3%; about 316 denier±10%; 316 denier±5%; about 316 denier±3%; about 317 denier±10%; 317 denier±5%; about 317 denier±3%; about 318 denier±10%; 318 denier±5%; about 318 denier±3%; about 319 denier±10%; 319 denier±5%; about 319 denier±3%; about 320 denier±10%; 320 denier±5%; about 320 denier±3%; about 321 denier±10%; 321 denier±5%; about 321 denier±3%; about 322 denier±10%; 322 denier±5%; about 322 denier±3%; about 323 denier±10%; 323 denier ±5%; about 323 denier±3%; about 324 denier±10%; 324 denier±5%; about 324 denier±3%; about 325 denier±10%; 325 denier±5%; about 325 denier±3%; about 326 denier±10%; 326 denier±5%; about 326 denier±3%; about 327 denier±10%; 327 denier±5%; about 327 denier±3%; about 328 denier±10%; 328 denier±5%; about 328 denier±3%; about 329 denier±10%; 329 denier±5%; about 329 denier±3%; about 330 denier±10%; 330 denier±5%; about 330 denier±3%; about 331 denier±10%; 331 denier±5%; about 331 denier±3%; about 332 denier±10%; 332 denier±5%; about 332 denier±3%; about 333 denier±10%; 333 denier±5%; about 333 denier±3%; about 334 denier±10%; 334 denier±5%; about 334 denier±3%; about 335 denier±10%; 335 denier±5%; about 335 denier±3%; about 336 denier±10%; 336 denier±5%; about 336 denier±3%; about 337 denier±10%; 337 denier±5%; about 337 denier±3%; about 338 denier±10%; 338 denier ±5%; about 338 denier±3%; about 339 denier±10%; 339 denier±5%; about 339 denier±3%; about 340 denier±10%; 340 denier±5%; about 340 denier±3%; about 341 denier±10%; 341 denier±5%; about 341 denier±3%; about 342 denier±10%; 342 denier±5%; about 342 denier±3%; about 343 denier±10%; 343 denier±5%; about 343 denier±3%; about 344 denier±10%; 344 denier±5%; about 344 denier±3%; about 345 denier±10%; 345 denier±5%; about 345 denier±3%; about 346 denier±10%; 346 denier±5%; about 346 denier±3%; about 347 denier±10%; 347 denier±5%; about 347 denier±3%; about 348 denier±10%; 348 denier±5%; about 348 denier±3%; about 349 denier±10%; 349 denier±5%; about 349 denier±3%; about 350 denier±10%; 350 denier±5%; about 350 denier±3%; about 351 denier±10%; 351 denier±5%; about 351 denier±3%; about 352 denier±10%; 352 denier±5%; about 352 denier±3%; about 353 denier±10%; 353 denier ±5%; about 353 denier±3%; about 354 denier±10%; 354 denier±5%; about 354 denier±3%; about 355 denier±10%; 355 denier±5%; about 355 denier±3%; about 356 denier±10%; 356 denier±5%; about 356 denier±3%; about 357 denier±10%; 357 denier±5%; about 357 denier±3%; about 358 denier±10%; 358 denier±5%; about 358 denier±3%; about 359 denier±10%; 359 denier±5%; about 359 denier±3%; about 360 denier±10%; 360 denier±5%; about 360 denier±3%; about 361 denier±10%; 361 denier±5%; about 361 denier±3%; about 362 denier±10%; 362 denier±5%; about 362 denier±3%; about 363 denier±10%; 363 denier±5%; about 363 denier±3%; about 364 denier±10%; 364 denier±5%; about 364 denier±3%; about 365 denier±10%; 365 denier±5%; about 365 denier±3%; about 366 denier±10%; 366 denier±5%; about 366 denier±3%; about 367 denier±10%; 367 denier±5%; about 367 denier±3%; about 368 denier±10%; 368 denier ±5%; about 368 denier±3%; about 369 denier±10%; about 369 denier±5%; about 369 denier±3%; about 370 denier±10%; 370 denier±5%; about 370 denier±3%; about 371 denier±10%; 371 denier±5%; about 371 denier±3%; about 372 denier±10%; 372 denier ±5%; about 372 denier±3%; about 373 denier±10%; 373 denier±5%; about 373 denier±3%; about 374 denier±10%; 374 denier±5%; about 374 denier±3%; about 375 denier±10%; 375 denier±5%; about 375 denier±3%; about 376 denier±10%; 376 denier±5%; about 376 denier±3%; about 377 denier±10%; 377 denier±5%; about 377 denier±3%; about 378 denier±10%; 378 denier±5%; about 378 denier±3%; about 379 denier±10%; about 379 denier±5%; about 379 denier±3%; about 380 denier±10%; about 380 denier±5%; about 380 denier±3%; a range encompassing any of the foregoing values; or any combination of the foregoing values.

In an aspect, the first cooling composition can be present in an amount of about 0.01 wt % to about 1 wt % based on the total weight of the single-covered yarn. In a further aspect, the first cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In an aspect, the first cooling composition can be present in an amount of about 1.0 wt % to about 5 wt % based on the total weight of the single-covered yarn. In a further aspect, the first cooling composition can be present in an amount, based on the total weight of the single-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.01 wt % to about 0.9 wt % of the first cooling material; about 0.001 wt % to about 0.05 wt % of the first cooling compound; about 0.0001 wt % to about 0.005 wt % of the first cooling salt; or combinations thereof; and wherein the wt % is based on the total weight of the single-covered yarn. In a still further aspect, the first cooling material can be present in the first cooling composition, based on the total weight of the single-covered yarn, in an amount of about 0.05 wt % to about 0.9 wt % of the first cooling material; about 0.005 wt % to about 0.03 wt % of the first cooling compound; about 0.0003 wt % to about 0.003 wt % of the first cooling salt; or combinations thereof; and wherein the wt % is based on the total weight of the single-covered yarn. In a yet further aspect, the first cooling material can be present in the first cooling composition in an amount of about 0.07 wt % to about 0.5 wt % of the first cooling material; about 0.007 wt % to about 0.03 wt % of the first cooling compound; and about 0.0001 wt % to about 0.004 wt % of the first cooling salt; and wherein the wt % is based on the total weight of the single-covered yarn. In an even further aspect, the first cooling material can be present in the first cooling composition in an amount of about 0.19 wt % to about 0.3 wt % of the first cooling material; about 0.007 wt % to about 0.20 wt % of the first cooling compound; and about 0.0001 wt % to about 0.003 wt % of the first cooling salt; and wherein the wt % is based on the total weight of the single-covered yarn.

In a further aspect, the first cooling material can be present in the first cooling composition in an amount of about 0.1 wt % to about 4.0 wt % of the first cooling material; about 0.1 wt % to about 5.0 wt % of the first cooling compound; about 0.01 wt % to about 2.0 wt % of the first cooling salt; or combinations thereof; and wherein the wt % is based on the total weight of the single-covered yarn. In a still further aspect, the first cooling material can be present in the first cooling composition, based on the total weight of the single-covered yarn, in an amount of about 0.1 wt % to about 3.0 wt % of the first cooling material; about 0.1 wt % to about 4.0 wt % of the first cooling compound; about 0.01 wt % to about 1.0 wt % of the first cooling salt; or combinations thereof; and wherein the wt % is based on the total weight of the single-covered yarn. In a yet further aspect, the first cooling material can be present in the first cooling composition in an amount of about 0.1 wt % to about 2.5 wt % of the first cooling material; about 0.1 wt % to about 3.0 wt % of the first cooling compound; and about 0.01 wt % to about 0.75 wt % of the first cooling salt; and wherein the wt % is based on the total weight of the single-covered yarn. In an even further aspect, the first cooling material can be present in the first cooling composition in an amount of about 0.3 wt % to about 2.0 wt % of the first cooling material; about 0.1 wt % to about 2.5 wt % of the first cooling compound; and about 0.05 wt % to about 0.5 wt % of the first cooling salt; and wherein the wt % is based on the total weight of the single-covered yarn. In a still further aspect, the first cooling material can be present in the first cooling composition in an amount of about 0.5 wt % to about 2.0 wt % of the first cooling material; about 0.5 wt % to about 2.2 wt % of the first cooling compound; and about 0.07 wt % to about 0.45 wt % of the first cooling salt; and wherein the wt % is based on the total weight of the single-covered yarn.

In a further aspect, the first cooling material can be present in the first cooling composition in an amount of about 0.01 wt % to about 0.9 wt %; and wherein the wt % is based on the total weight of the single-covered yarn. In a still further aspect, the first cooling material can be present in an amount of 0.05 wt % to about 0.9 wt %; and wherein the wt % is based on the total weight of the single-covered yarn. In a yet further aspect, the first cooling material can be present in an amount of about 0.07 wt % to about 0.5 wt %; and wherein the wt % is based on the total weight of the single-covered yarn. In an even further aspect, the first cooling material can be present in an amount of about 0.19 wt % to about 0.3 wt %; and wherein the wt % is based on the total weight of the single-covered yarn.

In a further aspect, the first cooling material can be present in the first cooling composition, based on the total weight of the single-covered yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.1 wt % to about 4.0 wt %; and wherein the wt % is based on the total weight of the single-covered yarn. In a still further aspect, the first cooling material can be present in an amount of about 0.1 wt % to about 4.0 wt %; and wherein the wt % is based on the total weight of the single-covered yarn. In a yet further aspect, the first cooling material can be present in an amount of about 0.1 wt % to about 2.5 wt %; and wherein the wt % is based on the total weight of the single-covered yarn. In a still further aspect, the first cooling material can be present in an amount of about 0.3 wt % to about 2.0 wt % of the first cooling material; and wherein the wt % is based on the total weight of the single-covered yarn. In an even further aspect, the first cooling material can be present in an amount of about 0.5 wt % to about 2.0 wt %; and wherein the wt % is based on the total weight of the single-covered yarn.

In a further aspect, the first cooling material can be present in the first cooling composition, based on the total weight of the single-covered yarn, in an amount of about 0.0 wt %, about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, a sub-range with a range utilizing any of the foregoing values; or any set of values utilizing the foregoing values.

In a further aspect, the first cooling compound can be present in the first cooling polymer composition in an amount of about 0.001 wt % to about 0.05 wt %; about 0.005 wt % to about 0.03 wt %; about 0.007 wt % to about 0.03 wt %; about 0.007 wt % to about 0.20 wt %; and wherein the wt % is based on the total weight of the single-covered yarn.

In a further aspect, the first cooling compound can be present in the first cooling polymer composition, based on the total weight of the single-covered yarn, in an amount of about 0.001 wt %; about 0.002 wt %; about 0.003 wt %; about 0.004 wt %; about 0.005 wt %; about 0.010 wt %; about 0.015 wt %; about 0.020 wt %; about 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; about 0.075 wt %; about 0.080 wt %; about 0.085 wt %; about 0.090 wt %; about 0.090 wt %; about 0.095 wt %; about 0.100 wt %; about 0.110 wt %; about 0.115 wt %; about 0.120 wt %; about 0.125 wt %; about 0.130 wt %; about 0.135 wt %; about 0.140 wt %; about 0.145 wt %; about 0.150 wt %; about 0.155 wt %; about 0.160 wt %; about 0.165 wt %; about 0.170 wt %; about 0.175 wt %; about 0.180 wt %; about 0.185 wt %; about 0.190 wt %; about 0.190 wt %; about 0.195 wt %; about 0.200 wt %; a range utilizing any of the foregoing values; a sub-range with a range utilizing any of the foregoing values; or any set of values utilizing the foregoing values.

In a further aspect, the first cooling compound can be present in the first cooling polymer composition in an amount of about 0.1 wt % to about 5.0 wt %; about 0.1 wt % to about 4.0 wt %; about 0.1 wt % to about 3.0 wt %; about 0.1 wt % to about 2.5 wt %; about 0.5 wt % to about 2.2 wt %; and wherein the wt % is based on the total weight of the single-covered yarn.

In a further aspect, the first cooling compound can be present in the first cooling polymer composition, based on the total weight of the single-covered yarn, in an amount of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the first cooling composition comprises a first cooling salt present in an amount, based on the total weight of the single-covered yarn, of about 0.0001 wt % to about 0.005 wt %; about 0.0003 wt % to about 0.003 wt %; about 0.007 wt % to about 0.03 wt %; about 0.0001 wt % to about 0.003 wt %; a range utilizing any of the foregoing values; a sub-range with a range utilizing any of the foregoing values; or any set of values utilizing the foregoing values.

In a further aspect, the first cooling composition comprises a first cooling salt present in an amount, based on the total weight of the single-covered yarn, of about 0.0001 wt %; about 0.0002 wt %; about 0.0003 wt %; about 0.0004 wt %; about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; a range utilizing any of the foregoing values; a sub-range with a range utilizing any of the foregoing values; or any set of values utilizing the foregoing values.

In various aspects, the first cooling composition comprises a first cooling salt present in an amount, based on the total weight of the single-covered yarn, of about 0.01 wt % to about 2.0 wt %; about 0.01 wt % to about 1.0 wt %; about 0.01 wt % to about 0.75 wt %; about 0.05 wt % to about 0.5 wt %; about 0.07 wt % to about 0.45 wt %; or a sub-range within any of the foregoing ranges.

In a further aspect, the first cooling composition comprises a first cooling salt present in an amount, based on the total weight of the single-covered yarn, of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.000 wt %; about 1.01 wt %; about 1.02 wt %; about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %;

about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

In an aspect, the second cooling composition can be present in an amount of about 0.01 wt % to about 1 wt % based on the total weight of the single-covered yarn. In a further aspect, the second cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; a range utilizing any of the foregoing values; a sub-range with a range utilizing any of the foregoing values; or any set of values utilizing the foregoing values.

In an aspect, the second cooling composition can be present in an amount of about 1.0 wt % to about 5 wt % based on the total weight of the single-covered yarn. In a further aspect, the second cooling composition can be present in an amount, based on the total weight of the single-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.01 wt % to about 0.9 wt % of the second cooling material; about 0.001 wt % to about 0.05 wt % of the second cooling compound; about 0.0001 wt % to about 0.005 wt % of the second cooling salt; or combinations thereof; and wherein the wt % is based on the total weight of the single-covered yarn. In a still further aspect, the second cooling material can be present in the second cooling composition, based on the total weight of the single-covered yarn, in an amount of about 0.05 wt % to about 0.9 wt % of the second cooling material; about 0.005 wt % to about 0.03 wt % of the second cooling compound; about 0.0003 wt % to about 0.003 wt % of the second cooling salt; or combinations thereof; and wherein the wt % is based on the total weight of the single-covered yarn. In a yet further aspect, the second cooling material can be present in the second cooling composition in an amount of about 0.07 wt % to about 0.5 wt % of the second cooling material; about 0.007 wt % to about 0.03 wt % of the second cooling compound; and about 0.0001 wt % to about 0.004 wt % of the second cooling salt; and wherein the wt % is based on the total weight of the single-covered yarn. In an even further aspect, the second cooling material can be present in the second cooling composition in an amount of about 0.19 wt % to about 0.3 wt % of the second cooling material; about 0.007 wt % to about 0.20 wt % of the second cooling compound; and about 0.0001 wt % to about 0.003 wt % of the second cooling salt; and wherein the wt % is based on the total weight of the single-covered yarn.

In a further aspect, the second cooling material can be present in the second cooling composition in an amount of about 0.1 wt % to about 4.0 wt % of the second cooling material; about 0.1 wt % to about 5.0 wt % of the second cooling compound; about 0.01 wt % to about 2.0 wt % of the second cooling salt; or combinations thereof; and wherein the wt % is based on the total weight of the single-covered yarn. In a still further aspect, the second cooling material can be present in the second cooling composition, based on the total weight of the single-covered yarn, in an amount of about 0.1 wt % to about 3.0 wt % of the second cooling material; about 0.1 wt % to about 4.0 wt % of the second cooling compound; about 0.01 wt % to about 1.0 wt % of the second cooling salt; or combinations thereof; and wherein the wt % is based on the total weight of the single-covered yarn. In a yet further aspect, the second cooling material can be present in the second cooling composition in an amount of about 0.1 wt % to about 2.5 wt % of the second cooling material; about 0.1 wt % to about 3.0 wt % of the second cooling compound; and about 0.01 wt % to about 0.75 wt % of the second cooling salt; and wherein the wt % is based on the total weight of the single-covered yarn. In an even further aspect, the second cooling material can be present in the second cooling composition in an amount of about 0.3 wt % to about 2.0 wt % of the second cooling material; about 0.1 wt % to about 2.5 wt % of the second cooling compound; and about 0.05 wt % to about 0.5 wt % of the second cooling salt; and wherein the wt % is based on the total weight of the single-covered yarn. In a still further aspect, the second cooling material can be present in the second cooling composition in an amount of about 0.5 wt % to about 2.0 wt % of the second cooling material; about 0.5 wt % to about 2.2 wt % of the second cooling compound; and about 0.07 wt % to about 0.45 wt % of the second cooling salt; and wherein the wt % is based on the total weight of the single-covered yarn.

In a further aspect, the second cooling material can be present in the second cooling composition in an amount of about 0.01 wt % to about 0.9 wt %; and wherein the wt % is based on the total weight of the single-covered yarn. In a still further aspect, the second cooling material can be present in an amount of 0.05 wt % to about 0.9 wt %; and wherein the wt % is based on the total weight of the single-covered yarn. In a yet further aspect, the second cooling material can be present in an amount of about 0.07 wt % to about 0.5 wt %; and wherein the wt % is based on the total weight of the single-covered yarn. In an even further aspect, the second cooling material can be present in an amount of about 0.19 wt % to about 0.3 wt %; and wherein the wt % is based on the total weight of the single-covered yarn.

In a further aspect, the second cooling material can be present in the second cooling composition, based on the total weight of the single-covered yarn, in an amount of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.1 wt % to about 4.0 wt %; and wherein the wt % is based on the total weight of the single-covered yarn. In a still further aspect, the second cooling material can be present in an amount of about 0.1 wt % to about 4.0 wt %; and wherein the wt % is based on the total weight of the single-covered yarn. In a yet further aspect, the second cooling material can be present in an amount of about 0.1 wt % to about 2.5 wt %; and wherein the wt % is based on the total weight of the single-covered yarn. In a still further aspect, the second cooling material can be present in an amount of about 0.3 wt % to about 2.0 wt % of the second cooling material; and wherein the wt % is based on the total weight of the single-covered yarn. In an even further aspect, the second cooling material can be present in an amount of about 0.5 wt % to about 2.0 wt %; and wherein the wt % is based on the total weight of the single-covered yarn.

In a further aspect, the second cooling material can be present in the second cooling composition, based on the total weight of the single-covered yarn, in an amount of about 0.0 wt %, about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %, about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %, about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %, a sub-range with a range utilizing any of the foregoing values; or any set of values utilizing the foregoing values.

In a further aspect, the second cooling compound can be present in the second cooling polymer composition in an amount of about 0.001 wt % to about 0.05 wt %; about 0.005 wt % to about 0.03 wt %; about 0.007 wt % to about 0.03 wt %; about 0.007 wt % to about 0.20 wt %; and wherein the wt % is based on the total weight of the single-covered yarn.

In a further aspect, the second cooling compound can be present in the second cooling polymer composition, based on the total weight of the single-covered yarn, in an amount of about 0.001 wt %; about 0.002 wt %; about 0.003 wt %; about 0.004 wt %; about 0.005 wt %; about 0.010 wt %; about 0.015 wt %; about 0.020 wt %; about 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; about 0.075 wt %; about 0.080 wt %; about 0.085 wt %; about 0.090 wt %; about 0.090 wt %; about 0.095 wt %; about 0.100 wt %; about 0.110 wt %; about 0.115 wt %; about 0.120 wt %; about 0.125 wt %; about 0.130 wt %; about 0.135 wt %; about 0.140 wt %; about 0.145 wt %; about 0.150 wt %; about 0.155 wt %; about 0.160 wt %; about 0.165 wt %; about 0.170 wt %; about 0.175 wt %; about 0.180 wt %; about 0.185 wt %; about 0.190 wt %; about 0.190 wt %; about 0.195 wt %; about 0.200 wt %; a range utilizing any of the foregoing values; a sub-range with a range utilizing any of the foregoing values; or any set of values utilizing the foregoing values.

In a further aspect, the second cooling compound can be present in the second cooling polymer composition in an amount of about 0.1 wt % to about 5.0 wt %; about 0.1 wt % to about 4.0 wt %; about 0.1 wt % to about 3.0 wt %; about 0.1 wt % to about 2.5 wt %; about 0.5 wt % to about 2.2 wt %; and wherein the wt % is based on the total weight of the single-covered yarn.

In a further aspect, the second cooling compound can be present in the second cooling polymer composition, based on the total weight of the single-covered yarn, in an amount of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In a further aspect, the second cooling composition comprises a second cooling salt present in an amount, based on the total weight of the single-covered yarn, of about 0.0001 wt % to about 0.005 wt %; about 0.0003 wt % to about 0.003 wt %; about 0.007 wt % to about 0.03 wt %; about 0.0001 wt % to about 0.003 wt %; a range utilizing any of the foregoing values; a sub-range with a range utilizing any of the foregoing values; or any set of values utilizing the foregoing values.

In a further aspect, the second cooling composition comprises a second cooling salt present in an amount, based on the total weight of the single-covered yarn, of about 0.0001 wt %; about 0.0002 wt %; about 0.0003 wt %; about 0.0004 wt %; about 0.0005 wt %; about 0.0006 wt %; about 0.0007 wt %; about 0.0008 wt %; about 0.0009 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; about 0.0021 wt %; about 0.0022 wt %; about 0.0023 wt %; about 0.0024 wt %; about 0.0025 wt %; about 0.0026 wt %; about 0.0027 wt %; about 0.0028 wt %; about 0.0029 wt %; about 0.0030 wt %; about 0.0031 wt %; about 0.0032 wt %; about 0.0033 wt %; about 0.0034 wt %; about 0.0035 wt %; about 0.0036 wt %; about 0.0037 wt %; about 0.0038 wt %; about 0.0039 wt %; about 0.0040 wt %; about 0.0041 wt %; about 0.0042 wt %; about 0.0043 wt %; about 0.0044 wt %; about 0.0045 wt %; about 0.0046 wt %; about 0.0047 wt %; about 0.0048 wt %; about 0.0049 wt %; about 0.0050 wt %; a range utilizing any of the foregoing values; a sub-range with a range utilizing any of the foregoing values; or any set of values utilizing the foregoing values.

In various aspects, the second cooling composition comprises a second cooling salt present in an amount, based on the total weight of the single-covered yarn, of about 0.01 wt % to about 2.0 wt %; about 0.01 wt % to about 1.0 wt %; about 0.01 wt % to about 0.75 wt %; about 0.05 wt % to about 0.5 wt %; about 0.07 wt % to about 0.45 wt %; or a sub-range within any of the foregoing ranges.

In a further aspect, the second cooling composition comprises a second cooling salt present in an amount, based on the total weight of the single-covered yarn, of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.000 wt %; about 1.01 wt %; about 1.02 wt %; about 1.03 wt %; about 1.04 wt %; about 1.05 wt %; about 1.06 wt %; about 1.07 wt %; about 1.08 wt %; about 1.09 wt %; about 1.10 wt %; about 1.11 wt %; about 1.12 wt %; about 1.13 wt %; about 1.14 wt %; about 1.15 wt %; about 1.16 wt %; about 1.17 wt %; about 1.18 wt %; about 1.19 wt %; about 1.20 wt %; about 1.21 wt %; about 1.22 wt %; about 1.23 wt %; about 1.24 wt %; about 1.25 wt %; about 1.26 wt %; about 1.27 wt %; about 1.28 wt %; about 1.29 wt %; about 1.30 wt %; about 1.31 wt %; about 1.32 wt %; about 1.33 wt %; about 1.34 wt %; about 1.35 wt %; about 1.36 wt %; about 1.37 wt %; about 1.38 wt %; about 1.39 wt %; about 1.40 wt %; about 1.41 wt %; about 1.42 wt %; about 1.43 wt %; about 1.44 wt %; about 1.45 wt %; about 1.46 wt %; about 1.47 wt %; about 1.48 wt %; about 1.49 wt %; about 1.50 wt %; about 1.51 wt %; about 1.52 wt %; about 1.53 wt %; about 1.54 wt %; about 1.55 wt %; about 1.56 wt %; about 1.57 wt %; about 1.58 wt %; about 1.59 wt %; about 1.60 wt %; about 1.61 wt %; about 1.62 wt %; about 1.63 wt %; about 1.64 wt %; about 1.65 wt %; about 1.66 wt %; about 1.67 wt %; about 1.68 wt %; about 1.69 wt %; about 1.70 wt %; about 1.71 wt %; about 1.72 wt %; about 1.73 wt %; about 1.74 wt %; about 1.75 wt %; about 1.76 wt %; about 1.77 wt %; about 1.78 wt %; about 1.79 wt %; about 1.80 wt %; about 1.81 wt %; about 1.82 wt %; about 1.83 wt %; about 1.84 wt %; about 1.85 wt %; about 1.86 wt %; about 1.87 wt %; about 1.88 wt %; about 1.89 wt %; about 1.90 wt %; about 1.91 wt %; about 1.92 wt %; about 1.93 wt %; about 1.94 wt %; about 1.95 wt %; about 1.96 wt %; about 1.97 wt %; about 1.98 wt %; about 1.99 wt %; about 2.00 wt %; a range utilizing any of the foregoing values; a sub-range with a range utilizing any of the foregoing values; or any set of values utilizing the foregoing values.

E. Fabrics

In various aspects, the disclosure relates to a knit or a woven fabric comprising a disclosed single-covered yarn. More specifically, in one aspect, the present disclosure relates to a woven fabric comprising: a weft yarn comprising a disclosed single-covered yarn; and a warp yarn comprising cellulosic fibers, a polyamide yarn, a polyester yarn, or combinations thereof.

In various aspects, the woven fabric can be a warp-faced fabric. In some aspects, the disclosed woven fabric is a twill weave, e.g., a right-handed twill weave such that the right-handed twill weave has diagonals run from the left to the right of the fabric. The disclosed woven fabric can have a weave pattern that is a 3 by 1 weave; and wherein 3 warp yarns are woven over and under a weft yarn. In other instances, the disclosed woven fabric can have a weave pattern that is a 2 by 1 weave; and wherein 2 warp yarns are woven over and under a weft yarn. In still other instances, the disclosed woven fabric can have a weave pattern that is a 1 by 1 weave; and wherein 1 warp yarn is woven over and under a weft yarn. In some other aspects, the disclosed woven fabric can be a plain weave, e.g., a 1/1 plain weave. The disclosed woven fabric can be a poplin fabric.

In various aspects, a disclosed woven fabric comprises about 20 wt % to about 60 wt % of a warp yarn; and about 40 wt % to about 80 wt % of weft yarn comprising a disclosed single-covered yarn, where it is understood that the weight percent is based upon the total weight of the disclosed woven fabric. In a further aspect, a disclosed woven fabric comprises about 25 wt % to about 55 wt % of a warp yarn; and about 45 wt % to about 75 wt % of weft yarn comprising a disclosed single-covered yarn, where it is understood that the weight percent is based upon the total weight of the disclosed woven fabric. In a still further aspect, a disclosed woven fabric comprises about 27 wt % to about 53 wt % of a warp yarn; and about 47 wt % to about 73 wt % of weft yarn comprising a disclosed single-covered yarn, where it is understood that the weight percent is based upon the total weight of the disclosed woven fabric.

In a further aspect, a disclosed woven fabric comprises a warp yarn in a weight percent amount based on the total weight of the disclosed woven fabric of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; a range utilizing any of the foregoing values; a sub-range with a range utilizing any of the foregoing values; or any set of values utilizing the foregoing values.

In a further aspect, a disclosed woven fabric comprises a weft yarn in a weight percent amount based on the total weight of the disclosed woven fabric of about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values.

In a further aspect, a warp yarn further comprises an elastic fiber in a weight percent amount based on the total weight of the disclosed woven fabric of about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, a weft yarn further comprises an elastic fiber in a weight percent amount based on the total weight of the disclosed woven fabric of about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the disclosed woven fabric has a fabric weight of about 50 grams per square meter ("gsm") to about 300 gsm. In a still further aspect, the disclosed woven fabric has a fabric weight of about 100 gsm to about 250 gsm. In a yet further aspect, the disclosed woven fabric has a fabric weight of about 100 gsm to about 190 gsm.

In various aspects, the disclosed woven fabric has a fabric weight, in units of grams per square meter ("gsm"), of about 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300; a range utilizing any of the foregoing values; a sub-range with a range utilizing any of the foregoing values; or any set of values utilizing the foregoing values.

In a further aspect, the disclosed woven fabric has a warp count of about 50-200. In a still further aspect, the disclosed woven fabric has a warp count of about 80-160. In a yet further aspect, the disclosed woven fabric has a warp count of about 85-155.

In a further aspect, the disclosed woven fabric has a warp count of about 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200; a range utilizing any of the foregoing values; a sub-range with a range utilizing any of the foregoing values; or any set of values utilizing the foregoing values.

In a further aspect, the disclosed woven fabric has a weft count of about 30-100. In a still further aspect, the disclosed woven fabric has a weft count of about 40-95. In a yet further aspect, the disclosed woven fabric has a weft count of about 45-90.

In a further aspect, the disclosed woven fabric has a weft count of about 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100; a range utilizing any of the foregoing values; a sub-range with a range utilizing any of the foregoing values; or any set of values utilizing the foregoing values.

In a further aspect, the disclosed woven fabric has a Qmax value of about 0.15 to about 0.50 when determined in accordance with FTTS-FA-019 as specified by Committee of Conformity Assessment of Accreditation and Certification on Functional and Technical Textiles (Taiwan). In a still further aspect, the disclosed woven fabric has a Qmax value of about 0.17 to about 0.25 when determined in accordance with FTTS-FA-019 as specified by Committee of Conformity Assessment of Accreditation and Certification on Functional and Technical Textiles (Taiwan).

In a further aspect, the disclosed woven fabric has a Qmax value, when determined in accordance with FTTS-FA-019 as specified by Committee of Conformity Assessment of Accreditation and Certification on Functional and Technical Textiles (Taiwan), of about 0.10±10%; about 0.10±5%; about 0.10±3%; about 0.11±10%; about 0.11±5%; about 0.11±3%; about 0.12±10%; about 0.12±5%; about 0.12±3%; about 0.13±10%; about 0.13±5%; about 0.13±3%; about 0.14±10%; about 0.14±5%; about 0.14±3%; about 0.15±10%; about 0.15±5%; about 0.15±3%; about 0.16±10%; about 0.16±5%; about 0.16 ±3%; about 0.17±10%; about 0.17±5%; about 0.17±3%; about 0.18±10%; about 0.18±5%; about 0.18±3%; about 0.19±10%; about 0.19±5%; about 0.19±3%; about 0.20±10%; about 0.20±5%; about 0.20±3%; about 0.21±10%; about 0.21±5%; about 0.21±3%; about 0.22±10%; about 0.22±5%; about 0.22±3%; about 0.23±10%; about 0.23±5%; about 0.23±3%; about 0.24±10%; about 0.24±5%; about 0.24±3%; about 0.25±10%; about 0.25±5%; about 0.25±3%; about 0.26±10%; about 0.26±5%; about 0.26±3%; about 0.27±10%; about 0.27±5%; about 0.27±3%; about 0.28±10%; about 0.28±5%; about 0.28±3%; about 0.29±10%; about 0.29±5%; about 0.29±3%; about 0.30±10%; about 0.30±5%; about 0.30±3%; a range utilizing any of the foregoing values; a sub-range with a range utilizing any of the foregoing values; or any set of values utilizing the foregoing values.

In a further aspect, the disclosed woven fabric has a Qmax value, when determined in accordance with FTTS-FA-019 as specified by Committee of Conformity Assessment of Accreditation and Certification on Functional and Technical Textiles (Taiwan) that is about 20% greater than the Qmax value for a reference fabric. In this context, it is to be understood that the reference fabric consists essentially of similar weight yarns and/or fibers present in a similar weight percent in the reference fabric, with a reference fabric weight that is ±10% of the disclosed woven fabric, and a similar weave pattern in the reference fabric to that of the disclosed woven fabric. In a still further aspect, the disclosed woven fabric has a Qmax value, when determined in accordance with FTTS-FA-019 as specified by Committee of Conformity Assessment of Accreditation and Certification on Functional and Technical Textiles (Taiwan) that is about 25% greater than the Qmax value for a reference fabric. In a yet further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 30% greater than the Qmax value for a reference fabric.

In a further aspect, the disclosed woven fabric has a thermal resistance, when measured in accordance with ISO 11092, of about 0.001 to about 0.010 K $M^2$/W. In a still further aspect, the disclosed woven fabric has a thermal resistance, when measured in accordance with ISO 11092, of about 0.002 to about 0.009 K $M^2$/W. In a yet further aspect, the disclosed woven fabric has a thermal resistance, when measured in accordance with ISO 11092, of about 0.003 to about 0.008 K $M^2$/W.

In a further aspect, the disclosed woven fabric has a thermal resistance, when measured in accordance with ISO 11092, in units of K $M^2$/W, of about 0.0010, 0.0011, 0.0012, 0.0013, 0.0014, 0.0015, 0.0016, 0.0017, 0.0018, 0.0019, 0.0020, 0.0021, 0.0022, 0.0023, 0.0024, 0.0025, 0.0026, 0.0027, 0.0028, 0.0029, 0.0030, 0.0031, 0.0032, 0.0033, 0.0034, 0.0035, 0.0036, 0.0037, 0.0038, 0.0039, 0.0040, 0.0041, 0.0042, 0.0043, 0.0044, 0.0045, 0.0046, 0.0047, 0.0048, 0.0049, 0.0050, 0.0051, 0.0052, 0.0053, 0.0054, 0.0055, 0.0056, 0.0057, 0.0058, 0.0059, 0.0060, 0.0061, 0.0062, 0.0063, 0.0064, 0.0065, 0.0066, 0.0067, 0.0068, 0.0069, 0.0070, 0.0071, 0.0072, 0.0073, 0.0074, 0.0075, 0.0076, 0.0077, 0.0078, 0.0079, 0.0080, 0.0081, 0.0082, 0.0083, 0.0084, 0.0085, 0.0086, 0.0087, 0.0088, 0.0089, 0.0090, 0.0091, 0.0092, 0.0093, 0.0094, 0.0095, 0.0096, 0.0097, 0.0098, 0.0099, 0.0100; a range utilizing any of the foregoing values; a sub-range with a range utilizing any of the foregoing values; or any set of values utilizing the foregoing values.

In a further aspect, the disclosed woven fabric has a thermal conductance, when measured in accordance with ISO 11092, of about 100 to about 1000 W/K $M^2$. In a still further aspect, the disclosed woven fabric has a thermal conductance, when measured in accordance with ISO 11092, of about 110 to about 550 W/K $M^2$. In a yet further aspect, the disclosed woven fabric has a thermal conductance, when measured in accordance with ISO 11092, of about 125 to about 333 W/K $M^2$.

In a further aspect, the disclosed woven fabric has a thermal conductance, when measured in accordance with ISO 11092, in units of W/K $M^2$, of about 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000; a range utilizing any of the foregoing values; a sub-range with a range utilizing any of the foregoing values; or any set of values utilizing the foregoing values.

In a further aspect, the disclosed woven fabric has a wicking time, when determined in accordance with AATCC Test Method 197, of less than about 5 minutes. In a still further aspect, the disclosed woven fabric has a wicking time, when determined in accordance with AATCC Test Method 197, of less than about 4.9 minutes, less than about 4.8 minutes, less than about 4.7 minutes, less than about 4.6 minutes, less than about 4.5 minutes, less than about 4.4 minutes, less than about 4.3 minutes, less than about 4.2 minutes, less than about 4.1 minutes, less than about 4.0 minutes, less than about 3.9 minutes, less than about 3.8 minutes, less than about 3.7 minutes, less than about 3.6 minutes, less than about 3.5 minutes, less than about 3.4 minutes, less than about 3.3 minutes, less than about 3.2 minutes, less than about 3.1 minutes, less than about 3.0 minutes, less than about 2.9 minutes, less than about 2.8 minutes, less than about 2.7 minutes, less than about 2.6 minutes, less than about 2.5 minutes, less than about 2.4 minutes, less than about 2.3 minutes, less than about 2.2 minutes, less than about 2.1 minutes, less than about 2.0 minutes, less than about 1.9 minutes, less than about 1.8 minutes, less than about 1.7 minutes, less than about 1.6 minutes, less than about 1.5 minutes, less than about 1.4 minutes, less than about 1.3 minutes, less than about 1.2 minutes, less than about 1.1 minutes, or less than about 1.0 minutes.

In a further aspect, the disclosed woven fabric has a wicking time, when determined in accordance with AATCC Test Method 197, from about 0.5 minutes to about 4.9 minutes, about 0.5 minutes to about 4.8 minutes, about 0.5 minutes to about 4.7 minutes, about 0.5 minutes to about 4.6 minutes, about 0.5 minutes to about 4.5 minutes, about 0.5 minutes to about 4.4 minutes, about 0.5 minutes to about 4.3 minutes, about 0.5 minutes to about 4.2 minutes, about 0.5 minutes to about 4.1 minutes, about 0.5 minutes to about 4.0 minutes, about 0.5 minutes to about 3.9 minutes, about 0.5 minutes to about 3.8 minutes, about 0.5 minutes to about 3.7 minutes, about 0.5 minutes to about 3.6 minutes, about 0.5 minutes to about 3.5 minutes, about 0.5 minutes to about 3.4 minutes, about 0.5 minutes to about 3.3 minutes, about 0.5 minutes to about 3.2 minutes, about 0.5 minutes to about 3.1 minutes, about 0.5 minutes to about 3.0 minutes, about 0.5 minutes to about 2.9 minutes, about 0.5 minutes to about 2.8 minutes, about 0.5 minutes to about 2.7 minutes, about 0.5 minutes to about 2.6 minutes, about 0.5 minutes to about 2.5 minutes, about 0.5 minutes to about 2.4 minutes, about 0.5 minutes to about 2.3 minutes, about 0.5 minutes to about 2.2 minutes, about 0.5 minutes to about 2.1 minutes, about 0.5 minutes to about 2.0 minutes, about 0.5 minutes to about 1.9 minutes, about 0.5 minutes to about 1.8 minutes, about 0.5 minutes to about 1.7 minutes, about 0.5 minutes to about 1.6 minutes, about 0.5 minutes to about 1.5 minutes, about 0.5 minutes to about 1.4 minutes, about 0.5 minutes to about 1.3 minutes, about 0.5 minutes to about 1.2 minutes, about 0.5 minutes to about 1.1 minutes, about 0.5 minutes to about 1.0 minutes, a sub-range of any of the foregoing ranges, or any value or set of values within the foregoing ranges.

In a further aspect, the disclosed woven fabric has a wicking time, when determined in accordance with AATCC Test Method 197, from about 1.0 minutes to about 4.9 minutes, about 1.0 minutes to about 4.8 minutes, about 1.0 minutes to about 4.7 minutes, about 1.0 minutes to about 4.6 minutes, about 1.0 minutes to about 4.5 minutes, about 1.0 minutes to about 4.4 minutes, about 1.0 minutes to about 4.3 minutes, about 1.0 minutes to about 4.2 minutes, about 1.0 minutes to about 4.1 minutes, about 1.0 minutes to about 4.0 minutes, about 1.0 minutes to about 3.9 minutes, about 1.0 minutes to about 3.8 minutes, about 1.0 minutes to about 3.7 minutes, about 1.0 minutes to about 3.6 minutes, about 1.0 minutes to about 3.5 minutes, about 1.0 minutes to about 3.4 minutes, about 1.0 minutes to about 3.3 minutes, about 1.0 minutes to about 3.2 minutes, about 1.0 minutes to about 3.1 minutes, about 1.0 minutes to about 3.0 minutes, about 1.0 minutes to about 2.9 minutes, about 1.0 minutes to about 2.8 minutes, about 1.0 minutes to about 2.7 minutes, about 1.0 minutes to about 2.6 minutes, about 1.0 minutes to about 2.5 minutes, about 1.0 minutes to about 2.4 minutes, about 1.0 minutes to about 2.3 minutes, about 1.0 minutes to about 2.2 minutes, about 1.0 minutes to about 2.1 minutes, about 1.0 minutes to about 2.0 minutes, about 1.0 minutes to about 1.9 minutes, about 1.0 minutes to about 1.8 minutes, about 1.0 minutes to about 1.7 minutes, about 1.0 minutes to about 1.6 minutes, about 1.0 minutes to about 1.5 minutes, about 1.0 minutes to about 1.4 minutes, about 1.0 minutes to about 1.3 minutes, about 1.0 minutes to about 1.2 minutes, about 1.0 minutes to about 1.1 minutes, a sub-range of any of the foregoing ranges, or any value or set of values within the foregoing ranges.

In a further aspect, the disclosed woven fabric has a wicking time, when determined in accordance with AATCC Test Method 197, from about 1.5 minutes to about 4.9 minutes, about 1.5 minutes to about 4.8 minutes, about 1.5 minutes to about 4.7 minutes, about 1.5 minutes to about 4.6 minutes, about 1.5 minutes to about 4.5 minutes, about 1.5 minutes to about 4.4 minutes, about 1.5 minutes to about 4.3 minutes, about 1.5 minutes to about 4.2 minutes, about 1.5 minutes to about 4.1 minutes, about 1.5 minutes to about 4.0 minutes, about 1.5 minutes to about 3.9 minutes, about 1.5 minutes to about 3.8 minutes, about 1.5 minutes to about 3.7 minutes, about 1.5 minutes to about 3.6 minutes, about 1.5 minutes to about 3.5 minutes, about 1.5 minutes to about 3.4 minutes, about 1.5 minutes to about 3.3 minutes, about 1.5 minutes to about 3.2 minutes, about 1.5 minutes to about 3.1 minutes, about 1.5 minutes to about 3.0 minutes, about 1.5 minutes to about 2.9 minutes, about 1.5 minutes to about 2.8 minutes, about 1.5 minutes to about 2.7 minutes, about 1.5 minutes to about 2.6 minutes, about 1.5 minutes to about 2.5 minutes, about 1.5 minutes to about 2.4 minutes, about 1.5 minutes to about 2.3 minutes, about 1.5 minutes to about 2.2 minutes, about 1.5 minutes to about 2.1 minutes, about 1.5 minutes to about 2.0 minutes, about 1.5 minutes to about 1.9 minutes, about 1.5 minutes to about 1.8 minutes, about 1.5 minutes to about 1.7 minutes, about 1.5 minutes to about 1.6 minutes, a sub-range of any of the foregoing ranges, or any value or set of values within the foregoing ranges.

In a further aspect, the disclosed woven fabric has a wicking time, when determined in accordance with AATCC Test Method 197, from about 2.0 minutes to about 4.9 minutes, about 2.0 minutes to about 4.8 minutes, about 2.0 minutes to about 4.7 minutes, about 2.0 minutes to about 4.6 minutes, about 2.0 minutes to about 4.5 minutes, about 2.0 minutes to about 4.4 minutes, about 2.0 minutes to about 4.3 minutes, about 2.0 minutes to about 4.2 minutes, about 2.0 minutes to about 4.1 minutes, about 2.0 minutes to about 4.0 minutes, about 2.0 minutes to about 3.9 minutes, about 2.0 minutes to about 3.8 minutes, about 2.0 minutes to about 3.7 minutes, about 2.0 minutes to about 3.6 minutes, about 2.0 minutes to about 3.5 minutes, about 2.0 minutes to about 3.4 minutes, about 2.0 minutes to about 3.3 minutes, about 2.0 minutes to about 3.2 minutes, about 2.0 minutes to about 3.1 minutes, about 2.0 minutes to about 3.0 minutes, about 2.0 minutes to about 2.9 minutes, about 2.0 minutes to about 2.8 minutes, about 2.0 minutes to about 2.7 minutes, about 2.0 minutes to about 2.6 minutes, about 2.0 minutes to about 2.5 minutes, about 2.0 minutes to about 2.4 minutes, about 2.0 minutes to about 2.3 minutes, about 2.0 minutes to about 2.2 minutes, about 2.0 minutes to about 2.1 minutes, a sub-range of any of the foregoing ranges, or any value or set of values within the foregoing ranges.

In various aspects, the disclosed woven fabric has a wicking time, when determined in accordance with AATCC Test Method 197, at least about 100% faster than the wicking time for a reference fabric. In this context, it is to be understood that the reference fabric consists essentially of similar weight yarns and/or fibers present in a similar weight percent in the reference fabric, with a reference fabric weight that is ±10% of the disclosed woven fabric, and a similar weave pattern in the reference fabric to that of the disclosed woven fabric.

In a further aspect, the disclosed woven fabric has a wicking time, when determined in accordance with AATCC Test Method 197, that is at least about 50% faster than the wicking time for a reference fabric; at least about 55% faster than the wicking time for a reference fabric; at least about 60% faster than the wicking time for a reference fabric; at least about 65% faster than the wicking time for a reference fabric; at least about 70% faster than the wicking time for a reference fabric; at least about 75% faster than the wicking time for a reference fabric; at least about 80% faster than the wicking time for a reference fabric; at least about 85% faster than the wicking time for a reference fabric; at least about 90% faster than the wicking time for a reference fabric; at least about 95% faster than the wicking time for a reference fabric; at least about 100% faster than the wicking time for a reference fabric; at least about 110% faster than the wicking time for a reference fabric; at least about 115% faster than the wicking time for a reference fabric; at least about 120% faster than the wicking time for a reference fabric; at least about 125% faster than the wicking time for a reference fabric; at least about 130% faster than the wicking time for a reference fabric; at least about 135% faster than the wicking time for a reference fabric; at least about 140% faster than the wicking time for a reference fabric; at least about 145% faster than the wicking time for a reference fabric; at least about 150% faster than the wicking time for a reference fabric; at least about 155% faster than the wicking time for a reference fabric; at least about 160% faster than the wicking time for a reference fabric; at least about 165% faster than the wicking time for a reference fabric; at least about 170% faster than the wicking time for a reference fabric; at least about 175% faster than the wicking time for a reference fabric; at least about 180% faster than the wicking time for a reference fabric; at least about 185% faster than the wicking time for a reference fabric; at least about 190% faster than the wicking time for a reference fabric; at least about 195% faster than the wicking time for a reference fabric; or at least about 200% faster than the wicking time for a reference fabric.

In a further aspect, the disclosed woven fabric has a drying time, when determined in accordance with AATCC Test Method 79, of less than about 60 secs. In a still further aspect, the disclosed woven fabric has a drying time, when determined in accordance with AATCC Test Method 79, of about 8 secs to about 30 secs; about 10 secs to about 20 secs; about 10 secs to about 15 secs; or a sub-range of within any of the foregoing ranges.

In a further aspect, the disclosed woven fabric has a drying time, when determined in accordance with AATCC Test Method 79 that is at least about 100% faster than the drying time for a reference fabric. In this context, it is to be understood that the reference fabric consists essentially of similar weight yarns and/or fibers present in a similar weight percent in the reference fabric, with a reference fabric weight that is ±10% of the disclosed woven fabric, and a similar weave pattern in the reference fabric to that of the disclosed woven fabric. In a still further aspect, the disclosed woven fabric has a drying time, when determined in accordance with AATCC Test Method 79, that is faster than the drying time for the reference fabric by about 100%; about 200%; about 300%, about 400%; about 500%; or range encompassed by any combination of the foregoing values.

In a further aspect, the disclosed woven fabric has a drying rate, when determined in accordance with AATCC Test Method 201 that is less than about 2.5 ml/hr. In a still further aspect, the disclosed woven fabric has a drying rate, when determined in accordance with AATCC Test Method 201 that is about 0.5 ml/hr to about 1.5 ml/hr; about 0.5 ml/hr to about 1.0 ml/hr; about 0.5 ml/hr to about 0.7 ml/hr; or a sub-range within any of the foregoing ranges.

In a further aspect, the disclosed woven fabric has a UPF test value, when tested in accordance with AATCC Test Method 183, of at least about 1500 for dry evaluation and of at least about 3500 for wet evaluation. In a still further aspect, the disclosed woven fabric has a UPF test value, when tested in accordance with AATCC Test Method 183, of about 1500 to about 3000 for dry evaluation and of about 3500 to about 4500 for wet evaluation; about 1700 to about 2800 for dry evaluation and of about 3700 to about 4300 for wet evaluation; about 2000 to about 2700 for dry evaluation and of about 3800 to about 4200 for wet evaluation; or a sub-range within any of the foregoing ranges. In a yet further aspect, the disclosed woven fabric has a UPF test value, when tested in accordance with AATCC Test Method 183, of about 2500±10% for dry evaluation and of about 4100±10% for wet evaluation; about 2500±5% for dry evaluation and of about 4100±5% for wet evaluation; about 2500±3% for dry evaluation and of about 4100±3% for wet evaluation.

In an aspect, the first cooling composition can be present in a disclosed fabric in an amount of about 0.001 wt % to about 5 wt % based on the total weight of the fabric. In a further aspect, the first cooling composition can be present in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the second cooling composition can be present in a disclosed fabric in an amount of about 0.001 wt % to about 5 wt % based on the total weight of the fabric. In a further aspect, the second cooling composition can be present in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

The weight percent for a cooling composition in a disclosed fabric, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

In an aspect, the first cooling composition can be present in an amount of about 0.005 wt % to about 0.2 wt % based on the total weight of the woven fabric. In a further aspect, the first cooling composition can be present in an amount, based on the total weight of the woven fabric of about 0.005 wt %; about 0.006 wt %; about 0.007 wt %; about 0.008 wt %; about 0.009 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the first cooling composition can be present in an amount of about 0.1 wt % to about 2.0 wt % based on the total weight of the woven fabric. In a further aspect, the first cooling composition can be present in an amount, based on the total weight of the woven fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the first cooling composition can comprise, based on the total weight of the woven fabric, about 0.005 wt % to about 0.150 wt % of the first cooling material; about 0.0001 wt % to about 0.009 wt % of the first cooling compound; about 0.00005 wt % to about 0.002 wt % of the first cooling salt; or combinations thereof; and wherein the wt % is based on the total weight of the woven fabric. In a still further aspect, the first cooling composition can comprise, based on the total weight of the woven fabric, about 0.007 wt % to about 0.150 wt % of the first cooling material; about 0.0005 wt % to about 0.007 wt % of the first cooling compound; about 0.00005 wt % to about 0.0015 wt % of the first cooling salt; or combinations thereof; and wherein the wt % is based on the total weight of the woven fabric. In a yet further aspect, the first cooling composition can comprise, based on the total weight of the woven fabric, about 0.010 wt % to about 0.100 wt % of the first cooling material; about 0.0007 wt % to about 0.005 wt % of the first cooling compound; and about 0.00005 wt % to about 0.001 wt % of the first cooling salt; and wherein the wt % is based on the total weight of the woven fabric. In an even further aspect, the first cooling composition can comprise, based on the total weight of the woven fabric, about 0.010 wt % to about 0.090 wt % of the first cooling material; about 0.0010 wt % to about 0.0060 wt % of the first cooling compound; and about 0.0001 wt % to about 0.0003 wt % of the first cooling salt; and wherein the wt % is based on the total weight of the woven fabric.

In a further aspect, the first cooling composition can comprise, based on the total weight of the woven fabric, about 0.01 wt % to about 1.0 wt % of the first cooling material; about 0.01 wt % to about 1.5 wt % of the first cooling compound; about 0.001 wt % to about 0.20 wt % of the first cooling salt; or combinations thereof; and wherein the wt % is based on the total weight of the woven fabric. In a still further aspect, the first cooling composition can comprise, based on the total weight of the woven fabric, about 0.05 wt % to about 1.0 wt % of the first cooling material; about 0.05 wt % to about 1.0 wt % of the first cooling compound; about 0.005 wt % to about 0.15 wt % of the first cooling salt; or combinations thereof; and wherein the wt % is based on the total weight of the woven fabric. In a yet further aspect, the first cooling composition can comprise, based on the total weight of the woven fabric, about 0.1 wt % to about 0.75 wt % of the first cooling material; about 0.1 wt % to about 0.9 wt % of the first cooling compound; and about 0.01 wt % to about 0.15 wt % of the first cooling salt; and wherein the wt % is based on the total weight of the woven fabric. In an even further aspect, the first cooling composition can comprise, based on the total weight of the woven fabric, about 0.15 wt % to about 0.50 wt % of the first cooling material; about 0.15 wt % to about 0.75 wt % of the first cooling compound; and about 0.01 wt % to about 0.15 wt % of the first cooling salt; and wherein the wt % is based on the total weight of the woven fabric.

In a further aspect, the first cooling material can be present in the first cooling composition in an amount of about 0.005 wt % to about 0.150 wt %; and wherein the wt % is based on the total weight of the woven fabric. In a still further aspect, the first cooling material can be present in an amount of about 0.007 wt % to about 0.150 wt %; and wherein the wt % is based on the total weight of the woven fabric. In a yet further aspect, the first cooling material can be present in an amount of about 0.010 wt % to about 0.100 wt %; and wherein the wt % is based on the total weight of the woven fabric. In an even further aspect, the first cooling material can be present in an amount of about 0.010 wt % to about 0.090 wt %; and wherein the wt % is based on the total weight of the woven fabric.

In a further aspect, the first cooling material can be present in the first cooling composition, based on the total weight of the woven fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.01 wt % to about 1.0 wt %; and wherein the wt % is based on the total weight of the woven fabric. In a still further aspect, the first cooling material can be present in an amount of about 0.05 wt % to about 1.0 wt %; and wherein the wt % is based on the total weight of the woven fabric. In a yet further aspect, the first cooling material can be present in an amount of about 0.1 wt % to about 0.75 wt %; and wherein the wt % is based on the total weight of the woven fabric. In a still further aspect, the first cooling material can be present in an amount of about 0.15 wt % to about 0.50 wt % of the first cooling material; and wherein the wt % is based on the total weight of the woven fabric.

In a further aspect, the first cooling material can be present in the first cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the first cooling compound can be present in the first cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the woven fabric.

In a further aspect, the first cooling compound can be present in the first cooling composition, based on the total weight of the woven fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the first cooling compound can be present in the first cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the woven fabric.

In a further aspect, the first cooling compound can be present in the first cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the woven fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the woven fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the first cooling salt can be present in the first cooling composition, based on the total weight of the woven fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the first cooling salt can be present in the first cooling composition, based on the total weight of the woven fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %;

about 0.099 wt %; about 0.100 wt %; about 0.101 wt %; about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

In an aspect, the second cooling composition can be present in an amount of about 0.005 wt % to about 0.2 wt % based on the total weight of the woven fabric. In a further aspect, the second cooling composition can be present in an amount, based on the total weight of the woven fabric of about 0.005 wt %; about 0.006 wt %; about 0.007 wt %; about 0.008 wt %; about 0.009 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the second cooling composition can be present in an amount of about 0.1 wt % to about 2.0 wt % based on the total weight of the woven fabric. In a further aspect, the second cooling composition can be present in an amount, based on the total weight of the woven fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the second cooling composition can comprise, based on the total weight of the woven fabric, about 0.005 wt % to about 0.150 wt % of the second cooling material; about 0.0001 wt % to about 0.009 wt % of the second cooling compound; about 0.00005 wt % to about 0.002 wt % of the second cooling salt; or combinations thereof; and wherein the wt % is based on the total weight of the woven fabric. In a still further aspect, the second cooling composition can comprise, based on the total weight of the woven fabric, about 0.007 wt % to about 0.150 wt % of the second cooling material; about 0.0005 wt % to about 0.007 wt % of the second cooling compound; about 0.00005 wt % to about 0.0015 wt % of the second cooling salt; or combinations thereof; and wherein the wt % is based on the total weight of the woven fabric. In a yet further aspect, the second cooling composition can comprise, based on the total weight of the woven fabric, about 0.010 wt % to about 0.100 wt % of the second cooling material; about 0.0007 wt % to about 0.005 wt % of the second cooling compound; and about 0.00005 wt % to about 0.001 wt % of the second cooling salt; and wherein the wt % is based on the total weight of the woven fabric. In an even further aspect, the second cooling composition can comprise, based on the total weight of the woven fabric, about 0.010 wt % to about 0.090 wt % of the second cooling material; about 0.0010 wt % to about 0.0060 wt % of the second cooling compound; and about 0.0001 wt % to about 0.0003 wt % of the second cooling salt; and wherein the wt % is based on the total weight of the woven fabric.

In a further aspect, the second cooling composition can comprise, based on the total weight of the woven fabric, about 0.01 wt % to about 1.0 wt % of the second cooling material; about 0.01 wt % to about 1.5 wt % of the second cooling compound; about 0.001 wt % to about 0.20 wt % of the second cooling salt; or combinations thereof; and wherein the wt % is based on the total weight of the woven fabric. In a still further aspect, the second cooling composition can comprise, based on the total weight of the woven fabric, about 0.05 wt % to about 1.0 wt % of the second cooling material; about 0.05 wt % to about 1.0 wt % of the second cooling compound; about 0.005 wt % to about 0.15 wt % of the second cooling salt; or combinations thereof; and wherein the wt % is based on the total weight of the woven fabric. In a yet further aspect, the second cooling composition can comprise, based on the total weight of the woven fabric, about 0.1 wt % to about 0.75 wt % of the second cooling material; about 0.1 wt % to about 0.9 wt % of the second cooling compound; and about 0.01 wt % to about 0.15 wt % of the second cooling salt; and wherein the wt % is based on the total weight of the woven fabric. In an even further aspect, the second cooling composition can comprise, based on the total weight of the woven fabric, about 0.15 wt % to about 0.50 wt % of the second cooling material; about 0.15 wt % to about 0.75 wt % of the second cooling compound; and about 0.01 wt % to about 0.15 wt % of the second cooling salt; and wherein the wt % is based on the total weight of the woven fabric.

In a further aspect, the second cooling material can be present in the second cooling composition in an amount of about 0.005 wt % to about 0.150 wt %; and wherein the wt % is based on the total weight of the woven fabric. In a still further aspect, the second cooling material can be present in an amount of about 0.007 wt % to about 0.150 wt %; and wherein the wt % is based on the total weight of the woven fabric. In a yet further aspect, the second cooling material can be present in an amount of about 0.010 wt % to about 0.100 wt %; and wherein the wt % is based on the total weight of the woven fabric. In an even further aspect, the second cooling material can be present in an amount of about 0.010 wt % to about 0.090 wt %; and wherein the wt % is based on the total weight of the woven fabric.

In a further aspect, the second cooling material can be present in the second cooling composition, based on the total weight of the woven fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.01 wt % to about 1.0 wt %; and wherein the wt % is based on the total weight of the woven fabric. In a still further aspect, the second cooling material can be present in an amount of about 0.05 wt % to about 1.0 wt %; and wherein the wt % is based on the total weight of the woven fabric. In a yet further aspect, the second cooling material can be present in an amount of about 0.1 wt % to about 0.75 wt %; and wherein the wt % is based on the total weight of the woven fabric. In a still further aspect, the second cooling material can be present in an amount of about 0.15 wt % to about 0.50 wt % of the second cooling material; and wherein the wt % is based on the total weight of the woven fabric.

In a further aspect, the second cooling material can be present in the second cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the second cooling compound can be present in the second cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the woven fabric.

In a further aspect, the second cooling compound can be present in the second cooling composition, based on the total weight of the woven fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the second cooling compound can be present in the second cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the woven fabric.

In a further aspect, the second cooling compound can be present in the second cooling composition, based on the total weight of the woven fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the woven fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the woven fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the second cooling salt can be present in the second cooling composition, based on the total weight of the woven fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the second cooling salt can be present in the second cooling composition, based on the total weight of the woven fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.101 wt %;

about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

In various aspects, the disclosure relates to a knit fabric comprising a disclosed single-covered yarn, e.g., a jersey knit fabric.

In a further aspect, a disclosed single-covered yarn further comprises an elastic fiber in a weight percent amount based on the total weight of the disclosed knit fabric of about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, the disclosed knit fabric has a fabric weight of about 50 grams per square meter ("gsm") to about 300 gsm. In a still further aspect, the disclosed knit fabric has a fabric weight of about 100 gsm to about 250 gsm. In a yet further aspect, the disclosed knit fabric has a fabric weight of about 100 gsm to about 190 gsm. In an even further aspect, the disclosed knit fabric has a fabric weight of about 140 gsm to about 240 gsm.

In various aspects, the disclosed knit fabric has a fabric weight, in units of grams per square meter ("gsm"), of about 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300; a range utilizing any of the foregoing values; a sub-range with a range utilizing any of the foregoing values; or any set of values utilizing the foregoing values.

In a further aspect, the disclosed knit fabric has a Qmax value of about 0.15 to about 0.50 when determined in accordance with FTTS-FA-019 as specified by Committee of Conformity Assessment of Accreditation and Certification on Functional and Technical Textiles (Taiwan). In a still further aspect, the disclosed knit fabric has a Qmax value of about 0.17 to about 0.25 when determined in accordance with FTTS-FA-019 as specified by Committee of Conformity Assessment of Accreditation and Certification on Functional and Technical Textiles (Taiwan).

In a further aspect, the disclosed knit fabric has a Qmax value, when determined in accordance with FTTS-FA-019 as specified by Committee of Conformity Assessment of Accreditation and Certification on Functional and Technical Textiles (Taiwan), of about 0.10±10%; about 0.10±5%; about 0.10±3%; about 0.11±10%; about 0.11±5%; about 0.11±3%; about 0.12±10%; about 0.12±5%; about 0.12±3%; about 0.13±10%; about 0.13±5%; about 0.13±3%; about 0.14±10%; about 0.14±5%; about 0.14±3%; about 0.15±10%; about 0.15±5%; about 0.15±3%; about 0.16±10%; about 0.16±5%; about 0.16±3%; about 0.17±10%; about 0.17±5%; about 0.17±3%; about 0.18±10%; about 0.18±5%; about 0.18±3%; about 0.19±10%; about 0.19±5%; about 0.19±3%; about 0.20±10%; about 0.20±5%; about 0.20±3%; about 0.21±10%; about 0.21±5%; about 0.21±3%; about 0.22±10%; about 0.22±5%; about 0.22±3%; about 0.23±10%; about 0.23±5%; about 0.23±3%; about 0.24±10%; about 0.24±5%; about 0.24±3%; about 0.25±10%; about 0.25±5%; about 0.25±3%; about 0.26±10%; about 0.26±5%; about 0.26±3%; about 0.27±10%; about 0.27±5%; about 0.27±3%; about 0.28±10%; about 0.28±5%; about 0.28±3%; about 0.29±10%; about 0.29±5%; about 0.29±3%; about 0.30±10%; about 0.30±5%; about 0.30±3%; a range utilizing any of the foregoing values; a sub-range with a range utilizing any of the foregoing values; or any set of values utilizing the foregoing values.

In a further aspect, the disclosed knit fabric has a Qmax value, when determined in accordance with FTTS-FA-019 as specified by Committee of Conformity Assessment of Accreditation and Certification on Functional and Technical Textiles (Taiwan) that is about 20% greater than the Qmax value for a reference fabric. In this context, it is to be understood that the reference fabric consists essentially of similar weight yarns and/or fibers present in a similar weight percent in the reference fabric, with a reference fabric weight that is ±10% of the disclosed knit fabric, and a similar weave pattern in the reference fabric to that of the disclosed knit fabric. In a still further aspect, the disclosed knit fabric has a Qmax value, when determined in accordance with FTTS-FA-019 as specified by Committee of Conformity Assessment of Accreditation and Certification on Functional and Technical Textiles (Taiwan) that is about 25% greater than the Qmax value for a reference fabric. In a yet further aspect, the disclosed knit fabric has a Qmax value, when determined in accordance with FTTS-FA-019 as specified by Committee of Conformity Assessment of Accreditation and Certification on Functional and Technical Textiles (Taiwan), that is about 30% greater than the Qmax value for a reference fabric.

In a further aspect, the disclosed knit fabric has a thermal resistance, when measured in accordance with ISO 11092, of about 0.001 to about 0.010 K $M^2$/W. In a still further aspect, the disclosed knit fabric has a thermal resistance, when measured in accordance with ISO 11092, of about 0.002 to about 0.009 K $M^2$/W. In a yet further aspect, the disclosed knit fabric has a thermal resistance, when measured in accordance with ISO 11092, of about 0.003 to about 0.008 K $M^2$/W.

In a further aspect, the disclosed knit fabric has a thermal resistance, when measured in accordance with ISO 11092, in units of K $M^2$/W, of about 0.0010, 0.0011, 0.0012, 0.0013, 0.0014, 0.0015, 0.0016, 0.0017, 0.0018, 0.0019, 0.0020, 0.0021, 0.0022, 0.0023, 0.0024, 0.0025, 0.0026, 0.0027, 0.0028, 0.0029, 0.0030, 0.0031, 0.0032, 0.0033, 0.0034, 0.0035, 0.0036, 0.0037, 0.0038, 0.0039, 0.0040, 0.0041, 0.0042, 0.0043, 0.0044, 0.0045, 0.0046, 0.0047, 0.0048, 0.0049, 0.0050, 0.0051, 0.0052, 0.0053, 0.0054, 0.0055, 0.0056, 0.0057, 0.0058, 0.0059, 0.0060, 0.0061, 0.0062, 0.0063, 0.0064, 0.0065, 0.0066, 0.0067, 0.0068, 0.0069, 0.0070, 0.0071, 0.0072, 0.0073, 0.0074, 0.0075, 0.0076, 0.0077, 0.0078, 0.0079, 0.0080, 0.0081, 0.0082, 0.0083, 0.0084, 0.0085, 0.0086, 0.0087, 0.0088, 0.0089, 0.0090, 0.0091, 0.0092, 0.0093, 0.0094, 0.0095, 0.0096, 0.0097, 0.0098, 0.0099, 0.0100; a range utilizing any of the foregoing values; a sub-range with a range utilizing any of the foregoing values; or any set of values utilizing the foregoing values.

In a further aspect, the disclosed knit fabric has a thermal conductance, when measured in accordance with ISO 11092, of about 100 to about 1000 W/K $M^2$. In a still further aspect, the disclosed knit fabric has a thermal conductance, when measured in accordance with ISO 11092, of about 110 to about 550 W/K $M^2$. In a yet further aspect, the disclosed knit fabric has a thermal conductance, when measured in accordance with ISO 11092, of about 125 to about 333 W/K $M^2$.

In a further aspect, the disclosed knit fabric has a thermal conductance, when measured in accordance with ISO 11092, in units of W/K $M^2$, of about 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000; a range utilizing any of the foregoing values; a sub-range with a range utilizing any of the foregoing values; or any set of values utilizing the foregoing values.

In a further aspect, the disclosed knit fabric has a wicking time, when determined in accordance with AATCC Test Method 197, of less than about 5 minutes. In a still further aspect, the disclosed knit fabric has a wicking time, when determined in accordance with AATCC Test Method 197, of less than about 4.9 minutes, less than about 4.8 minutes, less than about 4.7 minutes, less than about 4.6 minutes, less than about 4.5 minutes, less than about 4.4 minutes, less than about 4.3 minutes, less than about 4.2 minutes, less than about 4.1 minutes, less than about 4.0 minutes, less than about 3.9 minutes, less than about 3.8 minutes, less than about 3.7 minutes, less than about 3.6 minutes, less than about 3.5 minutes, less than about 3.4 minutes, less than about 3.3 minutes, less than about 3.2 minutes, less than about 3.1 minutes, less than about 3.0 minutes, less than about 2.9 minutes, less than about 2.8 minutes, less than about 2.7 minutes, less than about 2.6 minutes, less than about 2.5 minutes, less than about 2.4 minutes, less than about 2.3 minutes, less than about 2.2 minutes, less than about 2.1 minutes, less than about 2.0 minutes, less than about 1.9 minutes, less than about 1.8 minutes, less than about 1.7 minutes, less than about 1.6 minutes, less than about 1.5 minutes, less than about 1.4 minutes, less than about 1.3 minutes, less than about 1.2 minutes, less than about 1.1 minutes, or less than about 1.0 minutes.

In a further aspect, the disclosed knit fabric has a wicking time, when determined in accordance with AATCC Test Method 197, from about 0.5 minutes to about 4.9 minutes, about 0.5 minutes to about 4.8 minutes, about 0.5 minutes to about 4.7 minutes, about 0.5 minutes to about 4.6 minutes, about 0.5 minutes to about 4.5 minutes, about 0.5 minutes to about 4.4 minutes, about 0.5 minutes to about 4.3 minutes, about 0.5 minutes to about 4.2 minutes, about 0.5 minutes to about 4.1 minutes, about 0.5 minutes to about 4.0 minutes, about 0.5 minutes to about 3.9 minutes, about 0.5 minutes to about 3.8 minutes, about 0.5 minutes to about 3.7 minutes, about 0.5 minutes to about 3.6 minutes, about 0.5 minutes to about 3.5 minutes, about 0.5 minutes to about 3.4 minutes, about 0.5 minutes to about 3.3 minutes, about 0.5 minutes to about 3.2 minutes, about 0.5 minutes to about 3.1 minutes, about 0.5 minutes to about 3.0 minutes, about 0.5 minutes to about 2.9 minutes, about 0.5 minutes to about 2.8 minutes, about 0.5 minutes to about 2.7 minutes, about 0.5 minutes to about 2.6 minutes, about 0.5 minutes to about 2.5 minutes, about 0.5 minutes to about 2.4 minutes, about 0.5 minutes to about 2.3 minutes, about 0.5 minutes to about 2.2 minutes, about 0.5 minutes to about 2.1 minutes, about 0.5 minutes to about 2.0 minutes, about 0.5 minutes to about 1.9 minutes, about 0.5 minutes to about 1.8 minutes, about 0.5 minutes to about 1.7 minutes, about 0.5 minutes to about 1.6 minutes, about 0.5 minutes to about 1.5 minutes, about 0.5 minutes to about 1.4 minutes, about 0.5 minutes to about 1.3 minutes, about 0.5 minutes to about 1.2 minutes, about 0.5 minutes to about 1.1 minutes, about 0.5 minutes to about 1.0 minutes, a sub-range of any of the foregoing ranges, or any value or set of values within the foregoing ranges.

In a further aspect, the disclosed knit fabric has a wicking time, when determined in accordance with AATCC Test Method 197, from about 1.0 minutes to about 4.9 minutes, about 1.0 minutes to about 4.8 minutes, about 1.0 minutes to about 4.7 minutes, about 1.0 minutes to about 4.6 minutes, about 1.0 minutes to about 4.5 minutes, about 1.0 minutes to about 4.4 minutes, about 1.0 minutes to about 4.3 minutes, about 1.0 minutes to about 4.2 minutes, about 1.0 minutes to about 4.1 minutes, about 1.0 minutes to about 4.0 minutes, about 1.0 minutes to about 3.9 minutes, about 1.0 minutes to about 3.8 minutes, about 1.0 minutes to about 3.7 minutes, about 1.0 minutes to about 3.6 minutes, about 1.0 minutes to about 3.5 minutes, about 1.0 minutes to about 3.4 minutes, about 1.0 minutes to about 3.3 minutes, about 1.0 minutes to about 3.2 minutes, about 1.0 minutes to about 3.1 minutes, about 1.0 minutes to about 3.0 minutes, about 1.0 minutes to about 2.9 minutes, about 1.0 minutes to about 2.8 minutes, about 1.0 minutes to about 2.7 minutes, about 1.0 minutes to about 2.6 minutes, about 1.0 minutes to about 2.5 minutes, about 1.0 minutes to about 2.4 minutes, about 1.0 minutes to about 2.3 minutes, about 1.0 minutes to about 2.2 minutes, about 1.0 minutes to about 2.1 minutes, about 1.0 minutes to about 2.0 minutes, about 1.0 minutes to about 1.9 minutes, about 1.0 minutes to about 1.8 minutes, about 1.0 minutes to about 1.7 minutes, about 1.0 minutes to about 1.6 minutes, about 1.0 minutes to about 1.5 minutes, about 1.0 minutes to about 1.4 minutes, about 1.0 minutes to about 1.3 minutes, about 1.0 minutes to about 1.2 minutes, about 1.0 minutes to about 1.1 minutes, a sub-range of any of the foregoing ranges, or any value or set of values within the foregoing ranges.

In a further aspect, the disclosed knit fabric has a wicking time, when determined in accordance with AATCC Test Method 197, from about 1.5 minutes to about 4.9 minutes, about 1.5 minutes to about 4.8 minutes, about 1.5 minutes to about 4.7 minutes, about 1.5 minutes to about 4.6 minutes, about 1.5 minutes to about 4.5 minutes, about 1.5 minutes to about 4.4 minutes, about 1.5 minutes to about 4.3 minutes, about 1.5 minutes to about 4.2 minutes, about 1.5 minutes to about 4.1 minutes, about 1.5 minutes to about 4.0 minutes, about 1.5 minutes to about 3.9 minutes, about 1.5 minutes to about 3.8 minutes, about 1.5 minutes to about 3.7 minutes, about 1.5 minutes to about 3.6 minutes, about 1.5 minutes to about 3.5 minutes, about 1.5 minutes to about 3.4 minutes, about 1.5 minutes to about 3.3 minutes, about 1.5 minutes to about 3.2 minutes, about 1.5 minutes to about 3.1 minutes, about 1.5 minutes to about 3.0 minutes, about 1.5 minutes to about 2.9 minutes, about 1.5 minutes to about 2.8 minutes, about 1.5 minutes to about 2.7 minutes, about 1.5 minutes to about 2.6 minutes, about 1.5 minutes to about 2.5 minutes, about 1.5 minutes to about 2.4 minutes, about 1.5 minutes to about 2.3 minutes, about 1.5 minutes to about 2.2 minutes, about 1.5 minutes to about 2.1 minutes, about 1.5 minutes to about 2.0 minutes, about 1.5 minutes to about 1.9 minutes, about 1.5 minutes to about 1.8 minutes, about 1.5 minutes to about 1.7 minutes, about 1.5 minutes to about 1.6 minutes, a sub-range of any of the foregoing ranges, or any value or set of values within the foregoing ranges.

In a further aspect, the disclosed knit fabric has a wicking time, when determined in accordance with AATCC Test Method 197, from about 2.0 minutes to about 4.9 minutes, about 2.0 minutes to about 4.8 minutes, about 2.0 minutes to about 4.7 minutes, about 2.0 minutes to about 4.6 minutes, about 2.0 minutes to about 4.5 minutes, about 2.0 minutes to about 4.4 minutes, about 2.0 minutes to about 4.3 minutes, about 2.0 minutes to about 4.2 minutes, about 2.0 minutes to about 4.1 minutes, about 2.0 minutes to about 4.0 minutes, about 2.0 minutes to about 3.9 minutes, about 2.0 minutes to about 3.8 minutes, about 2.0 minutes to about 3.7 minutes, about 2.0 minutes to about 3.6 minutes, about 2.0 minutes to about 3.5 minutes, about 2.0 minutes to about 3.4 minutes, about 2.0 minutes to about 3.3 minutes, about 2.0 minutes to about 3.2 minutes, about 2.0 minutes to about 3.1 minutes, about 2.0 minutes to about 3.0 minutes, about 2.0 minutes to about 2.9 minutes, about 2.0 minutes to about 2.8 minutes, about 2.0 minutes to about 2.7 minutes, about 2.0 minutes to about 2.6 minutes, about 2.0 minutes to about 2.5 minutes, about 2.0 minutes to about 2.4 minutes, about 2.0 minutes to about 2.3 minutes, about 2.0 minutes to about 2.2 minutes, about 2.0 minutes to about 2.1 minutes, a sub-range of any of the foregoing ranges, or any value or set of values within the foregoing ranges.

In various aspects, the disclosed knit fabric has a wicking time, when determined in accordance with AATCC Test Method 197, at least about 100% faster than the wicking time for a reference fabric. In this context, it is to be understood that the reference fabric consists essentially of similar weight yarns and/or fibers present in a similar weight percent in the reference fabric, with a reference fabric weight that is ±10% of the disclosed knit fabric, and a similar weave pattern in the reference fabric to that of the disclosed knit fabric.

In a further aspect, the disclosed knit fabric has a wicking time, when determined in accordance with AATCC Test Method 197, that is at least about 50% faster than the wicking time for a reference fabric; at least about 55% faster than the wicking time for a reference fabric; at least about 60% faster than the wicking time for a reference fabric; at least about 65% faster than the wicking time for a reference fabric; at least about 70% faster than the wicking time for a reference fabric; at least about 75% faster than the wicking time for a reference fabric; at least about 80% faster than the wicking time for a reference fabric; at least about 85% faster than the wicking time for a reference fabric; at least about 90% faster than the wicking time for a reference fabric; at least about 95% faster than the wicking time for a reference fabric; at least about 100% faster than the wicking time for a reference fabric; at least about 110% faster than the wicking time for a reference fabric; at least about 115% faster than the wicking time for a reference fabric; at least about 120% faster than the wicking time for a reference fabric; at least about 125% faster than the wicking time for a reference fabric; at least about 130% faster than the wicking time for a reference fabric; at least about 135% faster than the wicking time for a reference fabric; at least about 140% faster than the wicking time for a reference fabric; at least about 145% faster than the wicking time for a reference fabric; at least about 150% faster than the wicking time for a reference fabric; at least about 155% faster than the wicking time for a reference fabric; at least about 160% faster than the wicking time for a reference fabric; at least about 165% faster than the wicking time for a reference fabric; at least about 170% faster than the wicking time for a reference fabric; at least about 175% faster than the wicking time for a reference fabric; at least about 180% faster than the wicking time for a reference fabric; at least about 185% faster than the wicking time for a reference fabric; at least about 190% faster than the wicking time for a reference fabric; at least about 195% faster than the wicking time for a reference fabric; or at least about 200% faster than the wicking time for a reference fabric.

In a further aspect, the disclosed knit fabric has a drying time, when determined in accordance with AATCC Test Method 79, of less than about 60 secs. In a still further aspect, the disclosed knit fabric has a drying time, when determined in accordance with AATCC Test Method 79, of about 8 secs to about 30 secs; about 10 secs to about 20 secs; about 10 secs to about 15 secs; or a sub-range of within any of the foregoing ranges.

In a further aspect, the disclosed knit fabric has a drying time, when determined in accordance with AATCC Test Method 79 that is at least about 100% faster than the drying time for a reference fabric. In this context, it is to be understood that the reference fabric consists essentially of similar weight yarns and/or fibers present in a similar weight percent in the reference fabric, with a reference fabric weight that is ±10% of the disclosed knit fabric, and a similar weave pattern in the reference fabric to that of the disclosed knit fabric. In a still further aspect, the disclosed knit fabric has a drying time, when determined in accordance with AATCC Test Method 79, that is faster than the drying time for the reference fabric by about 100%; about 200%; about 300%, about 400%; about 500%; or range encompassed by any combination of the foregoing values.

In a further aspect, the disclosed knit fabric has a drying rate, when determined in accordance with AATCC Test Method 201 that is less than about 2.5 ml/hr. In a still further aspect, the disclosed knit fabric has a drying rate, when determined in accordance with AATCC Test Method 201 that is about 0.5 ml/hr to about 1.5 ml/hr; about 0.5 ml/hr to about 1.0 ml/hr; about 0.5 ml/hr to about 0.7 ml/hr; or a sub-range within any of the foregoing ranges.

In a further aspect, the disclosed knit fabric has a UPF test value, when tested in accordance with AATCC Test Method 183, of at least about 1500 for dry evaluation and of at least about 3500 for wet evaluation. In a still further aspect, the disclosed knit fabric has a UPF test value, when tested in accordance with AATCC Test Method 183, of about 1500 to about 3000 for dry evaluation and of about 3500 to about 4500 for wet evaluation; about 1700 to about 2800 for dry evaluation and of about 3700 to about 4300 for wet evaluation; about 2000 to about 2700 for dry evaluation and of about 3800 to about 4200 for wet evaluation; or a sub-range within any of the foregoing ranges. In a yet further aspect, the disclosed knit fabric has a UPF test value, when tested in accordance with AATCC Test Method 183, of about 2500±10% for dry evaluation and of about 4100±10% for wet evaluation; about 2500±5% for dry evaluation and of about 4100±5% for wet evaluation; about 2500±3% for dry evaluation and of about 4100±3% for wet evaluation.

In an aspect, the first cooling composition can be present in a disclosed knit fabric in an amount of about 0.001 wt % to about 5 wt % based on the total weight of the fabric. In a further aspect, the first cooling composition can be present in a disclosed knit fabric in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the second cooling composition can be present in a disclosed knit fabric in an amount of about 0.001 wt % to about 5 wt % based on the total weight of the fabric.

In a further aspect, the second cooling composition can be present in a disclosed knit fabric in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

The weight percent for a cooling composition in a disclosed fabric, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

In an aspect, the first cooling composition can be present in a disclosed knit fabric in an amount of about 0.005 wt % to about 0.2 wt % based on the total weight of the knit fabric. In a further aspect, the first cooling composition can be present in a disclosed knit fabric in an amount, based on the total weight of the knit fabric of about 0.005 wt %; about 0.006 wt %; about 0.007 wt %; about 0.008 wt %; about 0.009 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the first cooling composition can be present in a disclosed knit fabric in an amount of about 0.1 wt % to about 2.0 wt % based on the total weight of the knit fabric. In a further aspect, the first cooling composition can be present in a disclosed knit fabric in an amount, based on the total weight of the knit fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the first cooling composition can comprise, based on the total weight of the knit fabric, about 0.005 wt % to about 0.150 wt % of the first cooling material; about 0.0001 wt % to about 0.009 wt % of the first cooling compound; about 0.00005 wt % to about 0.002 wt % of the first cooling salt; or combinations thereof; and wherein the wt % is based on the total weight of the knit fabric. In a still further aspect, the first cooling composition can comprise, based on the total weight of the knit fabric, about 0.007 wt % to about 0.150 wt % of the first cooling material; about 0.0005 wt % to about 0.007 wt % of the first cooling compound; about 0.00005 wt % to about 0.0015 wt % of the first cooling salt; or combinations thereof; and wherein the wt % is based on the total weight of the knit fabric. In a yet further aspect, the first cooling composition can comprise, based on the total weight of the knit fabric, about 0.010 wt % to about 0.100 wt % of the first cooling material; about 0.0007 wt % to about 0.005 wt % of the first cooling compound; and about 0.00005 wt % to about 0.001 wt % of the first cooling salt; and wherein the wt % is based on the total weight of the knit fabric. In an even further aspect, the first cooling composition can comprise, based on the total weight of the knit fabric, about 0.010 wt % to about 0.090 wt % of the first cooling material; about 0.0010 wt % to about 0.0060 wt % of the first cooling compound; and about 0.0001 wt % to about 0.0003 wt % of the first cooling salt; and wherein the wt % is based on the total weight of the knit fabric.

In a further aspect, the first cooling composition can comprise, based on the total weight of the knit fabric, about 0.01 wt % to about 1.0 wt % of the first cooling material; about 0.01 wt % to about 1.5 wt % of the first cooling compound; about 0.001 wt % to about 0.20 wt % of the first cooling salt; or combinations thereof; and wherein the wt % is based on the total weight of the knit fabric. In a still further aspect, the first cooling composition can comprise, based on the total weight of the knit fabric, about 0.05 wt % to about 1.0 wt % of the first cooling material; about 0.05 wt % to about 1.0 wt % of the first cooling compound; about 0.005 wt % to about 0.15 wt % of the first cooling salt; or combinations thereof; and wherein the wt % is based on the total weight of the knit fabric. In a yet further aspect, the first cooling composition can comprise, based on the total weight of the knit fabric, about 0.1 wt % to about 0.75 wt % of the first cooling material; about 0.1 wt % to about 0.9 wt % of the first cooling compound; and about 0.01 wt % to about 0.15 wt % of the first cooling salt; and wherein the wt % is based on the total weight of the knit fabric. In an even further aspect, the first cooling composition can comprise, based on the total weight of the knit fabric, about 0.15 wt % to about 0.50 wt % of the first cooling material; about 0.15 wt % to about 0.75 wt % of the first cooling compound; and about 0.01 wt % to about 0.15 wt % of the first cooling salt; and wherein the wt % is based on the total weight of the knit fabric.

In a further aspect, the first cooling material can be present in the first cooling composition in an amount of about 0.005 wt % to about 0.150 wt %; and wherein the wt % is based on the total weight of the knit fabric. In a still further aspect, the first cooling material can be present in a disclosed knit fabric in an amount of about 0.007 wt % to about 0.150 wt %; and wherein the wt % is based on the total weight of the knit fabric. In a yet further aspect, the first cooling material can be present in a disclosed knit fabric in an amount of about 0.010 wt % to about 0.100 wt %; and wherein the wt % is based on the total weight of the knit fabric. In an even further aspect, the first cooling material can be present in a disclosed knit fabric in an amount of about 0.010 wt % to about 0.090 wt %; and wherein the wt % is based on the total weight of the knit fabric.

In a further aspect, the first cooling material can be present in the first cooling composition, based on the total weight of the knit fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the first cooling material can be present in the first cooling composition in an amount of about 0.01 wt % to about 1.0 wt %; and wherein the wt % is based on the total weight of the knit fabric. In a still further aspect, the first cooling material can be present in a disclosed knit fabric in an amount of about 0.05 wt % to about 1.0 wt %; and wherein the wt % is based on the total weight of the knit fabric. In a yet further aspect, the first cooling material can be present in a disclosed knit fabric in an amount of about 0.1 wt % to about 0.75 wt %; and wherein the wt % is based on the total weight of the knit fabric. In a still further aspect, the first cooling material can be present in a disclosed knit fabric in an amount of about 0.15 wt % to about 0.50 wt % of the first cooling material; and wherein the wt % is based on the total weight of the knit fabric.

In a further aspect, the first cooling material can be present in the first cooling composition, based on the total weight of the knit fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the first cooling compound can be present in the first cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the knit fabric.

In a further aspect, the first cooling compound can be present in the first cooling composition, based on the total weight of the knit fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the first cooling compound can be present in the first cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the knit fabric.

In a further aspect, the first cooling compound can be present in the first cooling composition, based on the total weight of the knit fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the knit fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the first cooling salt can be present in the first cooling composition, based on the total weight of the knit fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the first cooling salt can be present in the first cooling composition, based on the total weight of the knit fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the first cooling salt can be present in the first cooling composition, based on the total weight of the knit fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.101 wt %; about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

In an aspect, the second cooling composition can be present in a disclosed knit fabric in an amount of about 0.005 wt % to about 0.2 wt % based on the total weight of the knit fabric. In a further aspect, the second cooling composition can be present in a disclosed knit fabric in an amount, based on the total weight of the knit fabric of about 0.005 wt %; about 0.006 wt %; about 0.007 wt %; about 0.008 wt %; about 0.009 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; a range utilizing any of the foregoing values; a sub-range with a range utilizing any of the foregoing values; or any set of values utilizing the foregoing values.

In an aspect, the second cooling composition can be present in a disclosed knit fabric in an amount of about 0.1 wt % to about 2.0 wt % based on the total weight of the knit fabric. In a further aspect, the second cooling composition can be present in a disclosed knit fabric in an amount, based on the total weight of the knit fabric of about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the second cooling composition can comprise, based on the total weight of the knit fabric, about 0.005 wt % to about 0.150 wt % of the second cooling material; about 0.0001 wt % to about 0.009 wt % of the second cooling compound; about 0.00005 wt % to about 0.002 wt % of the second cooling salt; or combinations thereof; and wherein the wt % is based on the total weight of the knit fabric. In a still further aspect, the second cooling composition can comprise, based on the total weight of the knit fabric, about 0.007 wt % to about 0.150 wt % of the second cooling material; about 0.0005 wt % to about 0.007 wt % of the second cooling compound; about 0.00005 wt % to about 0.0015 wt % of the second cooling salt; or combinations thereof; and wherein the wt % is based on the total weight of the knit fabric. In a yet further aspect, the second cooling composition can comprise, based on the total weight of the knit fabric, about 0.010 wt % to about 0.100 wt % of the second cooling material; about 0.0007 wt % to about 0.005 wt % of the second cooling compound; and about 0.00005 wt % to about 0.001 wt % of the second cooling salt; and wherein the wt % is based on the total weight of the knit fabric. In an even further aspect, the second cooling composition can comprise, based on the total weight of the knit fabric, about 0.010 wt % to about 0.090 wt % of the second cooling material; about 0.0010 wt % to about 0.0060 wt % of the second cooling compound; and about 0.0001 wt % to about 0.0003 wt % of the second cooling salt; and wherein the wt % is based on the total weight of the knit fabric.

In a further aspect, the second cooling composition can comprise, based on the total weight of the knit fabric, about 0.01 wt % to about 1.0 wt % of the second cooling material; about 0.01 wt % to about 1.5 wt % of the second cooling compound; about 0.001 wt % to about 0.20 wt % of the second cooling salt; or combinations thereof; and wherein the wt % is based on the total weight of the knit fabric. In a still further aspect, the second cooling composition can comprise, based on the total weight of the knit fabric, about 0.05 wt % to about 1.0 wt % of the second cooling material; about 0.05 wt % to about 1.0 wt % of the second cooling compound; about 0.005 wt % to about 0.15 wt % of the second cooling salt; or combinations thereof; and wherein the wt % is based on the total weight of the knit fabric. In a yet further aspect, the second cooling composition can comprise, based on the total weight of the knit fabric, about 0.1 wt % to about 0.75 wt % of the second cooling material; about 0.1 wt % to about 0.9 wt % of the second cooling compound; and about 0.01 wt % to about 0.15 wt % of the second cooling salt; and wherein the wt % is based on the total weight of the knit fabric. In an even further aspect, the second cooling composition can comprise, based on the total weight of the knit fabric, about 0.15 wt % to about 0.50 wt % of the second cooling material; about 0.15 wt % to about 0.75 wt % of the second cooling compound; and about 0.01 wt % to about 0.15 wt % of the second cooling salt; and wherein the wt % is based on the total weight of the knit fabric.

In a further aspect, the second cooling material can be present in the second cooling composition in an amount of about 0.005 wt % to about 0.150 wt %; and wherein the wt % is based on the total weight of the knit fabric. In a still further aspect, the second cooling material can be present in a disclosed knit fabric in an amount of about 0.007 wt % to about 0.150 wt %; and wherein the wt % is based on the total weight of the knit fabric. In a yet further aspect, the second cooling material can be present in a disclosed knit fabric in an amount of about 0.010 wt % to about 0.100 wt %; and wherein the wt % is based on the total weight of the knit fabric. In an even further aspect, the second cooling material can be present in a disclosed knit fabric in an amount of about 0.010 wt % to about 0.090 wt %; and wherein the wt % is based on the total weight of the knit fabric.

In a further aspect, the second cooling material can be present in the second cooling composition, based on the total weight of the knit fabric, in an amount of about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; a range utilizing any of the foregoing values; a sub-range with a range utilizing any of the foregoing values; or any set of values utilizing the foregoing values.

In a further aspect, the second cooling material can be present in the second cooling composition in an amount of about 0.01 wt % to about 1.0 wt %; and wherein the wt % is based on the total weight of the knit fabric. In a still further aspect, the second cooling material can be present in a disclosed knit fabric in an amount of about 0.05 wt % to about 1.0 wt %; and wherein the wt % is based on the total weight of the knit fabric. In a yet further aspect, the second cooling material can be present in a disclosed knit fabric in an amount of about 0.1 wt % to about 0.75 wt %; and wherein the wt % is based on the total weight of the knit fabric. In a still further aspect, the second cooling material can be present in a disclosed knit fabric in an amount of about 0.15 wt % to about 0.50 wt % of the second cooling material; and wherein the wt % is based on the total weight of the knit fabric.

In a further aspect, the second cooling material can be present in the second cooling composition, based on the total weight of the knit fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.1 wt %; about 0.2 wt %; about 0.3 wt %; about 0.4 wt %; about 0.5 wt %; about 0.6 wt %; about 0.7 wt %; about 0.8 wt %; about 0.9 wt %; about 1.0 wt %, a sub-range with a range utilizing any of the foregoing values; or any set of values utilizing the foregoing values.

In a further aspect, the second cooling compound can be present in the second cooling composition in an amount of about 0.0001 wt % to about 0.009 wt %; about 0.0005 wt % to about 0.007 wt %; about 0.0007 wt % to about 0.005 wt %; about 0.0010 wt % to about 0.0060 wt %; and wherein the wt % is based on the total weight of the knit fabric.

In a further aspect, the second cooling compound can be present in the second cooling composition, based on the total weight of the knit fabric, in an amount of about 0.0001 wt %; about 0.0002 wt %; about 0.0003 wt %; about 0.0004 wt %; about 0.0005 wt %; about 0.0010 wt %; about 0.0015 wt %; about 0.0020 wt %; about 0.0025 wt %; about 0.0030 wt %; about 0.0035 wt %; about 0.0040 wt %; about 0.0045 wt %; about 0.0050 wt %; about 0.0055 wt %; about 0.0060 wt %; about 0.0065 wt %; about 0.0070 wt %; about 0.0075 wt %; about 0.0080 wt %; about 0.0085 wt %; about 0.0090 wt %; about 0.0090 wt %; a range utilizing any of the foregoing values; a sub-range with a range utilizing any of the foregoing values; or any set of values utilizing the foregoing values.

In a further aspect, the second cooling compound can be present in the second cooling composition in an amount of about 0.01 wt % to about 1.5 wt %; about 0.05 wt % to about 1.0 wt %; about 0.1 wt % to about 0.9 wt %; about 0.15 wt % to about 0.75 wt %; and wherein the wt % is based on the total weight of the knit fabric.

In a further aspect, the second cooling compound can be present in the second cooling composition, based on the total weight of the knit fabric, in an amount of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; about 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the knit fabric, of about 0.00005 wt % to about 0.002 wt %; about 0.00005 wt % to about 0.0015 wt %; about 0.00005 wt % to about 0.001 wt %; about 0.0001 wt % to about 0.0003 wt %; a range utilizing any of the foregoing values; a sub-range with a range utilizing any of the foregoing values; or any set of values utilizing the foregoing values.

In a further aspect, the second cooling salt can be present in the second cooling composition, based on the total weight of the knit fabric, of about 0.00005 wt %; about 0.00006 wt %; about 0.00007 wt %; about 0.00008 wt %; about 0.00009 wt %; about 0.00010 wt %; about 0.00011 wt %; about 0.00012 wt %; about 0.00013 wt %; about 0.00014 wt %; about 0.00015 wt %; about 0.00016 wt %; about 0.00017 wt %; about 0.00018 wt %; about 0.00019 wt %; about 0.00020 wt %; about 0.00021 wt %; about 0.00022 wt %; about 0.00023 wt %; about 0.00024 wt %; about 0.00025 wt %; about 0.00026 wt %; about 0.00027 wt %; about 0.00028 wt %; about 0.00029 wt %; about 0.00030 wt %; about 0.00031 wt %; about 0.00032 wt %; about 0.00033 wt %; about 0.00034 wt %; about 0.00035 wt %; about 0.00036 wt %; about 0.00037 wt %; about 0.00038 wt %; about 0.00039 wt %; about 0.00040 wt %; about 0.00041 wt %; about 0.00042 wt %; about 0.00043 wt %; about 0.00044 wt %; about 0.00045 wt %; about 0.00046 wt %; about 0.00047 wt %; about 0.00048 wt %; about 0.00049 wt %; about 0.00050 wt %; about 0.00051 wt %; about 0.00052 wt %; about 0.00053 wt %; about 0.00054 wt %; about 0.00055 wt %; about 0.00056 wt %; about 0.00057 wt %; about 0.00058 wt %; about 0.00059 wt %; about 0.00060 wt %; about 0.00061 wt %; about 0.00062 wt %; about 0.00063 wt %; about 0.00064 wt %; about 0.00065 wt %; about 0.00066 wt %; about 0.00067 wt %; about 0.00068 wt %; about 0.00069 wt %; about 0.00070 wt %; about 0.00071 wt %; about 0.00072 wt %; about 0.00073 wt %; about 0.00074 wt %; about 0.00075 wt %; about 0.00076 wt %; about 0.00077 wt %; about 0.00078 wt %; about 0.00079 wt %; about 0.00080 wt %; about 0.00081 wt %; about 0.00082 wt %; about 0.00083 wt %; about 0.00084 wt %; about 0.00085 wt %; about 0.00086 wt %; about 0.00087 wt %; about 0.00088 wt %; about 0.00089 wt %; about 0.00090 wt %; about 0.00091 wt %; about 0.00092 wt %; about 0.00093 wt %; about 0.00094 wt %; about 0.00095 wt %; about 0.00096 wt %; about 0.00097 wt %; about 0.00098 wt %; about 0.00099 wt %; about 0.0010 wt %; about 0.0011 wt %; about 0.0012 wt %; about 0.0013 wt %; about 0.0014 wt %; about 0.0015 wt %; about 0.0016 wt %; about 0.0017 wt %; about 0.0018 wt %; about 0.0019 wt %; about 0.0020 wt %; a range utilizing any of the foregoing values; a sub-range with a range utilizing any of the foregoing values; or any set of values utilizing the foregoing values.

In various aspects, the second cooling salt can be present in the second cooling composition, based on the total weight of the knit fabric, of about 0.001 wt % to about 0.20 wt %; about 0.005 wt % to about 0.15 wt %; about 0.01 wt % to about 0.15 wt %; about 0.01 wt % to about 0.15 wt %; or a sub-range within any of the foregoing ranges.

In a further aspect, the second cooling salt can be present in the second cooling composition, based on the total weight of the knit fabric, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; about 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.100 wt %; about 0.101 wt %; about 0.102 wt %; about 0.103 wt %; about 0.104 wt %; about 0.105 wt %; about 0.106 wt %; about 0.107 wt %; about 0.108 wt %; about 0.109 wt %; about 0.110 wt %; about 0.111 wt %; about 0.112 wt %; about 0.113 wt %; about 0.114 wt %; about 0.115 wt %; about 0.116 wt %; about 0.117 wt %; about 0.118 wt %; about 0.119 wt %; about 0.120 wt %; about 0.121 wt %; about 0.122 wt %; about 0.123 wt %; about 0.124 wt %; about 0.125 wt %; about 0.126 wt %; about 0.127 wt %; about 0.128 wt %; about 0.129 wt %; about 0.130 wt %; about 0.131 wt %; about 0.132 wt %; about 0.133 wt %; about 0.134 wt %; about 0.135 wt %; about 0.136 wt %; about 0.137 wt %; about 0.138 wt %; about 0.139 wt %; about 0.140 wt %; about 0.141 wt %; about 0.142 wt %; about 0.143 wt %; about 0.144 wt %; about 0.145 wt %; about 0.146 wt %; about 0.147 wt %; about 0.148 wt %; about 0.149 wt %; about 0.150 wt %; about 0.151 wt %; about 0.152 wt %; about 0.153 wt %; about 0.154 wt %; about 0.155 wt %; about 0.156 wt %; about 0.157 wt %; about 0.158 wt %; about 0.159 wt %; about 0.160 wt %; about 0.161 wt %; about 0.162 wt %; about 0.163 wt %; about 0.164 wt %; about 0.165 wt %; about 0.166 wt %; about 0.167 wt %; about 0.168 wt %; about 0.169 wt %; about 0.170 wt %; about 0.171 wt %; about 0.172 wt %; about 0.173 wt %; about 0.174 wt %; about 0.175 wt %; about 0.176 wt %; about 0.177 wt %; about 0.178 wt %; about 0.179 wt %; about 0.180 wt %; about 0.181 wt %; about 0.182 wt %; about 0.183 wt %; about 0.184 wt %; about 0.185 wt %; about 0.186 wt %; about 0.187 wt %; about 0.188 wt %; about 0.189 wt %; about 0.190 wt %; about 0.191 wt %; about 0.192 wt %; about 0.193 wt %; about 0.194 wt %; about 0.195 wt %; about 0.196 wt %; about 0.197 wt %; about 0.198 wt %; about 0.199 wt %; about 0.200 wt %; a range utilizing any of the foregoing values; a sub-range with a range utilizing any of the foregoing values; or any set of values utilizing the foregoing values.

F. Articles

In one aspect, the disclosure relates to articles comprising a disclosed composite fiber. In a further aspect, the article comprising the disclosed composite fiber is an article of clothing, including, but not limited to a pair of pants, a shirt, a jacket, a dress, a glove, a skirt, T-shirt, vest, poly top, pullover, male or female brief, underwear, long-john, night-wear such as pajamas, intimate apparel, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed composite fiber is an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed composite fiber an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed composite fiber a floor covering. In a yet further aspect, the article comprising the disclosed composite fiber is a tote bag, a furniture cover, a tarpaulin, or a vehicle seat.

In one aspect, the disclosure relates to articles comprising a disclosed double-covered yarn. In a further aspect, the article comprising the disclosed double-covered yarn is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed double-covered yarn an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed double-covered yarn an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed double-covered yarn a floor covering. In a yet further aspect, the article comprising the disclosed double-covered yarn is a tote bag, a furniture cover, a tarpaulin, or a vehicle seat.

In one aspect, the disclosure relates to articles comprising a disclosed fabric. In a further aspect, the article comprising the disclosed fabric is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, boxing glove, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed fabric an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed fabric an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed fabric a floor covering. In a yet further aspect, the article comprising the disclosed fabric is a tote bag, a furniture cover, a tarpaulin, or a vehicle seat.

G. Aspects

The following listing of exemplary aspects supports and is supported by the disclosure provided herein.

Aspect 1. A composite fiber comprising a core component and a sheath component, where: (a) the core component comprises a polyester polymer and a first cooling composition; and (b) the sheath component comprises a polyamide polymer and a second cooling composition; wherein the first cooling composition comprises a first cooling material, a first cooling compound, a first cooling salt, or combinations thereof; and wherein the second cooling composition comprises a second cooling material, a second cooling compound, and a second cooling salt.

Aspect 2. The composite fiber of Aspect 1, wherein the polyester polymer is a polyethylene terephthalate, a polytrimethylene terephthalate, or combinations thereof.

Aspect 3. The composite fiber of Aspect 2, wherein the polyester polymer is a polyethylene terephthalate.

Aspect 4. The composite fiber of any one of Aspect 1-3, wherein the first cooling composition is present in an amount of about 0.001 wt % to about 20 wt % based on the total weight of the polyester polymer and the cooling composition.

Aspect 5. The composite fiber of Aspect 4, wherein the first cooling composition is present in an amount of about 0.001 wt % to about 5 wt % based on the total weight of the polyester polymer and the cooling composition.

Aspect 6. The composite fiber of any one of Aspect 1-Aspect 5, wherein the first cooling composition comprises about 0.1 wt % to about 10 wt % of the first cooling material; about 0.02 wt % to about 3.00 wt % of the first cooling compound; about 0.001 wt % to about 3.00 wt % of the first cooling salt; or combinations thereof; and wherein the wt % is based on the total weight of the polyester polymer and the cooling composition.

Aspect 7. The composite fiber of Aspect 6, wherein the first cooling composition comprises about 0.2 wt % to about 2 wt % of the first cooling material; about 0.02 wt % to about 0.07 wt % of the first cooling compound; about 0.001 wt % to about 0.02 wt % of the first cooling salt; or combinations thereof.

Aspect 8. The composite fiber of Aspect 6, wherein the first cooling composition comprises about 0.5 wt % to about 1 wt % of the first cooling material; about 0.03 wt % to about 0.05 wt % of the first cooling compound; about 0.001 wt % to about 0.01 wt % of the first cooling salt; or combinations thereof.

Aspect 9. The composite fiber of Aspect 6, wherein the first cooling composition comprises about 0.2 wt % to about 2 wt % of the first cooling material; about 0.02 wt % to about 0.07 wt % of the first cooling compound; and about 0.001 wt % to about 0.02 wt % of the first cooling salt.

Aspect 10. The composite fiber of Aspect 6, wherein the first cooling composition comprises about 0.5 wt % to about 1 wt % of the first cooling material; about 0.03 wt % to about 0.05 wt % of the first cooling compound; and about 0.001 wt % to about 0.01 wt % of the first cooling salt; or combinations thereof.

Aspect 11. The composite fiber of any one of Aspect 1-Aspect 10, wherein the first cooling material is present in an amount of about 0.1 wt % to about 10 wt %; and wherein the wt % is based on the total weight of the polyester polymer and the cooling composition.

Aspect 12. The composite fiber of Aspect 11, wherein the first cooling material is present in an amount of about 0.1 wt % to about 5 wt %.

Aspect 13. The composite fiber of Aspect 11, wherein the first cooling material is present in an amount of about 0.1 wt % to about 3 wt %.

Aspect 14. The composite fiber of Aspect 11, wherein the first cooling material is present in an amount of about 0.1 wt % to about 2 wt %.

Aspect 15. The composite fiber of Aspect 11, wherein the first cooling material is present in an amount of about 0.4 wt % to about 1 wt %; and wherein the wt % is based on the total weight of the polyester polymer and the cooling composition.

Aspect 16. The composite fiber of Aspect 11, wherein the first cooling material is present in an amount of about 0.5 wt % to about 0.9 wt %; and wherein the wt % is based on the total weight of the polyester polymer and the cooling composition.

Aspect 17. The composite fiber of any one of Aspect 1-Aspect 16, wherein the first cooling material is a metal, a metal alloy, a metal oxide, a carbon material, a ceramic material, a mineral, or combinations thereof.

Aspect 18. The composite fiber of Aspect 17, wherein the mineral comprises dolomite, tourmaline, magnesia, periclase, magnesite, calcite, aragonite, or combinations thereof.

Aspect 19. The composite fiber of Aspect 17, wherein the mineral comprises calcium, magnesium, silicon, zirconium, titanium, or combinations thereof.

Aspect 20. The composite fiber of Aspect 19, wherein the mineral comprising calcium is calcite, aragonite, dolomite, tourmaline, or combinations thereof.

Aspect 21. The composite fiber of Aspect 19, wherein the mineral comprising magnesium is magnesia, periclase, magnesite, dolomite, tourmaline, or combinations thereof.

Aspect 22. The composite fiber of Aspect 19, wherein the mineral comprising zirconium is zircon, allendeite, baddeleyite, eudialyte, loranskite, menezesite, or combinations thereof.

Aspect 23. The composite fiber of Aspect 19, wherein the mineral comprising titanium is rutile, ilmenite, titanite, anatase, brookite, or combinations thereof.

Aspect 24. The composite fiber of Aspect 19, wherein the mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 25. The composite fiber of Aspect 19, wherein the mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 26. The composite fiber of Aspect 17, wherein the ceramic comprises aluminum oxide, aluminum titanate, zirconium oxide, aluminum nitride, silicon carbide, silicon nitride, silicon alumina nitride, or combinations thereof.

Aspect 27. The composite fiber of Aspect 17, wherein the metal comprises silver, aluminum, copper, or combinations thereof.

Aspect 28. The composite fiber of Aspect 27, wherein the metal comprises silver.

Aspect 29. The composite fiber of Aspect 27, wherein the metal comprises copper.

Aspect 30. The composite fiber of Aspect 27, wherein the metal comprises a mixture of copper and silver.

Aspect 31. The composite fiber of Aspect 17, wherein the metal alloy comprises silver, aluminum, copper, or combinations thereof.

Aspect 32. The composite fiber of Aspect 31, wherein the metal alloy comprises silver.

Aspect 33. The composite fiber of Aspect 31, wherein the metal alloy comprises copper.

Aspect 34. The composite fiber of Aspect 31, wherein the metal alloy comprises silver and copper.

Aspect 35. The composite fiber of Aspect 17, wherein the metal oxide comprises gold (II) oxide, gold (Ill) oxide, silver (I) oxide, silver (II) oxide, silver (I, Ill) oxide, magnesium oxide, iron (II) oxide, iron (Ill) oxide, copper (I) oxide, copper (II) oxide, or combinations thereof.

Aspect 36. The composite fiber of Aspect 35, wherein the metal oxide comprises silver (I) oxide, copper (I) oxide, copper (II) oxide, or combinations thereof.

Aspect 37. The composite fiber of Aspect 35, wherein the metal oxide comprises silver (I) oxide.

Aspect 38. The composite fiber of any one of Aspect 5-Aspect 34, wherein the first cooling material is a powder, a wire, a filament, a sheet, a particle, or combinations thereof.

Aspect 39. The composite fiber of Aspect 38, wherein the first cooling material is a particle, a powder, or combinations thereof.

Aspect 40. The composite fiber of Aspect 39, where the first cooling material is a particle.

Aspect 41. The composite fiber of Aspect 40, wherein the first cooling material is a nanoparticle, a microparticle, or combinations thereof.

Aspect 42. The composite fiber of Aspect 41, wherein the nanoparticle has a size of about 10 nm to about 100 nm.

Aspect 43. The composite fiber of Aspect 41, wherein the nanoparticle has a size of about 15 nm to about 50 nm.

Aspect 44. The composite fiber of Aspect 41, wherein the nanoparticle has a size of about 20 nm to about 40 nm.

Aspect 45. The composite fiber of Aspect 41, wherein the microparticle has a size of about 10 μm to about 200 μm.

Aspect 46. The composite fiber of Aspect 41, wherein the microparticle has a size of about 20 μm to about 100 μm.

Aspect 47. The composite fiber of Aspect 41, wherein the microparticle has a size of about 30 μm to about 90 μm.

Aspect 48. The composite fiber of Aspect 41, wherein the microparticle has a size of about 40 μm to about 80 μm.

Aspect 49. The composite fiber of Aspect 41, wherein the microparticle has a size of about 50 μm to about 70 μm.

Aspect 50. The composite fiber of any one of Aspect 1-Aspect 49, wherein the first cooling compound is present in an amount of about 0.02 wt % to about 3.0 wt % of the first cooling compound; and wherein the wt % is based on the total weight of the polyester polymer and the cooling composition.

Aspect 51. The composite fiber of any Aspect 50, wherein the first cooling compound is present in an amount of about 0.15 wt % to about 3.00 wt % of the first cooling compound.

Aspect 52. The composite fiber of any Aspect 50, wherein the first cooling compound is present in an amount of about 0.15 wt % to about 2.50 wt % of the first cooling compound.

Aspect 53. The composite fiber of any Aspect 50, wherein the first cooling compound is present in an amount of about 0.15 wt % to about 2.00 wt % of the first cooling compound.

Aspect 54. The composite fiber of any Aspect 50, wherein the first cooling compound is present in an amount of about 0.02 wt % to about 0.07 wt % of the first cooling compound.

Aspect 55. The composite fiber of any Aspect 50, wherein the first cooling compound is present in an amount of about 0.03 wt % to about 0.07 wt % of the first cooling compound.

Aspect 56. The composite fiber of any Aspect 50, wherein the first cooling compound is present in an amount of about 0.03 wt % to about 0.06 wt % of the first cooling compound.

Aspect 57. The composite fiber of any Aspect 50, wherein the first cooling compound is present in an amount of about 0.03 wt % to about 0.05 wt % of the first cooling compound.

Aspect 58. The composite fiber of any one of Aspect 1-Aspect 57, wherein the first cooling compound comprises a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 59. The composite fiber of Aspect 58, wherein the first cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof.

Aspect 60. The composite fiber of Aspect 59, wherein the first cooling compound comprises aluminum oxide, magnesium oxide, silicon dioxide, titanium dioxide, or combinations thereof.

Aspect 61. The composite fiber of Aspect 60, wherein the first cooling compound comprises titanium dioxide.

Aspect 62. The composite fiber of any one of Aspect 50-Aspect 61, wherein the first cooling compound is a powder, a wire, a filament, a sheet, a particle, or combinations thereof.

Aspect 63. The composite fiber of Aspect 62, wherein the first cooling compound is a powder, a particle, or combinations thereof.

Aspect 64. The composite fiber of Aspect 63, wherein the first cooling compound is a particle.

Aspect 65. The composite fiber of Aspect 64, wherein the particle is a nanoparticle, a microparticle, or combinations thereof.

Aspect 66. The composite fiber of Aspect 65, wherein the nanoparticle has a size of about 10 nm to about 100 nm.

Aspect 67. The composite fiber of Aspect 65, wherein the nanoparticle has a size of about 15 nm to about 50 nm.

Aspect 68. The composite fiber of Aspect 65, wherein the nanoparticle has a size of about 20 nm to about 40 nm.

Aspect 69. The composite fiber of Aspect 65, wherein the microparticle has a size of about 10 μm to about 200 μm.

Aspect 70. The composite fiber of Aspect 65, wherein the microparticle has a size of about 20 μm to about 100 μm.

Aspect 71. The composite fiber of Aspect 65, wherein the microparticle has a size of about 30 μm to about 90 μm.

Aspect 72. The composite fiber of Aspect 65, wherein the microparticle has a size of about 40 μm to about 80 μm.

Aspect 73. The composite fiber of Aspect 65, wherein the microparticle has a size of about 50 μm to about 70 μm.

Aspect 74. The composite fiber of any one of Aspect 1-Aspect 73, wherein the first cooling salt is present in an amount of about 0.001 wt % to about 5.00 wt % of the first cooling salt; and wherein the wt % is based on the total weight of the polyester polymer and the cooling composition.

Aspect 75. The composite fiber of Aspect 74, wherein the first cooling salt is present in an amount of about 1.00 wt % to about 4.00 wt % of the first cooling salt.

Aspect 76. The composite fiber of Aspect 74, wherein the first cooling salt is present in an amount of about 0.05 wt % to about 4.00 wt % of the first cooling salt.

Aspect 77. The composite fiber of Aspect 74, wherein the first cooling salt is present in an amount of about 0.05 wt % to about 3.00 wt % of the first cooling salt.

Aspect 78. The composite fiber of Aspect 74, wherein the first cooling salt is present in an amount of about 0.05 wt % to about 2.50 wt % of the first cooling salt.

Aspect 79. The composite fiber of Aspect 74, wherein the first cooling salt is present in an amount of about 0.15 wt % to about 3.00 wt % of the first cooling salt.

Aspect 80. The composite fiber of Aspect 74, wherein the first cooling salt is present in an amount of about 0.15 wt % to about 2.50 wt % of the first cooling salt.

Aspect 81. The composite fiber of Aspect 74, wherein the first cooling salt is present in an amount of about 0.001 wt % to about 0.01 wt % of the first cooling salt.

Aspect 82. The composite fiber of Aspect 74, wherein the first cooling salt is present in an amount of about 0.002 wt % to about 0.01 wt % of the first cooling salt.

Aspect 83. The composite fiber of any one of Aspect 1-Aspect 82, wherein the first cooling salt is a Group I salt, a Group II salt, a transition metal salt, or combinations thereof.

Aspect 84. The composite fiber of Aspect 83, wherein the first cooling salt is a Group I salt.

Aspect 85. The composite fiber of Aspect 83, wherein the first cooling salt is a Group II salt.

Aspect 86. The composite fiber of Aspect 83, wherein the first cooling salt is a transition metal salt Aspect 87. The composite fiber of Aspect 86, wherein the first cooling salt is a transition metal salt comprising a cation of silver, copper, titanium, iron, nickel, zinc, gold, or combinations thereof.

Aspect 88. The composite fiber of any one of Aspect 83-Aspect 87, wherein the first cooling salt comprises a Group I carbonate, a Group I halide, a Group I nitrate, a Group I sulfate, or combinations thereof.

Aspect 89. The composite fiber of any one of Aspect 83-Aspect 87, wherein the first cooling salt comprises a Group II carbonate, a Group II halide, a Group II nitrate, a Group II sulfate, or combinations thereof.

Aspect 90. The composite fiber of any one of Aspect 83-Aspect 87, wherein the first cooling salt comprises a transition metal carbonate, a transition metal halide, a transition metal nitrate, a transition metal sulfate, or combinations thereof.

Aspect 91. The composite fiber of any one of Aspect 83-Aspect 90, wherein the first cooling salt comprises a Group I carbonate, a Group II carbonate, transition metal carbonate, or combinations thereof.

Aspect 92. The composite fiber of Aspect 91, wherein the first cooling salt comprises calcium carbonate, magnesium carbonate, or combinations thereof.

Aspect 93. The composite fiber of any one of Aspect 74-Aspect 92, wherein the first cooling salt is a powder, a wire, a filament, a sheet, a particle, or combinations thereof.

Aspect 94. The composite fiber of Aspect 93, wherein the first cooling salt is a powder, a particle, or combinations thereof.

Aspect 95. The composite fiber of Aspect 94, wherein the first cooling salt is a particle.

Aspect 96. The composite fiber of Aspect 95, wherein the particle has a size of about 10 μm to about 1000 μm.

Aspect 97. The composite fiber of Aspect 95, wherein the particle has a size of about 30 μm to about 500 μm.

Aspect 98. The composite fiber of Aspect 94, wherein the particle is a nanoparticle, a microparticle, or combinations thereof.

Aspect 99. The composite fiber of Aspect 98, wherein the nanoparticle has a size of about 10 nm to about 100 nm.

Aspect 100. The composite fiber of Aspect 98, wherein the nanoparticle has a size of about 15 nm to about 50 nm.

Aspect 101. The composite fiber of Aspect 98, wherein the nanoparticle has a size of about 20 nm to about 40 nm.

Aspect 102. The composite fiber of Aspect 98, wherein the microparticle has a size of about 10 μm to about 200 μm.

Aspect 103. The composite fiber of Aspect 98, wherein the microparticle has a size of about 20 μm to about 100 μm.

Aspect 104. The composite fiber of Aspect 98, wherein the microparticle has a size of about 30 μm to about 90 μm.

Aspect 105. The composite fiber of Aspect 98, wherein the microparticle has a size of about 40 μm to about 80 μm.

Aspect 106. The composite fiber of Aspect 98, wherein the microparticle has a size of about 50 μm to about 70 μm.

Aspect 107. The composite fiber of any one of Aspect 1-Aspect 106, wherein the polyamide polymer is a nylon 6, nylon 4/6, nylon 6/6, nylon 6/10, nylon 6/12, nylon 11, nylon 12, or combinations thereof.

Aspect 108. The composite fiber of Aspect 107, wherein the polyamide polymer is a nylon 6/6.

Aspect 109. The composite fiber of any one of Aspect 1-Aspect 108, wherein the second cooling composition is present in an amount of about 1 wt % to about 20 wt % based on the total weight of the polyester polymer and the cooling composition.

Aspect 110. The composite fiber of any one of Aspect 1-Aspect 109, wherein the second cooling composition comprises about 1 wt % to about 10 wt % of the second cooling material; about 1 wt % to about 15 wt % of the second cooling compound; about 0.1 wt % to about 5 wt % of the second cooling salt; or combinations thereof; and wherein the wt % is based on the total weight of the polyester polymer and the cooling composition.

Aspect 111. The composite fiber of Aspect 110, wherein the second cooling composition comprises about 4 wt % to about 8 wt % of the second cooling material; about 5 wt % to about 10 wt % of the second cooling compound; about 0.3 wt % to about 2.5 wt % of the second cooling salt; or combinations thereof.

Aspect 112. The composite fiber of Aspect 110, wherein the second cooling composition comprises about 1 wt % to about 10 wt % of the second cooling material; about 1 wt % to about 15 wt % of the second cooling compound; about 0.1 wt % to about 5 wt % of the second cooling salt; or combinations thereof.

Aspect 113. The composite fiber of Aspect 110, wherein the second cooling composition comprises about 4 wt % to about 8 wt % of the second cooling material; about 5 wt % to about 10 wt % of the second cooling compound; about 0.3 wt % to about 2.5 wt % of the second cooling salt; or combinations thereof.

Aspect 114. The composite fiber of any one of Aspect 1-Aspect 113, wherein the second cooling material is present in an amount of about 1 wt % to about 10 wt %; and wherein the wt % is based on the total weight of the polyester polymer and the cooling composition.

Aspect 115. The composite fiber of Aspect 114, wherein the second cooling material is present in an amount of about 4 wt % to about 8 wt %.

Aspect 116. The composite fiber of Aspect 114, wherein the second cooling material is present in an amount of about 5 wt % to about 7 wt %.

Aspect 117. The composite fiber of any one of Aspect 1-Aspect 116, wherein the second cooling material is a metal, a metal alloy, a metal oxide, a carbon material, a ceramic material, a mineral, or combinations thereof.

Aspect 118. The composite fiber of Aspect 117, wherein the mineral comprises dolomite, tourmaline, magnesia, periclase, magnesite, calcite, aragonite, or combinations thereof.

Aspect 119. The composite fiber of Aspect 117, wherein the mineral comprises calcium, magnesium, silicon, zirconium, titanium, or combinations thereof.

Aspect 120. The composite fiber of Aspect 119, wherein the mineral comprising calcium is calcite, aragonite, dolomite, tourmaline, or combinations thereof.

Aspect 121. The composite fiber of Aspect 119, wherein the mineral comprising magnesium is magnesia, periclase, magnesite, dolomite, tourmaline, or combinations thereof.

Aspect 122. The composite fiber of Aspect 118, wherein the mineral comprising zirconium is zircon, allendeite, baddeleyite, eudialyte, loranskite, menezesite, or combinations thereof.

Aspect 123. The composite fiber of Aspect 118, wherein the mineral comprising titanium is rutile, ilmenite, titanite, anatase, brookite, or combinations thereof.

Aspect 124. The composite fiber of Aspect 118, wherein the mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 125. The composite fiber of Aspect 118, wherein the mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 126. The composite fiber of Aspect 117, wherein the ceramic comprises aluminum oxide, aluminum titanate, magnesium oxide, zirconium oxide, aluminum nitride, silicon carbide, silicon nitride, silicon alumina nitride, or combinations thereof.

Aspect 127. The composite fiber of Aspect 117, wherein the metal comprises silver, aluminum, copper, or combinations thereof.

Aspect 128. The composite fiber of Aspect 127, wherein the metal comprises silver.

Aspect 129. The composite fiber of Aspect 127, wherein the metal comprises copper.

Aspect 130. The composite fiber of Aspect 127, wherein the metal comprises a mixture of silver and copper.

Aspect 131. The composite fiber of Aspect 117, wherein the metal alloy comprises silver, aluminum, copper, or combinations thereof.

Aspect 132. The composite fiber of Aspect 131, wherein the metal alloy comprises silver.

Aspect 133. The composite fiber of Aspect 131, wherein the metal alloy comprises copper.

Aspect 134. The composite fiber of Aspect 131, wherein the metal alloy comprises silver and copper.

Aspect 135. The composite fiber of Aspect 117, wherein the metal oxide comprises gold (II) oxide, gold (Ill) oxide, silver (I) oxide, silver (II) oxide, silver (I, Ill) oxide, magnesium oxide, iron (II) oxide, iron (Ill) oxide, copper (I) oxide, copper (II) oxide, or combinations thereof.

Aspect 136. The composite fiber of Aspect 135, wherein the metal oxide comprises silver (I) oxide, copper (I) oxide, copper (II) oxide, or combinations thereof.

Aspect 137. The composite fiber of Aspect 135, wherein the metal oxide comprises silver (I) oxide.

Aspect 138. The composite fiber of any one of Aspect 109-Aspect 137, wherein the second cooling material is a powder, a wire, a filament, a sheet, a particle, or combinations thereof.

Aspect 139. The composite fiber of Aspect 138, wherein the second cooling material is a particle, a powder, or combinations thereof.

Aspect 140. The composite fiber of Aspect 139, where the second cooling material is a particle.

Aspect 141. The composite fiber of Aspect 140, wherein the particle is a nanoparticle, a microparticle, or combinations thereof.

Aspect 142. The composite fiber of Aspect 141, wherein the nanoparticle has a size of about 10 nm to about 100 nm.

Aspect 143. The composite fiber of Aspect 141, wherein the nanoparticle has a size of about 15 nm to about 50 nm.

Aspect 144. The composite fiber of Aspect 141, wherein the nanoparticle has a size of about 20 nm to about 40 nm.

Aspect 145. The composite fiber of Aspect 141, wherein the microparticle has a size of about 10 μm to about 200 μm.

Aspect 146. The composite fiber of Aspect 141, wherein the microparticle has a size of about 20 μm to about 100 μm.

Aspect 147. The composite fiber of Aspect 141, wherein the microparticle has a size of about 30 μm to about 90 μm.

Aspect 148. The composite fiber of Aspect 141, wherein the microparticle has a size of about 40 μm to about 80 μm.

Aspect 149. The composite fiber of Aspect 141, wherein the microparticle has a size of about 50 μm to about 70 μm.

Aspect 150. The composite fiber of any one of Aspect 1-Aspect 149, wherein the second cooling compound is present in an amount of about 1 wt % to about 15 wt % of the second cooling compound; and wherein the wt % is based on the total weight of the polyester polymer and the cooling composition.

Aspect 151. The composite fiber of any Aspect 142, wherein the second cooling compound is present in an amount of about 0.15 wt % to about 3.00 wt % of the first cooling compound.

Aspect 152. The composite fiber of any Aspect 142, wherein the second cooling compound is present in an amount of about 0.15 wt % to about 2.50 wt % of the first cooling compound.

Aspect 153. The composite fiber of any Aspect 142, wherein the second cooling compound is present in an amount of about 0.15 wt % to about 2.00 wt % of the first cooling compound.

Aspect 154. The composite fiber of any Aspect 142, wherein the second cooling compound is present in an amount of about 4 wt % to about 12 wt % of the second cooling compound.

Aspect 155. The composite fiber of any Aspect 142, wherein the second cooling compound is present in an amount of about 5 wt % to about 11 wt % of the second cooling compound.

Aspect 156. The composite fiber of any Aspect 142, wherein the second cooling compound is present in an amount of about 6 wt % to about 10 wt % of the second cooling compound.

Aspect 157. The composite fiber of any one of Aspect 1-Aspect 156, wherein the second cooling compound comprises a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 158. The composite fiber of Aspect 157, wherein the second cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof.

Aspect 159. The composite fiber of Aspect 158, wherein the second cooling compound comprises aluminum oxide, silicon dioxide, titanium dioxide, or combinations thereof.

Aspect 160. The composite fiber of Aspect 159, wherein the second cooling compound comprises titanium dioxide.

Aspect 161. The composite fiber of any one of Aspect 150-Aspect 160, wherein the first cooling compound is a powder, a wire, a filament, a sheet, a particle, or combinations thereof.

Aspect 162. The composite fiber of Aspect 161, wherein the first cooling compound is a powder, a particle, or combinations thereof.

Aspect 163. The composite fiber of Aspect 162, wherein the first cooling compound is a particle.

Aspect 164. The composite fiber of Aspect 163, wherein the particle is a nanoparticle, a microparticle, or combinations thereof.

Aspect 165. The composite fiber of Aspect 164, wherein the nanoparticle has a size of about 10 nm to about 100 nm.

Aspect 166. The composite fiber of Aspect 164, wherein the nanoparticle has a size of about 15 nm to about 50 nm.

Aspect 167. The composite fiber of Aspect 164, wherein the nanoparticle has a size of about 20 nm to about 40 nm.

Aspect 168. The composite fiber of Aspect 164, wherein the microparticle has a size of about 10 μm to about 200 μm.

Aspect 169. The composite fiber of Aspect 164, wherein the microparticle has a size of about 20 μm to about 100 μm.

Aspect 170. The composite fiber of Aspect 164, wherein the microparticle has a size of about 30 μm to about 90 μm.

Aspect 171. The composite fiber of Aspect 164, wherein the microparticle has a size of about 40 μm to about 80 μm.

Aspect 172. The composite fiber of Aspect 164, wherein the microparticle has a size of about 50 μm to about 70 μm.

Aspect 173. The composite fiber of any one of Aspect 1-Aspect 172, wherein the second cooling salt is present in an amount of about 0.1 wt % to about 5 wt % of the second cooling salt; and wherein the wt % is based on the total weight of the polyester polymer and the cooling composition.

Aspect 174. The composite fiber of Aspect 173, wherein the second cooling salt is present in an amount of about 1.00 wt % to about 4.00 wt % of the first cooling salt.

Aspect 175. The composite fiber of Aspect 173, wherein the second cooling salt is present in an amount of about 0.05 wt % to about 4.00 wt % of the first cooling salt.

Aspect 176. The composite fiber of Aspect 173, wherein the second cooling salt is present in an amount of about 0.05 wt % to about 3.00 wt % of the first cooling salt.

Aspect 177. The composite fiber of Aspect 173, wherein the second cooling salt is present in an amount of about 0.05 wt % to about 2.50 wt % of the first cooling salt.

Aspect 178. The composite fiber of Aspect 173, wherein the second cooling salt is present in an amount of about 0.15 wt % to about 3.00 wt % of the first cooling salt.

Aspect 179. The composite fiber of Aspect 173, wherein the second cooling salt is present in an amount of about 0.15 wt % to about 2.50 wt % of the first cooling salt.

Aspect 180. The composite fiber of Aspect 173, wherein the second cooling salt is present in an amount of about 0.3 wt % to about 2.5 wt % of the second cooling salt.

Aspect 181. The composite fiber of Aspect 173, wherein the second cooling salt is present in an amount of about 0.5 wt % to about 2 wt % of the second cooling salt.

Aspect 182. The composite fiber of any one of Aspect 1-Aspect 181, wherein the second cooling salt is a Group I salt, a Group II salt, a transition metal salt, or combinations thereof.

Aspect 183. The composite fiber of Aspect 182, wherein the second cooling salt is a Group I salt.

Aspect 184. The composite fiber of Aspect 182, wherein the second cooling salt is a Group II salt.

Aspect 185. The composite fiber of Aspect 182, wherein the second cooling salt is a transition metal salt.

Aspect 186. The composite fiber of Aspect 185, wherein the second cooling salt is a transition metal salt comprising a cation of silver, copper, titanium, iron, nickel, zinc, gold, or combinations thereof.

Aspect 187. The composite fiber of any one of Aspect 182-Aspect 186, wherein the second cooling salt comprises a Group I carbonate, a Group I halide, a Group I nitrate, a Group I sulfate, or combinations thereof.

Aspect 188. The composite fiber of any one of Aspect 182-Aspect 186, wherein the second cooling salt comprises a Group II carbonate, a Group II halide, a Group II nitrate, a Group II sulfate, or combinations thereof.

Aspect 189. The composite fiber of any one of Aspect 182-Aspect 186, wherein the second cooling salt comprises a transition metal carbonate, a transition metal halide, a transition metal nitrate, a transition metal sulfate, or combinations thereof.

Aspect 190. The composite fiber of any one of Aspect 182-Aspect 186, wherein the second cooling salt comprises a Group I carbonate, a Group II carbonate, transition metal carbonate, or combinations thereof.

Aspect 191. The composite fiber of Aspect 190, wherein the second cooling salt comprises calcium carbonate, magnesium carbonate, or combinations thereof.

Aspect 192. The composite fiber of any one of Aspect 173-Aspect 191, wherein the second cooling salt is a powder, a wire, a filament, a sheet, a particle, or combinations thereof.

Aspect 193. The composite fiber of Aspect 192, wherein the second cooling salt is a powder, a particle, or combinations thereof.

Aspect 194. The composite fiber of Aspect 193, wherein the second cooling salt is a particle.

Aspect 195. The composite fiber of Aspect 194, wherein the particle has a size of about 10 μm to about 1000 μm.

Aspect 196. The composite fiber of Aspect 194, wherein the particle has a size of about 30 μm to about 500 μm.

Aspect 197. The composite fiber of Aspect 194, wherein the particle is a nanoparticle, a microparticle, or combinations thereof.

Aspect 198. The composite fiber of Aspect 197, wherein the nanoparticle has a size of about 10 nm to about 100 nm.

Aspect 199. The composite fiber of Aspect 197, wherein the nanoparticle has a size of about 15 nm to about 50 nm.

Aspect 200. The composite fiber of Aspect 197, wherein the nanoparticle has a size of about 20 nm to about 40 nm.

Aspect 201. The composite fiber of Aspect 197, wherein the microparticle has a size of about 10 μm to about 200 μm.

Aspect 202. The composite fiber of Aspect 197, wherein the microparticle has a size of about 20 μm to about 100 μm.

Aspect 203. The composite fiber of Aspect 197, wherein the microparticle has a size of about 30 μm to about 90 μm.

Aspect 204. The composite fiber of Aspect 197, wherein the microparticle has a size of about 40 μm to about 80 μm.

Aspect 205. The composite fiber of Aspect 197, wherein the microparticle has a size of about 50 μm to about 70 μm.

Aspect 206. The composite fiber of any one of Aspect 1-Aspect 205, wherein the composite fiber has a weight of about 70 d/30f to about 80 d/40f.

Aspect 207. The composite fiber of Aspect 182, wherein the composite fiber has a weight of about 75 d/36f±10%.

Aspect 208. The composite fiber of Aspect 182, wherein the composite fiber has a weight of about 75 d/36f±5%.

Aspect 209. The composite fiber of Aspect 182, wherein the composite fiber has a weight of about 75 d/36f±3%.

Aspect 210. The composite fiber of any one of Aspect 1-Aspect 209, wherein the composite fiber comprises about 30 wt % to about 60 wt % of the polyester and the first cooling composition, and about 30 wt % to about 60 wt % of the polyamide and the second cooling composition.

Aspect 211. The composite fiber of Aspect 210, wherein the composite fiber comprises about 45 wt % to about 55 wt % of the polyester and the first cooling composition, and about 45 wt % to about 55 wt % of the polyamide and the second cooling composition.

Aspect 212. The composite fiber of Aspect 210, wherein the composite fiber comprises about 48 wt % to about 52 wt % of the polyester and the first cooling composition, and about 48 wt % to about 52 wt % of the polyamide and the second cooling composition.

Aspect 213. The composite fiber of Aspect 210, wherein the composite fiber comprises about 50 wt % of the polyester and the first cooling composition, and about 50 wt % of the polyamide and the second cooling composition.

Aspect 214. A composite fiber comprising a core component and a sheath component, where: (a) the core component comprises a polyester polymer and a first cooling composition; and (b) the sheath component comprises a polyamide polymer and a second cooling composition; wherein the first cooling composition comprises a first cooling component present in an amount of about 1 wt % to about 20 wt %; and wherein the second cooling composition comprises a second cooling component present in an amount of about 1 wt % to about 20 wt %.

Aspect 215. The composite fiber of Aspect 214, wherein the first cooling component comprises Ag, Al, Ca, Cu, Fe, K, Mg, Si, Ti, or combinations thereof.

Aspect 216. The composite fiber of Aspect 215, wherein the Ag is present in an amount of about 0.1 wt % to about 10 wt % when determined by elemental analysis.

Aspect 217. The composite fiber of Aspect 215, wherein the Al is present in an amount of about 0.1 wt % to about 1 wt % when determined by elemental analysis.

Aspect 218. The composite fiber of Aspect 215, wherein the Ca is present in an amount of about 0.1 wt % to about 3 wt % when determined by elemental analysis.

Aspect 219. The composite fiber of Aspect 215, wherein the Cu is present in an amount of about 0.1 wt % to about 10 wt % when determined by elemental analysis.

Aspect 220. The composite fiber of Aspect 215, wherein the Fe is present in an amount of about 0.05 wt % to about 3 wt % when determined by elemental analysis.

Aspect 221. The composite fiber of Aspect 215, wherein the K is present in an amount of about 0.1 wt % to about 3 wt % when determined by elemental analysis.

Aspect 222. The composite fiber of Aspect 215, wherein the Mg is present in an amount of about 0.01 wt % to about 1.0 wt % when determined by elemental analysis.

Aspect 223. The composite fiber of Aspect 215, wherein the Si is present in an amount of about 0.1 wt % to about 3 wt % when determined by elemental analysis.

Aspect 224. The composite fiber of Aspect 215, wherein the Ti is present in an amount of about 0.01 wt % to about 1.0 wt % when determined by elemental analysis.

Aspect 225. The composite fiber of any one of Aspect 214-Aspect 224, wherein the first cooling component comprises a first mineral, a first carbide, a first nitride, a first oxide, a first salt, or combinations thereof.

Aspect 226. The composite fiber of Aspect 225, wherein the first mineral comprises dolomite, tourmaline, zircon, magnesia, magnesite, calcite, aragonite, zircon, allendeite, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof.

Aspect 227. The composite fiber of Aspect 226, wherein the first mineral comprises dolomite, tourmaline, zircon, magnesia, magnesite, calcite, aragonite, quartz, or combinations thereof.

Aspect 228. The composite fiber of Aspect 225, wherein the first carbide comprises silicon carbide.

Aspect 229. The composite fiber of Aspect 225, wherein the first nitride comprises aluminum nitride, silicon nitride, silicon alumina nitride, or combinations thereof.

Aspect 230. The composite fiber of Aspect 225, wherein the first oxide comprises aluminum oxide, copper (I) oxide, copper (II) oxide, iron (II) oxide, magnesium oxide, silicon dioxide, silver oxide, titanium oxide, titanium dioxide, titanium trioxide, zirconium oxide, or combinations thereof.

Aspect 231. The composite fiber of Aspect 230, wherein the oxide comprises aluminum oxide, magnesium oxide, silicon dioxide, titanium dioxide, or combinations thereof.

Aspect 232. The composite fiber of Aspect 225, wherein the first salt is a Group I salt, a Group II salt, a transition metal salt, or combinations thereof.

Aspect 233. The composite fiber of Aspect 232, wherein the first salt is a Group I salt.

Aspect 234. The composite fiber of Aspect 232, wherein the first salt is a Group II salt.

Aspect 235. The composite fiber of Aspect 232, wherein the first salt is a transition metal salt Aspect 236. The composite fiber of Aspect 235, wherein the first salt is a transition metal salt comprising a cation of silver, copper, titanium, iron, nickel, zinc, gold, or combinations thereof.

Aspect 237. The composite fiber of any one of Aspect 232-Aspect 236, wherein the first salt comprises a Group I carbonate, a Group I halide, a Group I nitrate, a Group I sulfate, or combinations thereof.

Aspect 238. The composite fiber of any one of Aspect 232-Aspect 236, wherein the first salt comprises a Group II carbonate, a Group II halide, a Group II nitrate, a Group II sulfate, or combinations thereof.

Aspect 239. The composite fiber of any one of Aspect 232-Aspect 236, wherein the first salt comprises a transition metal carbonate, a transition metal halide, a transition metal nitrate, a transition metal sulfate, or combinations thereof.

Aspect 240. The composite fiber of any one of Aspect 232-Aspect 239, wherein the first salt comprises a Group I carbonate, a Group II carbonate, transition metal carbonate, or combinations thereof.

Aspect 241. The composite fiber of Aspect 240, wherein the first carbonate comprises magnesium carbonate, calcium carbonate, or combinations thereof.

Aspect 242. The composite fiber of any one of Aspect 232-Aspect 239, wherein the first salt comprises a Group I sulfate, a Group II sulfate, transition metal sulfate, or combinations thereof.

Aspect 243. The composite fiber of Aspect 240, wherein the first carbonate comprises sodium sulfate, potassium sulfate, calcium sulfate, magnesium sulfate, or combinations thereof.

Aspect 244. The composite fiber of Aspect 240, wherein the first carbonate comprises potassium sulfate.

Aspect 245. The composite fiber of any one of Aspect 232-Aspect 239, wherein the first salt comprises a Group I halide, a Group II halide, transition metal halide, or combinations thereof.

Aspect 246. The composite fiber of Aspect 245, wherein the first salt comprises iron (II) chloride, iron (III) chloride, sodium chloride, potassium chloride, calcium chloride, magnesium chloride, or combinations thereof.

Aspect 247. The composite fiber of Aspect 245, wherein the first salt comprises potassium chloride.

Aspect 248. The composite fiber of Aspect 214, wherein the second cooling component comprises Ag, Al, Ca, Cu, Fe, K, Mg, Si, Ti, or combinations thereof.

Aspect 249. The composite fiber of Aspect 248, wherein the Ag is present in an amount of about 0.1 wt % to about 10 wt % when determined by elemental analysis.

Aspect 250. The composite fiber of Aspect 248, wherein the Al is present in an amount of about 0.1 wt % to about 1 wt % when determined by elemental analysis.

Aspect 251. The composite fiber of Aspect 248, wherein the Ca is present in an amount of about 0.1 wt % to about 3 wt % when determined by elemental analysis.

Aspect 252. The composite fiber of Aspect 248, wherein the Cu is present in an amount of about 0.1 wt % to about 10 wt % when determined by elemental analysis.

Aspect 253. The composite fiber of Aspect 248, wherein the Fe is present in an amount of about 0.05 wt % to about 3 wt % when determined by elemental analysis.

Aspect 254. The composite fiber of Aspect 248, wherein the K is present in an amount of about 0.1 wt % to about 3 wt % when determined by elemental analysis.

Aspect 255. The composite fiber of Aspect 248, wherein the Mg is present in an amount of about 0.01 wt % to about 1.0 wt % when determined by elemental analysis.

Aspect 256. The composite fiber of Aspect 248, wherein the Si is present in an amount of about 0.1 wt % to about 3 wt % when determined by elemental analysis.

Aspect 257. The composite fiber of Aspect 248, wherein the Ti is present in an amount of about 0.01 wt % to about 1.0 wt % when determined by elemental analysis.

Aspect 258. The composite fiber of any one of Aspect 248-Aspect 258, wherein the second cooling component comprises a second mineral, a second carbide, a second nitride, a second oxide, a second salt, or combinations thereof.

Aspect 259. The composite fiber of Aspect 259, wherein the second mineral comprises dolomite, tourmaline, zircon, magnesia, magnesite, calcite, aragonite, zircon, allendeite, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof.

Aspect 260. The composite fiber of Aspect 260, wherein the second mineral comprises dolomite, tourmaline, zircon, magnesia, magnesite, calcite, aragonite, quartz, or combinations thereof.

Aspect 261. The composite fiber of Aspect 258, wherein the second carbide comprises silicon carbide.

Aspect 262. The composite fiber of Aspect 259, wherein the nitride comprises aluminum nitride, silicon nitride, silicon alumina nitride, or combinations thereof.

Aspect 263. The composite fiber of Aspect 258, wherein the oxide comprises aluminum oxide, copper (I) oxide, copper (II) oxide, iron (II) oxide, magnesium oxide, silicon dioxide, silver oxide, titanium oxide, titanium dioxide, titanium trioxide, zirconium oxide, or combinations thereof.

Aspect 264. The composite fiber of Aspect 263, wherein the oxide comprises aluminum oxide, magnesium oxide, silicon dioxide, titanium dioxide, or combinations thereof.

Aspect 265. The composite fiber of Aspect 258, wherein the second salt is a Group I salt, a Group II salt, a transition metal salt, or combinations thereof.

Aspect 266. The composite fiber of Aspect 265, wherein the second salt is a Group I salt.

Aspect 267. The composite fiber of Aspect 265, wherein the second salt is a Group II salt.

Aspect 268. The composite fiber of Aspect 265, wherein the second salt is a transition metal salt Aspect 269. The composite fiber of Aspect 268, wherein the second salt is a transition metal salt comprising a cation of silver, copper, titanium, iron, nickel, zinc, gold, or combinations thereof.

Aspect 270. The composite fiber of any one of Aspect 265-Aspect 269, wherein the second salt comprises a Group I carbonate, a Group I halide, a Group I nitrate, a Group I sulfate, or combinations thereof.

Aspect 271. The composite fiber of any one of Aspect 265-Aspect 269, wherein the second salt comprises a Group II carbonate, a Group II halide, a Group II nitrate, a Group II sulfate, or combinations thereof.

Aspect 272. The composite fiber of any one of Aspect 265-Aspect 269, wherein the second salt comprises a transition metal carbonate, a transition metal halide, a transition metal nitrate, a transition metal sulfate, or combinations thereof.

Aspect 273. The composite fiber of any one of Aspect 265-Aspect 269, wherein the second salt comprises a Group I carbonate, a Group II carbonate, transition metal carbonate, or combinations thereof.

Aspect 274. The composite fiber of Aspect 273, wherein the second carbonate comprises magnesium carbonate, calcium carbonate, or combinations thereof.

Aspect 275. The composite fiber of any one of Aspect 265-Aspect 269, wherein the second salt comprises a Group I sulfate, a Group II sulfate, transition metal sulfate, or combinations thereof.

Aspect 276. The composite fiber of Aspect 275, wherein the second carbonate comprises sodium sulfate, potassium sulfate, calcium sulfate, magnesium sulfate, or combinations thereof.

Aspect 277. The composite fiber of Aspect 275, wherein the second carbonate comprises potassium sulfate.

Aspect 278. The composite fiber of any one of Aspect 265-Aspect 269, wherein the second salt comprises a Group I halide, a Group II halide, transition metal halide, or combinations thereof.

Aspect 279. The composite fiber of Aspect 278, wherein the second salt comprises iron (II) chloride, iron (Ill) chloride, sodium chloride, potassium chloride, calcium chloride, magnesium chloride, or combinations thereof.

Aspect 280. The composite fiber of Aspect 278, wherein the second salt comprises potassium chloride.

Aspect 281. An article comprising the composite fiber of any one of Aspect 1-Aspect 280.

Aspect 282. The article of Aspect 281, wherein the article is an article of clothing.

Aspect 283. The article of 282, wherein the article of clothing is a pair of pants, a shirt, a jacket, a dress, or a skirt.

Aspect 284. The article of Aspect 281, wherein the article is an article of sportswear.

Aspect 285. The article of Aspect 281, wherein is the article is an article of drapery.

Aspect 286. The article of Aspect 281, wherein is the article is a floor covering.

Aspect 287. The article of Aspect 281, wherein is the article is a tote bag, a furniture cover, a tarpaulin, or a vehicle seat.

Aspect 288. A single covered yarn comprising:

(a) a core fiber comprising a composite fiber of any one of Aspect 1-Aspect 280; and (b) a first fiber comprising a cellulosic fiber;

wherein the first fiber is wound around the core yarn to form a single covered yarn.

Aspect 289. The single covered yarn of Aspect 288, wherein the cellulosic fiber is a regenerated cellulosic fiber.

Aspect 290. The single covered yarn of Aspect 289, wherein the regenerated cellulosic fiber is a viscose rayon, a high wet modulus rayon, a cuprammonium rayon, a saponified rayon, a modal rayon, a lyocell rayon, or combinations thereof.

Aspect 291. The single covered yarn of Aspect 289, wherein the regenerated cellulosic fiber is a viscose rayon.

Aspect 292. The single covered yarn of any one of Aspect 288-Aspect 291, wherein the first fiber has a weight of about 105 d/20f to about 130 d/40f.

Aspect 293. The single covered yarn of Aspect 292, wherein the first fiber has a weight of about 115 d/25f to about 135 d/35f.

Aspect 294. The single covered yarn of Aspect 292, wherein the first fiber has a weight of about 120 d/30f±10%.

Aspect 295. The single covered yarn of Aspect 292, wherein the first fiber has a weight of about 120 d/30f±5%.

Aspect 296. The single covered yarn of Aspect 292, wherein the first fiber has a weight of about 120 d/30f±3%.

Aspect 297. The single covered yarn of any one of Aspect 288-Aspect 296, wherein the single covered yarn has a weight of about 250 denier to about 350 denier.

Aspect 298. The single covered yarn of Aspect 297, wherein the single covered yarn has a weight of about 270 denier to about 330 denier.

Aspect 299. The single covered yarn of Aspect 297, wherein the single covered yarn has a weight of about 280 denier to about 320 denier.

Aspect 300. The single covered yarn of Aspect 297, wherein the single covered yarn has a weight of about 285 denier to about 310 denier.

Aspect 301. The single covered yarn of Aspect 297, wherein the single covered yarn has a weight of about 290 denier±10%.

Aspect 302. The single covered yarn of Aspect 297, wherein the single covered yarn has a weight of about 290 denier±5%.

Aspect 303. The single covered yarn of Aspect 297, wherein the single covered yarn has a weight of about 290 denier±3%.

Aspect 304. The single covered yarn of any one of Aspect 288-Aspect 296, wherein the single covered yarn has a weight of about 250 denier to about 360 denier.

Aspect 305. The single covered yarn of Aspect 297, wherein the single covered yarn has a weight of about 270 denier to about 360 denier.

Aspect 306. The single covered yarn of Aspect 297, wherein the single covered yarn has a weight of about 280 denier to about 360 denier.

Aspect 307. The single covered yarn of Aspect 297, wherein the single covered yarn has a weight of about 285 denier to about 360 denier.

Aspect 308. The single covered yarn of Aspect 297, wherein the single covered yarn has a weight of about 350 denier±10%.

Aspect 309. The single covered yarn of Aspect 297, wherein the single covered yarn has a weight of about 350 denier±5%.

Aspect 310. The single covered yarn of Aspect 297, wherein the single covered yarn has a weight of about 350 denier±3%.

Aspect 311. An article comprising the single covered yarn of any one of Aspect 288-Aspect 310.

Aspect 312. The article of Aspect 311, wherein the article is an article of clothing.

Aspect 313. The article of Aspect 312, wherein the article of clothing is a pair of pants, a shirt, a jacket, a dress, an article of intimate apparel, or a skirt.

Aspect 314. The article of Aspect 311, wherein the article is an article of sportswear.

Aspect 315. The article of Aspect 311, wherein is the article is an article of drapery.

Aspect 316. The article of Aspect 311, wherein is the article is a floor covering.

Aspect 317. The article of Aspect 311, wherein is the article is a tote bag, a furniture cover, a tarpaulin, or a vehicle seat.

Aspect 318. A fabric comprising the single covered yarn of any one of Aspect 288-Aspect 310.

Aspect 319. The fabric of Aspect 318, wherein the fabric is a woven fabric.

Aspect 320. The fabric of Aspect 319, where the fabric comprises a weft yarn comprising the single covered yarn of any one of Aspect 288-Aspect 311; and a warp yarn comprising cellulosic fibers, a polyamide yarn, a polyester yarn, or combinations thereof.

Aspect 321. The fabric of Aspect 319 or Aspect 320, wherein the fabric has a fabric weight of about 70 gsm to about 250 gsm.

Aspect 322. The fabric of Aspect 321, wherein the fabric has a fabric weight of about 70 gsm to about 90 gsm.

Aspect 323. The fabric of Aspect 321, wherein the fabric has a fabric weight of about 90 gsm to about 120 gsm.

Aspect 324. The fabric of Aspect 321, wherein the fabric has a fabric weight of about 120 gsm to about 250 gsm.

Aspect 325. The fabric of Aspect 321, wherein the fabric has a fabric weight of about 170 gsm to about 210 gsm.

Aspect 326. The fabric of Aspect 318, wherein the fabric is a knit fabric.

Aspect 327. The fabric of Aspect 326, wherein the fabric is a weft knit fabric.

Aspect 328. The fabric of Aspect 327, wherein the fabric has a wale of about 50 to about 70; and the fabric has a course of about 30 to about 60.

Aspect 329. The fabric of any one of Aspect 318-Aspect 328, wherein the fabric has a Qmax value of about 0.15 to about 0.50 when determined in accordance with FTTS-FA-019 as specified by Committee of Conformity Assessment of Accreditation and Certification on Functional and Technical Textiles (Taiwan).

Aspect 330. The fabric of Aspect 329, wherein the fabric has a Qmax value of about 0.16 to about 0.25.

Aspect 331. The fabric of Aspect 329, wherein the fabric has a Qmax value of about 0.16 to about 0.200±10%.

Aspect 332. The fabric of Aspect 330, wherein the fabric has a Qmax value of about 0.16 to about 0.200±5%.

Aspect 333. The fabric of Aspect 329, wherein the fabric has a Qmax value of about 0.16 to about 0.200±3%.

Aspect 334. The fabric of Aspect 329, wherein the fabric has a Qmax value of about 0.17 to about 0.25.

Aspect 335. The fabric of Aspect 329, wherein the fabric has a Qmax value of about 0.18 to about 0.20±10%.

Aspect 336. The fabric of Aspect 329, wherein the fabric has a Qmax value of about 0.18 to about 0.20±5%.

Aspect 337. The fabric of Aspect 329, wherein the fabric has a Qmax value of about 0.18 to about 0.20±3%.

Aspect 338. The fabric of any one of Aspect 318-Aspect 337, wherein the fabric has a wicking time of less than about 5 minutes for water to rise 20 mm in length when determined in accordance with AATCC Test Method 197.

Aspect 339. The fabric of Aspect 338, wherein the fabric has a wicking time of about 2 minutes for the water to rise 20 mm in length.

Aspect 340. The fabric of Aspect 338, wherein the fabric has a wicking time of about 5 minutes for the water to rise 20 mm in length.

Aspect 341. The fabric of Aspect 338, wherein the fabric has a wicking time of about 1 minutes for the water to rise 20 mm in length.

Aspect 342. The fabric of any one of Aspect 318-Aspect 341, wherein the fabric has a drying rate of less than about 2.5 ml/hr when determined in accordance with AATCC Test Method 201.

Aspect 343. The fabric of Aspect 342, wherein the fabric has a drying rate of about 0.5 ml/hr to about 1.5 ml/hr.

Aspect 344. The fabric of Aspect 342, wherein the fabric has a drying rate of about 0.5 ml/hr to about 1.0 ml/hr.

Aspect 345. The fabric of Aspect 342, wherein the fabric has a drying rate of about 0.7 ml/hr to about 1.0 ml/hr.

Aspect 346. The fabric of Aspect 342, wherein the fabric has a drying rate of about 0.5 ml/hr to about 0.9 ml/hr.

Aspect 347. An article comprising the fabric of any one of Aspect 318-346.

Aspect 348. The article of Aspect 347, wherein the article is an article of clothing.

Aspect 349. The article of Aspect 348, wherein the article of clothing is a pair of pants, a shirt, a jacket, a dress, an article of intimate apparel, or a skirt.

Aspect 350. The article of Aspect 348, wherein the article is an article of sportswear.

Aspect 351. The article of Aspect 348, wherein is the article is an article of drapery.

Aspect 352. The article of Aspect 348, wherein is the article is a floor covering.

Aspect 353. The article of Aspect 348, wherein is the article is a tote bag, a furniture cover, a tarpaulin, or a vehicle seat.

From the foregoing, it will be seen that aspects herein are well adapted to attain all the ends and objects hereinabove set forth together with other advantages which are obvious and which are inherent to the structure.

While specific elements and steps are discussed in connection to one another, it is understood that any element and/or steps provided herein is contemplated as being combinable with any other elements and/or steps regardless of explicit provision of the same while still being within the scope provided herein.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings and detailed description is to be interpreted as illustrative and not in a limiting sense.

It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

H. Examples

The following examples are put forth so as to provide those of ordinary skill in the art with a complete disclosure and description of how the compounds, compositions, articles, devices and/or methods claimed herein are made and evaluated, and are intended to be purely exemplary of the disclosure and are not intended to limit the scope of what the inventors regard as their disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1

Exemplary Disclosed Fabric.

Representative disclosed fabric samples were prepared using a disclosed single-covered yarn comprising a disclosed composite fiber with a core-sheath structure. The characteristics of the representative fabric samples and their identifiers are shown below in Table 1.

TABLE 1

| No. | Identifier | Fabric | Fabric Content* | Fabric Construction | Cuttable Width | Fabric Weight# | Fabric Count (# warp × # weft) | Warp Count | Weft Count |
|---|---|---|---|---|---|---|---|---|---|
| 1 | Ex. 1 | Woven | 30% Nylon**, 40% Rayon Core Component, 12% Sheath Component, 6% Spandex | 1/1 plain 12% | 56 inches weave | 195 | 104 × 84 | 10.7 Tex (96.3 D) | 33.3 Tex (299.7 D) |
| 2 | Ex. 2 | Woven | 48% Nylon**, 32% Rayon, Core Component, 10% Sheath Component | 2/1 twill 10% | 60 inches | 105 | 154 × 88 | 7.6 Tex (68.4D) | 15.8 Tex (142.2D) |
| 3 | Ex. 3 | Woven | 51% Nylon**, 31% Rayon, 9% Core Component, 9% Sheath Component | 1/1 (poplin) | 60 inches | 104 | 154 × 82 | 7.8 Tex (70.2D) | 16.0 Tex (144.0 D) |
| 4 | Ex. 4 | Knit | 59% Rayon, 18% Core Component, 18% Sheath Component, 5% Spandex | Jersey | 56 inches | 185 | Not applicable | Not applicable | 16.4 Tex (36.0's/1) |

*Rayon, core component, and sheath component are in a single-covered yarn prepared according to the present disclosure; the single covered yarn was used in the weft yarn of the woven example fabrics.

**Nylon was in the warp yarn of the woven example fabrics.

#Fabric weight is given in grams per square meter (gsm).

The single-covered yarn in the weft yarn comprised a composite fiber comprising a core component and sheath component that comprised, by elemental analysis, the indicated levels of elements as shown in Tables 2 and 3, respectively, below.

TABLE 2*

| Element | Ex. 1 | Ex. 2 | Ex. 3 | Ex. 4 |
|---|---|---|---|---|
| Ag | — | 5.00 | — | 3.30 |
| Al | 0.65 | — | 0.35 | 0.15 |
| Ca | 0.30 | 1.80 | 0.30 | 0.15 |
| Cl | 0.05 | — | — | — |
| Cu | 6.40 | 0.25 | 3.30 | 0.10 |
| Fe | 0.40 | 1.75 | 0.25 | 0.05 |
| K | 1.10 | 3.70 | 1.00 | — |
| Mg | 0.15 | 0.15 | 0.15 | — |
| P | — | 0.25 | 0.10 | — |
| S | 0.05 | 0.15 | 0.05 | 0.25 |
| Si | 2.20 | 1.60 | 0.50 | 0.15 |
| Ti | — | 0.20 | — | — |
| Total | 11.30 | 14.85 | 6.00 | 4.15 |

*weight percent of the indicated element in the core component as determined by elemental analysis.

TABLE 3**

| Element | Ex. 1 | Ex. 2 | Ex. 3 | Ex. 4 |
|---|---|---|---|---|
| Ag | — | 5.00 | — | 3.30 |
| Al | 0.65 | — | 0.35 | 0.15 |
| Ca | 0.30 | 1.80 | 0.30 | 0.15 |
| Cl | 0.05 | — | — | — |
| Cu | 6.40 | 0.25 | 3.30 | 0.10 |
| Fe | 0.40 | 1.75 | 0.25 | 0.05 |
| K | 1.10 | 3.70 | 1.00 | — |
| Mg | 0.15 | 0.15 | 0.15 | — |
| P | — | 0.25 | 0.10 | — |
| S | 0.05 | 0.15 | 0.05 | 0.25 |

TABLE 3**-continued

| Element | Ex. 1 | Ex. 2 | Ex. 3 | Ex. 4 |
|---|---|---|---|---|
| Si | 2.20 | 1.60 | 0.50 | 0.15 |
| Ti | — | 0.20 | — | — |
| Total | 11.30 | 14.85 | 6.00 | 4.15 |

**weight percent of the indicated element in the sheath component as determined by elemental analysis.

The foregoing cooling composition amounts are those as determined in the sheath component and core component by elemental analysis and quantitative compositional analysis performed using field emission scanning electron microscope (FESEM) carried out with a FEI Teneo scanning electron microscope (FEI, Inc., Hillsboro, Oreg., U.S.) equipped with an extremely large area detector for energy-dispersive spectroscopy (150 mm Oxford XMaxN; Oxford Instruments, Concord, Massachussetts, U.S.). Elemental analysis capability was provided using the Aztec Energy software (Oxford Instruments). The area of analysis was chosen under "Scan Image" option. The raw elemental analysis was carried out under the "Acquire spectra" option and the final average analysis was presented under the "Fitted spectra tool."

Figure 2A:
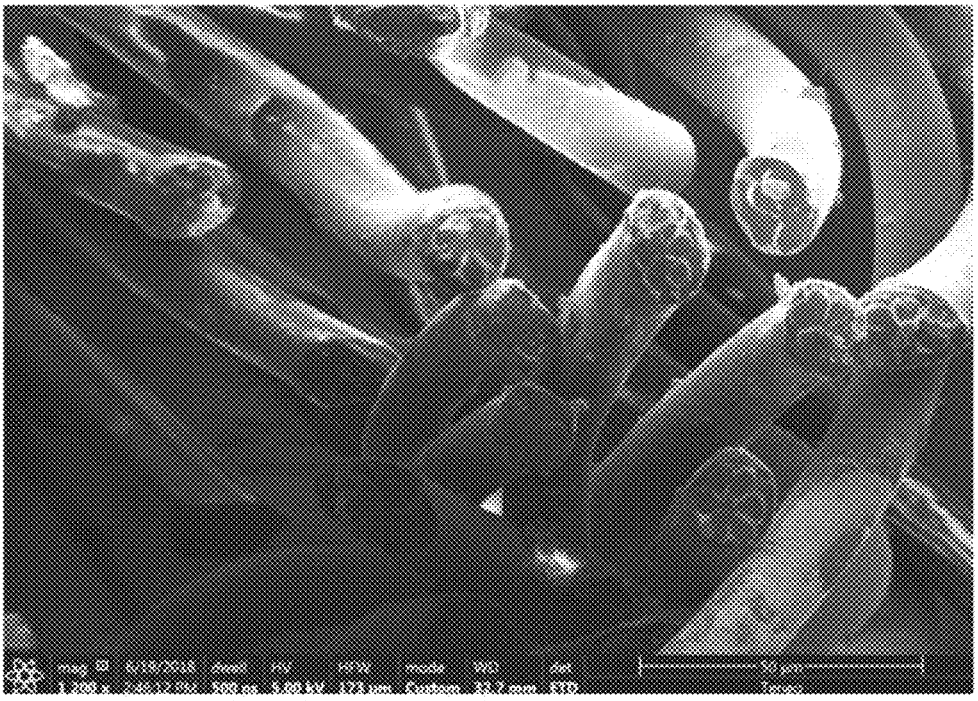
FIGS. 2A-2C show representative scanning electron micrograph (SEM) images cross-sectional ends a disclosed composite fiber.
Figure 2B:
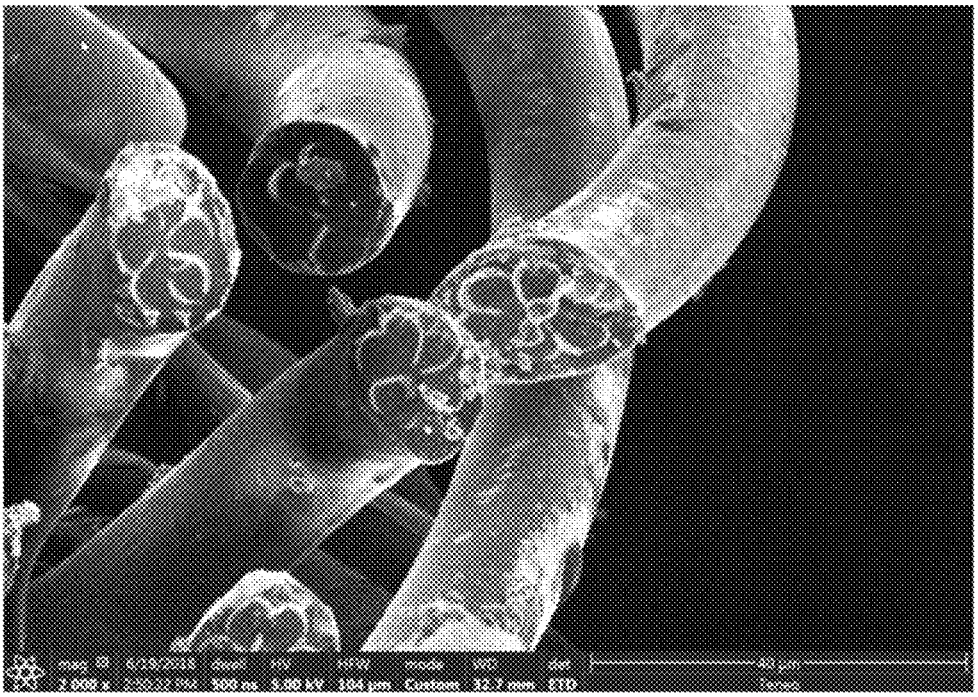
Figure 2C:
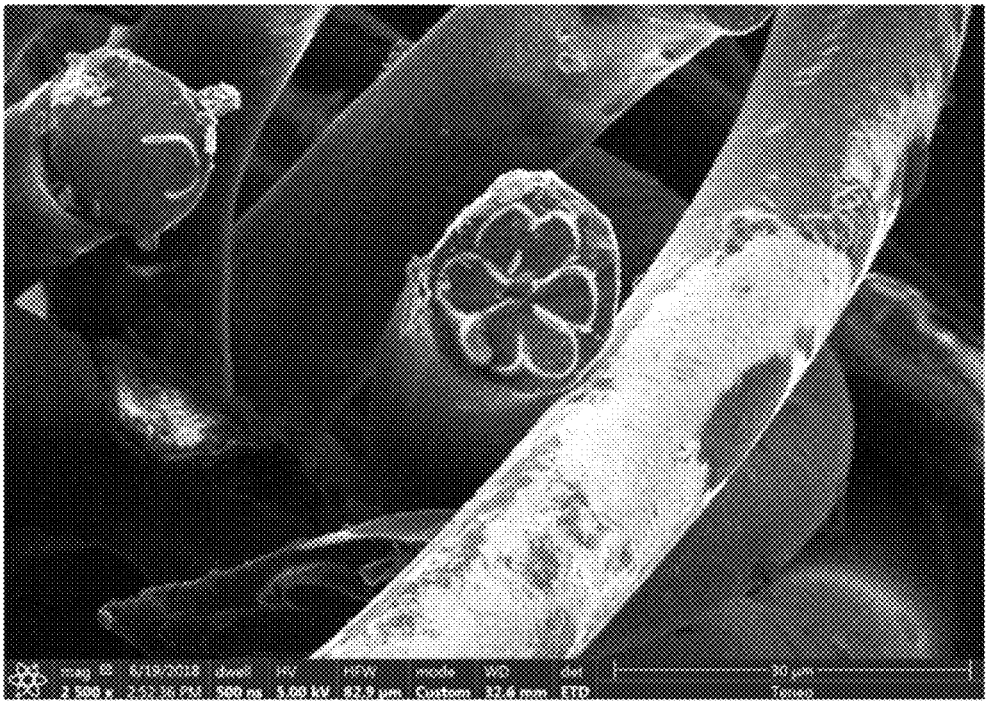
Figure 3A:
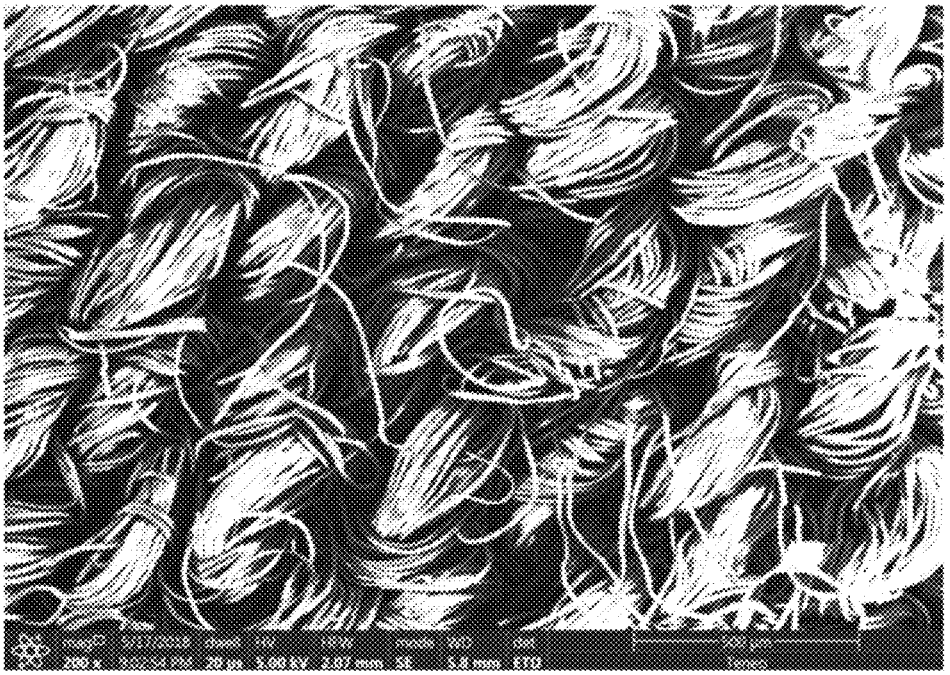
FIGS. 3A-3B show representative scanning electron micrograph (SEM) images of a disclosed knit fabric comprising a disclosed single-covered yarn.
Figure 3B:
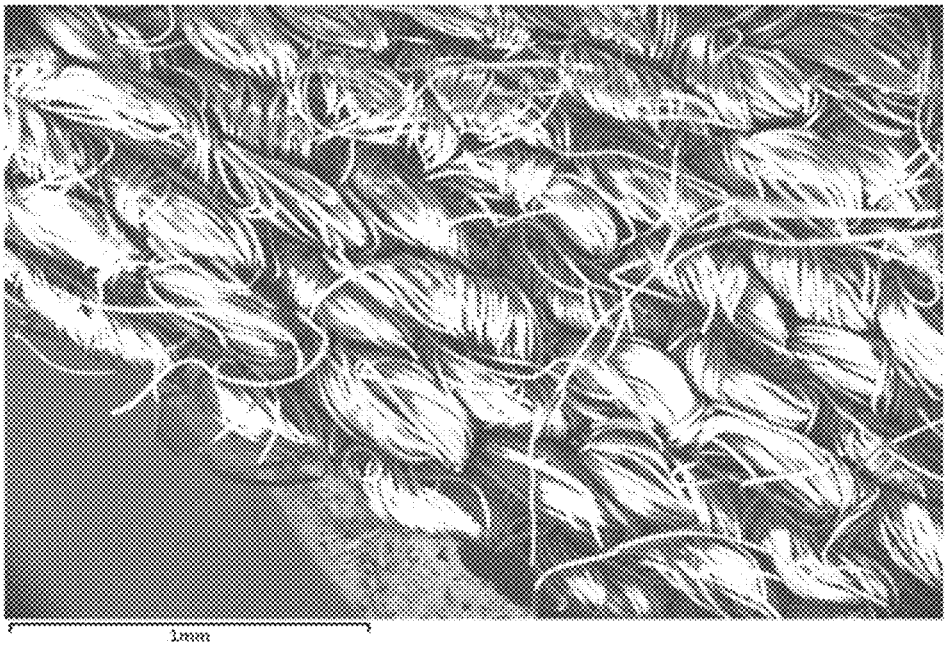
Figure 4A:
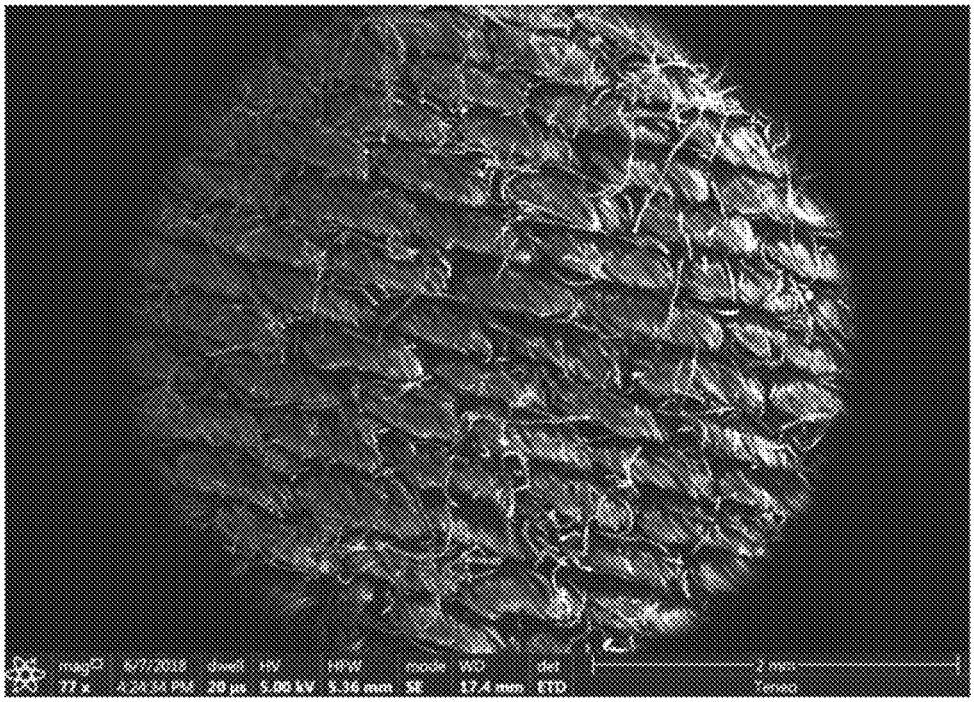
FIGS. 4A-4C show representative scanning electron micrograph (SEM) images of a disclosed woven fabric comprising a disclosed single-covered yarn.
Figure 4B:
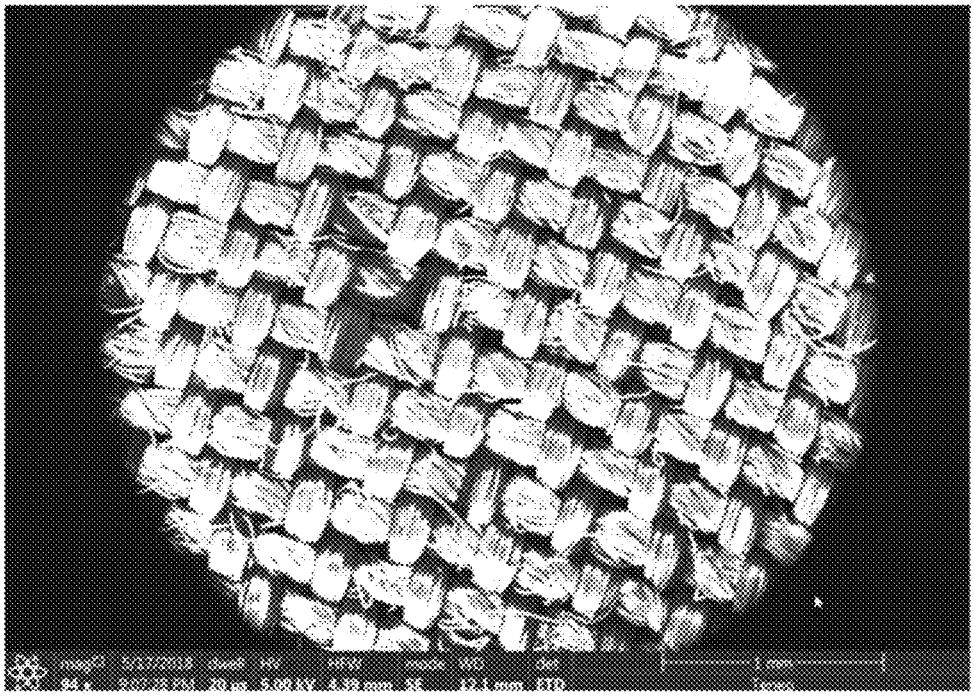
Figure 4C:
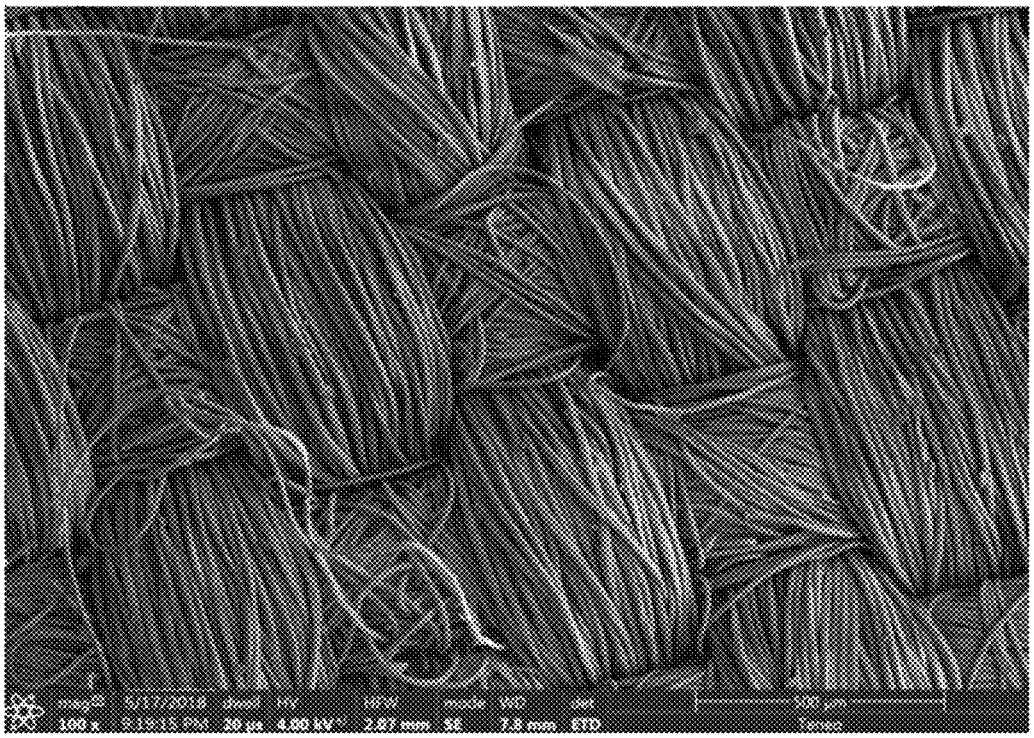
Figure 5:
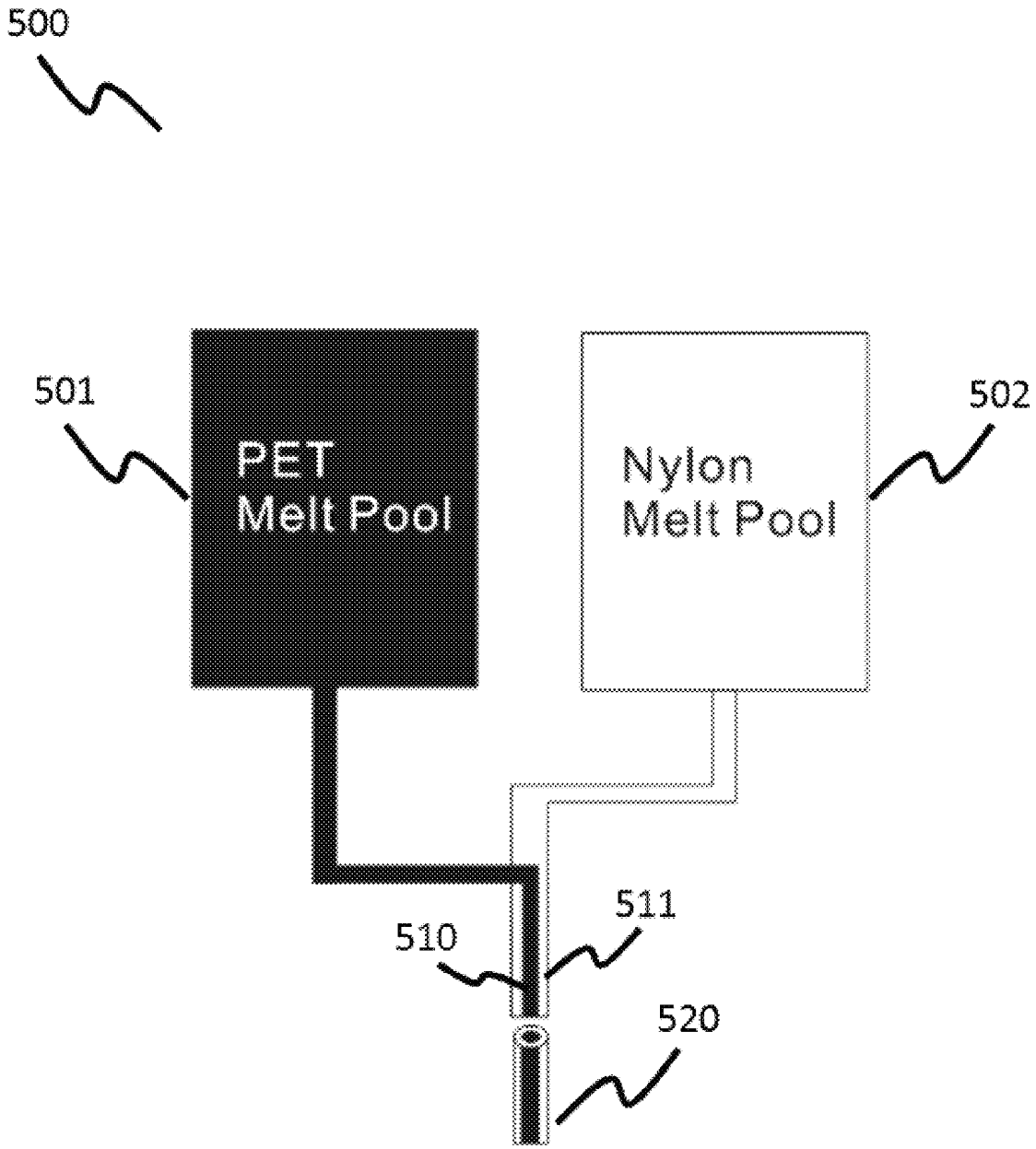
FIG. 5 shows a representative schematic view of a disclosed process, 500, to prepare a disclosed composite fiber with indicia numbers as follows: a reservoir, such as a hopper, having a PET melt pool comprising a PET and a first cooling composition, 501; a reservoir, such as a hopper, having a nylon melt pool comprising a nylon and a second cooling composition, 502; an inner spinneret assembly, 510, for ejecting the core of a composite fiber; an outer spinneret assembly, 511, for ejecting the sheath component around the core of a composite fiber; and the composite fiber, 520, formed by the process.

Representative scanning electron micrograph (SEM) images are shown in FIGS. 2A-2C of the representative cross-sectional ends a disclosed composite fiber used in this example. Representative SEM images are shown in FIGS. 3A-3B of a disclosed knit fabric comprising a disclosed single-covered yarn used in the representative disclosed knit fabric sample of this example. Representative SEM images are shown in FIGS. 4A-4C of a disclosed woven fabric comprising a disclosed single-covered yarn used in representative disclosed woven fabric samples of this example. All SEM images were obtained at the Georgia Electron Microscopy Center (University of Georgia, 151 Barrow Hall, 115 D.W. Brooks Drive, Athens Ga. 30602, USA).

Conventional Fabrics.

Representative conventional fabric samples were used for comparison to the representative disclosed fabrics. The conventional fabric samples are as shown below in Table 4.

TABLE 4

| No. | Identifier | Fabric | Fabric Content* | Fabric Construction | Cuttable Width | Fabric Weight# | Fabric Count (# warp × # weft) | Warp Count | Weft Count |
|---|---|---|---|---|---|---|---|---|---|
| 1 | Comp. 1 | Woven | 100% Rayon | Plain weave | 59 | 130 | 72 × 86 | 20.7 Tex (28.5's/1) | 20.4 Tex (28.9's/1) |
| 2 | Comp. 2 | Woven | 87% Tencel, 13% Polyester | Poplin | 58 | 147 | 100 × 80 | — | |
| 3 | Comp. 3 | Knit | 95% Rayon, 5% spandex | Jersey | 60 | 194 | Not applicable | Not applicable | 6.4 tex (36.0's/1) |

*Rayon, core component, and sheath component are in a single-covered yarn prepared according to the present disclosure; the single covered yarn was used in the weft yarn of the woven example fabrics.
**Nylon was in the warp yarn of the woven example fabrics.
#Fabric weight is given in grams per square meter (gsm).

Fabric Characteristics. The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 200 ("Drying Rate of Textiles at their Absorbent Capacity: Air Flow Method") and AATCC 201 ("Drying Rate of Fabrics: Heated Plate Method"); and (c) wicking in length and width directions was determined in accordance with AATCC 197 ("Vertical Wicking of Textiles"). The data obtained in these tests are given below in Table 5. All tests were conducted by Intertek Testing Services Taiwan Ltd. (8F, No. 423, Ruiguang Rd., Neihu District, Taipei 11492, Taiwan (R.O.C.).

TABLE 5

| Test Sample | Q max[1] | Thermal Resistance[2] | Thermal Conductance[‡] | Drying Time[†] | Drying Rate[††] | Wicking* | Wicking** |
|---|---|---|---|---|---|---|---|
| Ex. 1 | 0.197 | 0.008 | 125 | 8.05 | 1.49 | 1 | 1 |
| Ex. 2 | 0.174 | 0.005 | 200 | 2.86 | 4.2 | 2 | 1 |
| Ex. 3 | 0.192 | 0.003 | 333 | 3.18 | 3.77 | 3 | 1 |
| Comp. 1 | 0.125 | 0.031 | 32.3 | 14.44 | 0.83 | 2 | 1 |
| Comp. 2 | 0.179 | n.d. | n.d. | 7.15 | 1.68 | 2 | 2 |
| Ex. 4 | 0.173 | 0.01 | 100 | 8.86 | 1.35 | 1 | 1 |
| Comp. 3 | 0.122 | 0.018 | 55.6 | 13.75 | 0.87 | 1 | 1 |

[1] Reported in $W/cm^2$ and carried out per FTTS-FA-019.
[2] Reported in $Km^2/M$ and carried out per ISO 11092:2014.
[‡]Reported in $W/Km^2$ and carried out per ISO 11092:2014.
[†]Reported in minutes and carried out per AATCC 201.
[††]Reported in ml/hr and carried out per AATCC 201.
*Reported in time (minutes) for water level to reach 20 mm length direction and carried out per AATCC 197.
**Reported in time (minutes) for water level to reach 20 mm in the width direction per AATCC 197.
n.d. indicates that the test was not performed on the indicated sample.

The data in Table 5 show that a representative disclosed fabrics have surprisingly superior thermal characteristics as exhibited up to a 41% and 57% enhanced Qmax values for the knit and woven fabric examples, respectively. Thermal conductance improved up to 10.3-fold (cf. a thermal conductance of 333 $W/Km^2$ for the representative disclosed fabric example 2 versus over 32.3 $W/Km^2$ for a conventional 100% rayon fabric, Comp. 1).

Figure 7:
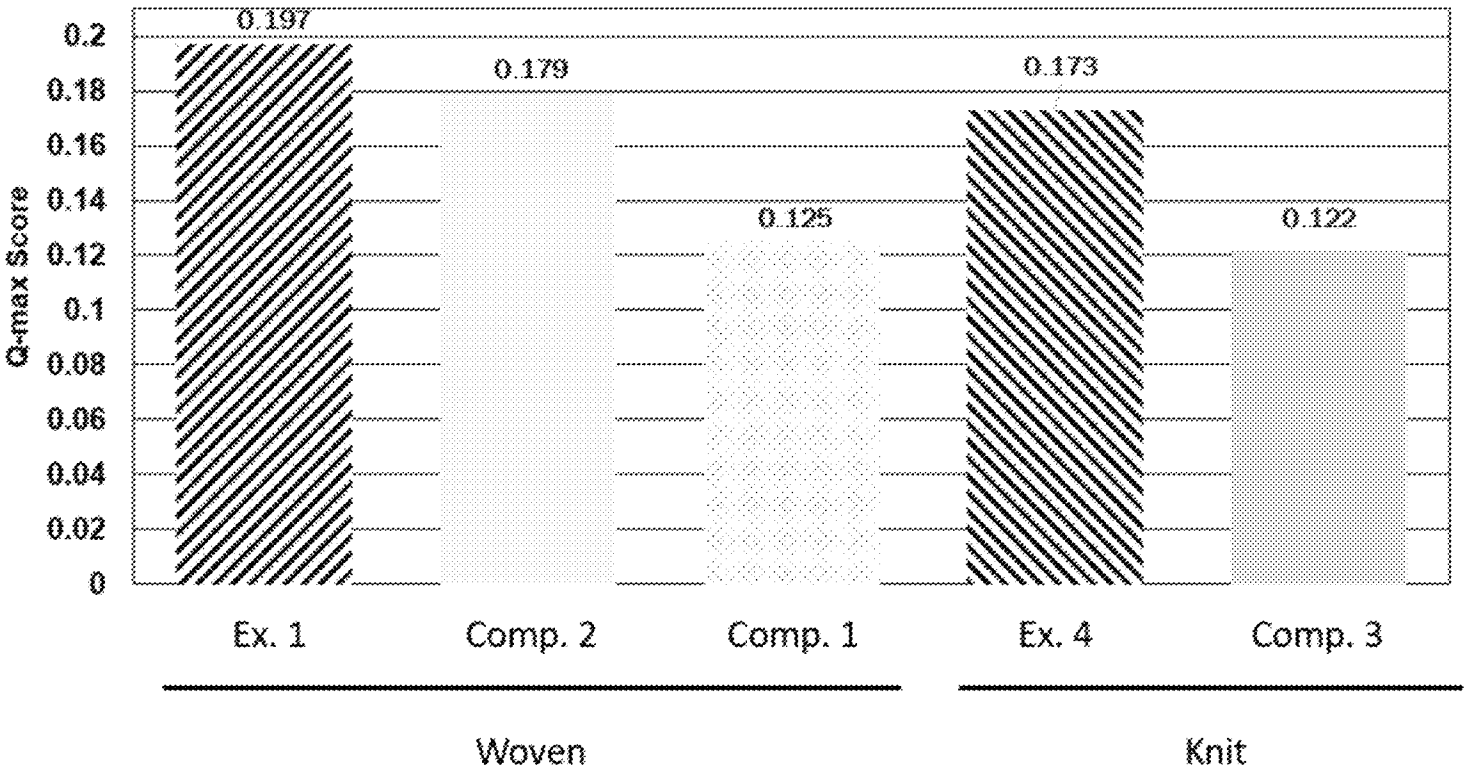
FIG. 7 shows representative Qmax data for disclosed fabrics comprising a disclosed composite fiber. The composition and structure of the indicated fabrics are as provided in the Examples.
Figure 8:
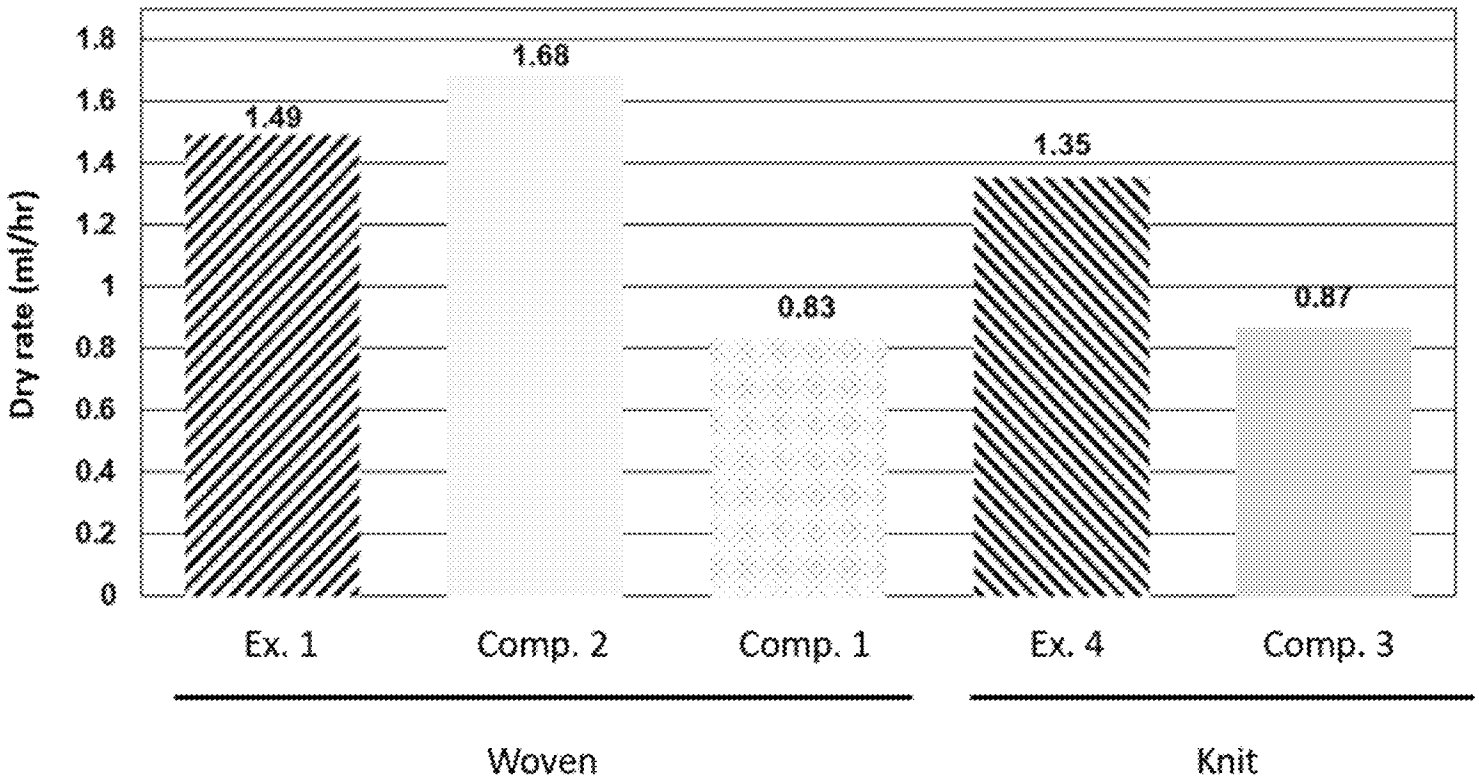
FIG. 8 shows representative drying rate data for disclosed fabrics comprising a disclosed composite fiber. The composition and structure of the indicated fabrics are as provided in the Examples.
Figure 9:
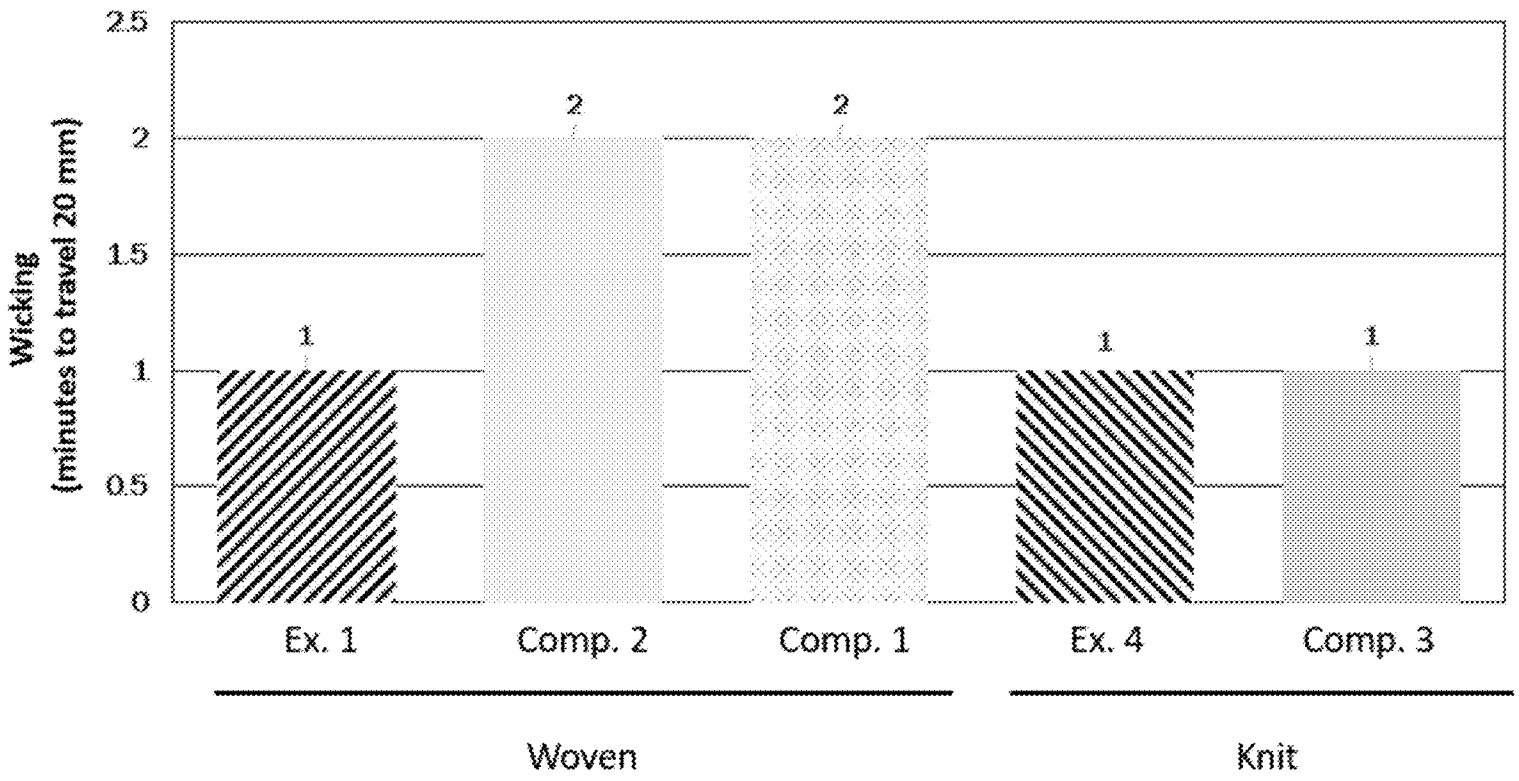
FIG. 9 shows representative wicking data for disclosed fabrics comprising a disclosed composite fiber. The composition and structure of the indicated fabrics are as provided in the Examples.

Improvements were also observed for both woven and knit representative examples in drying and wicking behavior. For example, the representative disclosed fabrics demonstrated up to a 500% faster drying time compared to the a sample (cf. a dry time of 2.86 minutes for the representative disclosed fabric example 2 versus over 14.44 minutes for a conventional 100% rayon fabric, Comp. 1). The improved drying rates were similarly improved. The foregoing improvements were attainable while using a 100% cotton yarn in the warp weave, but incorporating a disclosed double-covered yarn in the weft weave. Some of the data in Table 5 are also plotted and shown in FIGS. 7-9, which show Qmax, drying rate, and wicking behavior (time in minutes for water level to reach 20 mm–length direction) for Ex. 1 and 4 compared to conventional samples, Comp. 1-3.

In the aggregate, the disclosed representative fabrics showed surprisingly significant improvements in a number of characteristics and properties compared to a conventional denim fabric.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A single covered yarn comprising:

(a) a core fiber comprising a composite fiber; and (b) a first fiber comprising a cellulosic fiber;

wherein the composite fiber comprises a core component and a sheath component;

wherein the core component comprises a polyester polymer and a first cooling composition;

wherein the sheath component comprises a polyamide polymer and a second cooling composition;

wherein the first cooling composition is present in an amount of about 1 wt % to about 20 wt % based on the weight of the polyester polymer and the first cooling composition;

wherein the first cooling composition comprises Ag, Al, Ca, Cu, Fe, K, Mg, Si, Ti, or combinations thereof present in at least one ionic or covalent compound;

wherein the second cooling composition is present in an amount of about 1 wt % to about 20 wt % based on the weight of the polyamide polymer and the second cooling composition;

wherein the second cooling composition comprises Ag, Al, Ca, Cu, Fe, K, Mg, Si, Ti, or combinations thereof present in an at least one ionic or covalent compound; and wherein the first fiber is wound around the core yarn to form a single covered yarn.

2. The single covered yarn of claim 1, wherein the first cooling composition comprises one or more of:

(a) Ag in an amount of about 0.1 wt % to about 10 wt % as determined in the composite fiber by elemental analysis;

(b) Al in an amount of about 0.1 wt % to about 1 wt % as determined in the composite fiber by elemental analysis;

(c) Ca in an amount of about 0.1 wt % to about 3 wt % as determined in the composite fiber by elemental analysis;

(d) Cu in an amount of about 0.1 wt % to about 10 wt % as determined in the composite fiber by elemental analysis;

(e) Fe in an amount of about 0.05 wt % to about 3 wt % as determined in the composite fiber by elemental analysis;

(f) K in an amount of about 0.1 wt % to about 3 wt % as determined in the composite fiber by elemental analysis;

(g) Mg in an amount of about 0.01 wt % to about 1.0 wt % as determined in the composite fiber by elemental analysis;

(h) Si in an amount of about 0.1 wt % to about 3 wt % as determined in the composite fiber by elemental analysis; and (i) Ti in an amount of about 0.01 wt % to about 1.0 wt % as determined in the composite fiber by elemental analysis.

3. The single covered yarn of claim 1, wherein the second cooling composition comprises one or more of:

(a) Ag in an amount of about 0.1 wt % to about 10 wt % as determined in the composite fiber by elemental analysis;

(b) Al in an amount of about 0.1 wt % to about 1 wt % as determined in the composite fiber by elemental analysis;

(c) Ca in an amount of about 0.1 wt % to about 3 wt % as determined in the composite fiber by elemental analysis;

(d) Cu in an amount of about 0.1 wt % to about 10 wt % as determined in the composite fiber by elemental analysis;

(e) Fe in an amount of about 0.05 wt % to about 3 wt % as determined in the composite fiber by elemental analysis;

(f) K in an amount of about 0.1 wt % to about 3 wt % as determined in the composite fiber by elemental analysis;

(g) Mg in an amount of about 0.01 wt % to about 1.0 wt % as determined in the composite fiber by elemental analysis;

(h) Si in an amount of about 0.1 wt % to about 3 wt % as determined in the composite fiber by elemental analysis; and (i) Ti in an amount of about 0.01 wt % to about 1.0 wt % as determined in the composite fiber by elemental analysis.

4. The single covered yarn of claim 1, wherein the composite fiber comprises about 30 wt % to about 60 wt % of the polyester and the first cooling composition, and about 30 wt % to about 60 wt % of the polyamide and the second cooling composition.

5. The single covered yarn of claim 4, wherein the composite fiber comprises about 45 wt % to about 55 wt % of the polyester and the first cooling composition, and about 45 wt % to about 55 wt % of the polyamide and the second cooling composition.

6. The single covered yarn of claim 1, wherein the cellulosic fiber is a regenerated cellulosic fiber.

7. The single covered yarn of claim 6, wherein the regenerated cellulosic fiber is a viscose rayon, a high wet modulus rayon, a cuprammonium rayon, a saponified rayon, a modal rayon, a lyocell rayon, or combinations thereof.

8. The single covered yarn of claim 7, wherein the regenerated cellulosic fiber is a viscose rayon.

9. The single covered yarn of claim 1, wherein the composite fiber has a weight of about 140 D to about 400 D.

10. The single covered yarn of claim 1, wherein the first fiber has a weight of about 70 D to about 95 D.

11. A fabric comprising the single covered yarn of claim 1.

12. The fabric of claim 11, wherein the fabric is a woven fabric.

13. The fabric of claim 11, wherein the fabric comprises a weft yarn comprising the single covered yarn of claim 1; and a warp yarn comprising cellulosic fibers, a polyamide yarn, a polyester yarn, or combinations thereof.

14. The fabric of claim 11, wherein the fabric has a fabric weight of about 70 gsm to about 250 gsm.

15. The fabric of claim 11, wherein the fabric has a Qmax value of about 0.15 $W/cm^2$ to about 0.30 $W/cm^2$ when determined in accordance with FTTS-FA-019 as specified by Committee of Conformity Assessment of Accreditation and Certification on Functional and Technical Textiles (Taiwan).

16. The fabric of claim 11, wherein the fabric has a thermal conductance of about 110 $W/K\text{-}m^2$ to about 500 $W/K\text{-}m^2$ when determined in accordance with ISO 11092.

17. The fabric of claim 11, wherein the fabric has a wicking time of less than about 5 minutes for water to rise 20 mm in length when determined in accordance with AATCC Test Method 197.

18. The fabric of claim 11, wherein the fabric has a drying rate of less than about 2.5 ml/hr when determined in accordance with AATCC Test Method 201.

19. An article comprising the fabric of claim 11.

20. The article of claim 19, wherein the article is a pair of pants, a shirt, a jacket, a dress, an article of intimate apparel, or a skirt.

* * * * *